US008089409B2

(12) United States Patent
Shibata

(10) Patent No.: US 8,089,409 B2
(45) Date of Patent: Jan. 3, 2012

(54) PATCH ANTENNA DEVICE AND ANTENNA DEVICE

(75) Inventor: Osamu Shibata, Kawasaki (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 305 days.

(21) Appl. No.: 12/435,696

(22) Filed: May 5, 2009

(65) Prior Publication Data

US 2009/0224981 A1 Sep. 10, 2009

Related U.S. Application Data

(63) Continuation of application No. PCT/JP2007/066291, filed on Aug. 22, 2007.

(30) Foreign Application Priority Data

Nov. 6, 2006 (JP) ..... 2006-300591
Nov. 6, 2006 (JP) ..... 2006-300592
Nov. 6, 2006 (JP) ..... 2006-300593
Feb. 5, 2007 (JP) ..... 2007-025436
Feb. 8, 2007 (JP) ..... 2007-029228

(51) Int. Cl.
*H01Q 1/24* (2006.01)

(52) U.S. Cl. ..... 343/700 MS

(58) Field of Classification Search ..... 343/700 MS, 343/829, 846

See application file for complete search history.

(56) References Cited

U.S. PATENT DOCUMENTS 4,835,538 A * 5/1989 McKenna et al. ..... 343/700 MS
5,153,600 A 10/1992 Metzler et al.
5,210,542 A * 5/1993 Pett et al. ..... 343/700 MS
5,243,353 A * 9/1993 Nakahara et al. ..... 343/700 MS
5,539,420 A 7/1996 Dusseux et al.
5,594,455 A * 1/1997 Hori et al. ..... 343/700 MS
5,896,107 A * 4/1999 Huynh ..... 343/700 MS
6,184,833 B1 2/2001 Tran
6,384,785 B1 5/2002 Kamogawa et al.

(Continued)

FOREIGN PATENT DOCUMENTS

EP 0 426 972 5/1991

(Continued)

OTHER PUBLICATIONS

Official Communication issued in corresponding Japanese Patent Application No. 2010-155770, mailed on Feb. 21, 2011.

(Continued)

*Primary Examiner* — Tho G Phan
(74) *Attorney, Agent, or Firm* — Keating & Bennett, LLP

(57) ABSTRACT

A patch antenna device and an antenna device that are miniaturized while avoiding degradation of radiation characteristics, such as gain and efficiency. A first electrode is formed on a front surface of a rectangular parallelepiped-shaped dielectric substrate. A second electrode is formed on a rear surface of the dielectric substrate. The first electrode is connected through a coaxial cable to a power supply unit. The width W of each of the first and second electrodes is smaller than or equal to a quarter of the length L thereof, and the thickness T of the dielectric substrate is larger than or equal to the above width W. Advantageously, the second electrode is set so as to be longer than the first electrode, and both end portions of the second electrode are bent and arranged on both end surfaces of the dielectric substrate.

8 Claims, 34 Drawing Sheets

U.S. PATENT DOCUMENTS

| | | | |
|---|---|---|---|
| 6,476,769 | B1 | 11/2002 | Lehtola |
| 2003/0058175 | A1 | 3/2003 | Akiyama et al. |

FOREIGN PATENT DOCUMENTS

| | | | |
|---|---|---|---|
| EP | 0 450 881 | A2 | 10/1991 |
| EP | 0 521 384 | | 1/1993 |
| EP | 1 148 581 | A1 | 10/2001 |
| EP | 1 296 410 | | 3/2003 |
| JP | 2-172307 | A | 7/1990 |
| JP | 2-256305 | A | 10/1990 |
| JP | 4-354401 | | 12/1992 |
| JP | 5-50818 | | 7/1993 |
| JP | 5-211406 | | 8/1993 |
| JP | 8-18328 | | 1/1996 |
| JP | 8-18329 | | 1/1996 |
| JP | 9-51224 | A | 2/1997 |
| JP | 9-64636 | A | 3/1997 |
| JP | 9-93028 | | 4/1997 |
| JP | 9-167214 | | 6/1997 |
| JP | 11-195922 | | 7/1999 |
| JP | 2951707 | | 7/1999 |
| JP | 3092629 | B2 | 9/2000 |
| JP | 2001-111336 | | 4/2001 |
| JP | 2001-326528 | A | 11/2001 |
| JP | 2002-305409 | | 10/2002 |
| JP | 2002-374122 | | 12/2002 |
| JP | 2003-60431 | A | 2/2003 |
| JP | 2003-124730 | | 4/2003 |
| JP | 2003-273640 | A | 9/2003 |
| JP | 2003-338783 | | 11/2003 |
| JP | 2004-242168 | | 8/2004 |
| JP | 2006-245751 | | 9/2006 |

OTHER PUBLICATIONS

International Search Report issued Nov. 6, 2007 with English language translation.

Written Opinion with English language translation.

This is supplemental to the Information Disclosure Statement filed May 5, 2009 with the application. Minor typographical errors have been corrected, such as the filing date and the publication date of EP 0521 384. All prior art documents have previously been submitted and are therefore not enclosed.

Official Communication issued in corresponding European Patent Application No. 07792880.2, mailed on Sep. 27, 2011.

* cited by examiner

FIG. 6
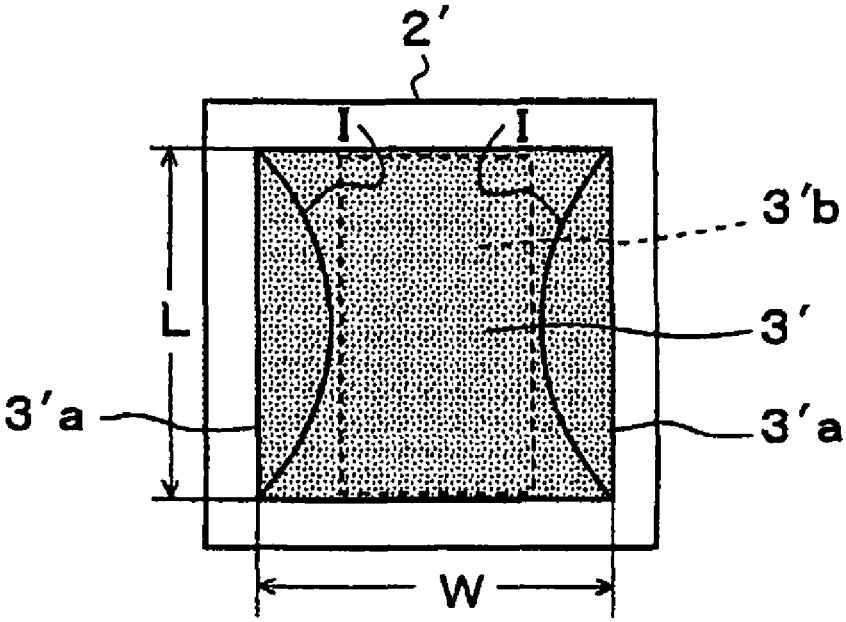
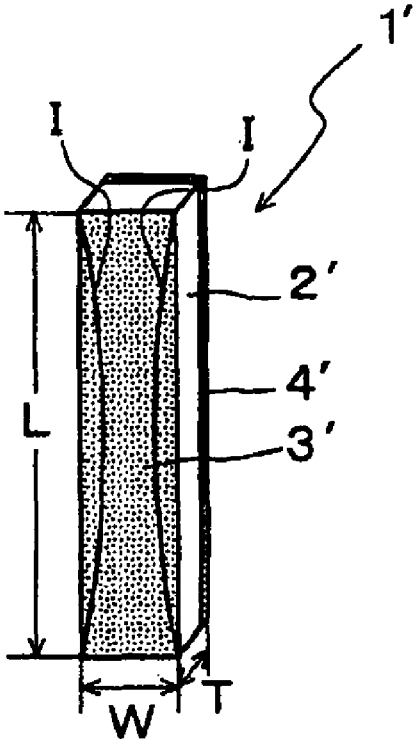
FIG. 7(a)
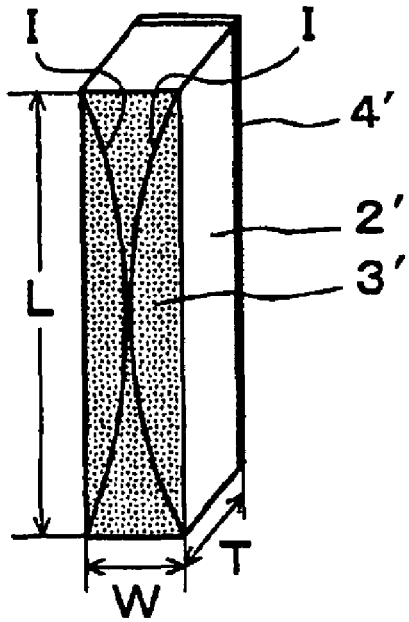
FIG. 7(b)

PATCH ANTENNA DEVICE AND ANTENNA DEVICE

CROSS-REFERENCE TO RELATED APPLICATIONS

This is a continuation under 35 U.S.C. §111(a) of PCT/JP2007/066291 filed Aug. 22, 2007, and claims priority of JP2006-300591 filed Nov. 6, 2006, JP2006-300592 filed Nov. 6, 2006, JP2006-300593 filed Nov. 6, 2006, JP2007-025436 filed Feb. 5, 2007, and JP2007-029228 filed Feb. 8, 2007, all incorporated by reference.

BACKGROUND

1. Technical Field

The invention relates to a patch antenna device and antenna device that may be used in a handy terminal for reading a UHF RFID, or the like.

2. Background Art

A patch antenna device includes a ground electrode made of a conductor, a dielectric substrate mounted on the ground electrode, and a conductive radiation electrode formed on the dielectric substrate. The patch antenna device thus configured patch antenna device not only may be reduced in thickness and is able to achieve high gain but also is compatible with an unbalanced circuit, such as a coaxial line or a microstrip line and, therefore, has many advantages, for example, in that it is possible to easily achieve matching with these circuits. For the above reason, the patch antenna device is widely used in an RFID handy terminal and other types of transceiver (for example, see Patent Document 1).

In addition, as a type of antenna device, an array antenna device has been suggested, in which a plurality of patch antenna devices are used as patch antenna elements (for example, see Patent Document 2). The above array antenna device generally has a planar structure. That is, a multiple number of radiation electrodes are arranged on a wide front surface of one dielectric substrate in a planar manner, a coaxial cable is connected from the rear surface side of the dielectric substrate to each radiation electrode, and then an RF signal from a power supply unit is supplied through the coaxial cable to each radiation electrode. Alternatively, a strip line is provided on the rear surface, or the like, of the dielectric substrate, and then an RF signal from the power supply unit is electromagnetically coupled through the strip line to each radiation electrode. Thus, radio waves from the radiation electrodes are radiated in a front (forward) direction perpendicular to the front surface of the dielectric substrate.

Patent Document 1: Japanese Unexamined Patent Application Publication No. 2006-245751

Patent Document 2: Japanese Unexamined Patent Application Publication No. 2001-111336

SUMMARY

However, the above described existing patch antenna devices have the following problems. When the patch antenna device is miniaturized, the relative dielectric constant of the dielectric substrate is increased. However, when the relative dielectric constant of the dielectric substrate is increased, the size of the antenna electrode is reduced and the size of the ground electrode is also reduced, radiation toward the ground-side rear surface increases and, as a result, the forward radiant gain reduced. That is, when the patch antenna device is miniaturized, an F/B ratio (Front-to-Back ratio) deteriorates and, therefore, there occurs the inconvenience that the gain in the forward direction abruptly decreases. Thus, in order to obtain a desired gain or F/B ratio in the patch antenna device that uses a substrate having a high dielectric constant, the size of the ground needs to be about half the wavelength or above. Hence, it has been difficult to miniaturize the patch antenna device. As described above, in the patch antenna device based on the existing patch antenna, it is difficult to obtain both an increase in gain and/or F/B ratio and miniaturization of the device at the same time.

In addition, in the existing patch array antenna device, because a planar structure is employed in which a multiple number of radiation electrodes are arranged on a wide front surface of one dielectric substrate, a large mounting area is required inside a small electronic apparatus. Thus, a small antenna mounting area does not allow the above arrangement. In contrast, it is conceivable that the number of antenna elements is reduced for miniaturization; however, when the number of antenna elements is reduced, it is difficult to obtain a desired gain.

The embodiments disclosed herein are contemplated to solve the above problems, so that a patch antenna device and antenna device may be miniaturized while ensuring a sufficient gain in a front direction and so that the directivity is easily changeable.

To solve the above problem, a patch antenna device is disclosed. The patch antenna device includes: a dielectric substrate which has a front surface and a rear surface facing each other and whose cross section taken perpendicularly to the front surface and the rear surface has substantially a rectangular shape; a first electrode formed on the front surface of the dielectric substrate for being connected to an RF power supply unit; and a second electrode formed on the rear surface of the dielectric substrate, wherein the width of the first electrode is smaller than or equal to a quarter of the length of the first electrode, said length defining an excitation direction, and the width of the second electrode is smaller than or equal to a quarter of the length of the second electrode, said length again being oriented in the excitation direction, and wherein the width of each of the front surface and rear surface of the dielectric substrate is equal to the width of each of the first and second electrodes, and the thickness of the dielectric substrate is larger than or equal to the width of the first and second electrodes.

According to the above configuration, when an RF electric signal is supplied from the power supply unit to the first electrode, an electromagnetic wave having a predetermined frequency is radiated from the first electrode. At this time, the width of each of the first electrode and the second electrode is smaller than or equal to a quarter of the length thereof, and also, the width of each of the front surface and rear surface of the dielectric substrate is equal to the width of each of the first and second electrodes. Thus, miniaturization of the entire patch antenna device is achieved; but there is still a possibility that the gain of the patch antenna device may decrease. But, in the patch antenna device, because the thickness of the dielectric substrate is larger than or equal to the width of the first and second electrodes, a decrease in gain is suppressed and, therefore, a sufficient gain may be ensured.

The patch antenna device may advantageously be configured so that the length of at least one of the first and second electrodes is longer than the length of the corresponding front surface or rear surface of the dielectric substrate, and both end portions of the at least one of the first and second electrodes in the longitudinal direction are bent and arranged on both end surfaces of the dielectric substrate.

The patch antenna device may advantageously be configured so that the length of the second electrode is longer than the length of the first electrode.

An antenna device according to another embodiment includes a pair of patch antenna elements, each of which is formed so that electrodes are provided respectively on at least two substantially parallel facing faces of a dielectric substrate, wherein the pair of patch antenna elements are arranged parallel to each other at a predetermined interval so that the electrode of one of the patch antenna elements faces the electrode of the other one of the patch antenna elements, and wherein one of the patch antenna elements is to be supplied with RF power to serve as a feeding element, and the other one of the patch antenna elements is to serve as a parasitic element. According to the above configuration, when one of the patch antenna elements, which is a feeding element, is supplied with the electric power, an electromagnetic wave having a predetermined frequency is radiated from the patch antenna element. Then, the radiated electromagnetic wave is electromagnetically coupled with the other one of the patch antenna elements, and the other one of the patch antenna elements resonates at the predetermined frequency. At this time, by appropriately setting the reactance of the other one of the patch antenna elements and/or the interval between the pair of patch antenna elements, it is possible to make an electromagnetic wave, radiated from the other one of the patch antenna elements, interfere with an electromagnetic wave that travels from the one of the patch antenna elements to the other one of the patch antenna elements. Specifically, by appropriately setting the reactance, the phase or amplitude of an electromagnetic wave radiated from the other one of the patch antenna elements is varied, and by setting the interval of the pair of patch antenna elements in association with the wavelength, it is possible to increase the gain of an electromagnetic wave radiated from the one of the patch antenna elements in the front direction, and, in addition, it is possible to increase an F/B ratio by attenuating an electromagnetic wave present in the rear direction.

In this antenna device, the patch antenna device described above is advantageously used as the patch antenna element.

In the antenna device, the patch antenna element, which serves as the parasitic element, may advantageously be arranged at a position opposite to a radiation direction of the patch antenna element, which serves as the feeding element.

In the antenna device, a reactance circuit is advantageously connected to the patch antenna element, which serves as the parasitic element, and is terminated. According to the above configuration, by varying the reactance of the reactance circuit connected to the patch antenna element, which is the parasitic element, it is possible to increase the reactance of the parasitic element side without increasing the size of the patch antenna element itself.

In the antenna device, the interval of the pair of patch antenna elements may advantageously be set within the range of 0.12 times to 0.30 times a free space wavelength at a working frequency. According to the above configuration, it is possible to obtain an optimal gain and an optimal F/B ratio.

According to a further embodiment, an antenna device includes a sub-array unit that employs the pair of patch antenna elements as described above, wherein a plurality of the sub-array units are arranged in a line at a predetermined interval so that the feeding element of the subsequent sub-array unit is located behind the parasitic element of the preceding sub-array unit, wherein the one of the patch antenna elements serves as a first patch antenna element and the other one of the patch antenna elements serves as a second patch antenna element, and one of the electrodes in each patch antenna element serves as a first electrode and the other one of the electrodes serves as a second electrode, and wherein the plurality of sub-array units are arranged in a line at the predetermined interval so that the second electrode of the second patch antenna element of the preceding sub-array unit faces the first electrode of the first patch antenna element of the subsequent sub-array unit. According to the above configuration, because the first patch antenna element, which is the feeding element placed on a front side, and the second patch antenna element, which is the parasitic element placed on a rear side, are alternately arranged at predetermined intervals, the first and second patch antenna elements are arranged in a line in the radiation direction of a radio wave. Thus, unlike the existing array patch antenna device in which a plurality of radiation electrodes are arranged on the surface of the dielectric substrate in a planar manner, the antenna device has a small area in the planar direction, and it is easy to mount the antenna device onto a device having a narrow antenna mounting area. In addition, in each sub-array unit, when the first patch antenna element is supplied with RF electric power, a radio wave having a predetermined frequency is radiated frontward and rearward from the first patch antenna element. Then, the radio wave radiated rearward is electromagnetically coupled with the second patch antenna element, and the second patch antenna element resonates at the predetermined frequency. At this time, by appropriately setting the reactance of the first and second patch antenna elements and/or the interval between these elements, the radio wave radiated rearward is attenuated, and only the gain of the radio wave radiated frontward may be increased. According to the above setting, each sub-array unit is able to radiate a high-gain radio wave frontward. In this antenna device, the plurality of sub-array units are arranged in a line at the predetermined interval so that the second electrode of the second patch antenna element of the preceding sub-array unit faces the first electrode of the first patch antenna element of the subsequent sub-array unit. Thus, by appropriately setting the interval between the adjacent sub-array units, it is possible to increase the gain of a radio wave radiated from the antenna device by superimposing the radio waves radiated frontward from the respective sub-array units. That is, the gain of a radio wave from the antenna device may be increased in association with the number of sub-array units.

In the antenna device, the predetermined interval between the preceding sub-array unit and the subsequent sub-array unit may advantageously be set to substantially half a free space wavelength at a working frequency, and a phase difference of about 180° provided between an RF signal power supplied to the first patch antenna element of the subsequent sub-array unit and the RF signal supplied to the first patch antenna element of the preceding sub-array unit. According to the above configuration, a radio wave radiated from the preceding sub-array unit coincides with a radio wave radiated from the subsequent sub-array unit, and it is possible to reliably increase the gain of a radio wave radiated from the antenna device.

In the antenna device, a reactance circuit may advantageously be connected to the second patch antenna element of each sub-array unit. According to the above configuration, by varying the reactance of the reactance circuit connected to the second patch antenna element, it is possible to increase the reactance of the second patch antenna element without increasing the size of the second patch antenna element itself.

In a further embodiment of an antenna device, the antenna device may include a pair of patch antenna elements, each of which is formed so that electrodes are provided respectively on at least two substantially parallel facing faces of a dielectric substrate, wherein the pair of patch antenna elements are arranged parallel to each other at a predetermined interval so that the electrode of one of the patch antenna elements faces the electrode of the other one of the patch antenna elements, and wherein the pair of patch antenna elements are to be supplied with RF electric power to serve as feeding elements. According to the above configuration, when the pair of patch antenna elements, which are the feeding elements, are supplied with an electric power, an electromagnetic wave having a predetermined frequency is radiated from two electrodes of each of the patch antenna elements. At this time, by appropriately setting the phase and/or amplitude of an electromagnetic wave from the other one of the patch antenna elements, it is possible to make the electromagnetic wave, radiated from the other one of the patch antenna elements, interfere with an electromagnetic wave that travels from the one of the patch antenna elements toward the other one of the patch antenna elements. That is, by appropriately setting the phase and/or amplitude of an electromagnetic wave radiated from the other one of the patch antenna elements, it is possible to increase the gain of the electromagnetic wave radiated from the one of the patch antenna elements in the front direction, and it is possible to increase the F/B ratio by attenuating an electromagnetic wave present in the rear direction.

In this antenna device any one of the patch antenna devices described above may be used as the patch antenna element.

The antenna device may advantageously be configured so that a phase difference between a signal supplied to the one of the patch antenna elements and a signal supplied to the other one of the patch antenna elements ranges from 60 degrees to 120 degrees.

The antenna device may advantageously be configured so that the amplitude of a radio wave radiated from the one of the patch antenna elements is higher by a value ranging from 2 dB to 6 dB than the amplitude of a radio wave radiated from the other one of the patch antenna elements.

In yet another embodiment of an antenna device, the antenna device may include a plurality of patch antenna elements arranged in a line at a predetermined interval so that the subsequent patch antenna element is located behind the preceding patch antenna element, wherein each patch antenna element is to be supplied with an RF signal, wherein each patch antenna element is formed so that first and second electrodes are respectively provided on a front face and rear face of a dielectric substrate, and wherein the plurality of patch antenna elements are arranged in a line at the predetermined interval so that the second electrode of the preceding patch antenna element faces the first electrode of the subsequent patch antenna element. According to the above configuration, because the plurality of patch antenna elements are arranged so that the second electrode of the preceding patch antenna element faces the first electrode of the subsequent patch antenna element, the plurality of patch antenna elements are arranged in a line in the radiation direction of a radio wave. Thus, unlike the existing antenna device in which a plurality of radiation electrodes are arranged on the surface of the dielectric substrate in a planar manner, the antenna device of the invention has a small area in the planar direction, and it is easy to mount the antenna device onto a device having a narrow antenna mounting area. In addition, when each patch antenna element is supplied with an RF signal, a radio wave having a predetermined frequency is radiated from each patch antenna element. In the antenna device, the plurality of patch antenna elements are arranged in a line at the predetermined interval so that the second electrode of the preceding patch antenna element faces the first electrode of the subsequent patch antenna element. Thus, by appropriately setting the interval between the adjacent patch antenna elements and the phase of each patch antenna element, it is possible to increase the gain of a radio wave radiated from the antenna device by superimposing radio waves radiated from the respective patch antenna elements. That is, the gain of a radio wave from the antenna device may be increased in association with the number of patch antenna elements.

The antenna device may advantageously be configured so that the predetermined interval between the preceding patch antenna element and the subsequent patch antenna element is set to substantially a quarter of a free space wavelength at a working frequency, and a phase difference of about 90° is provided between an electric power supplied to the subsequent patch antenna element and an electric signal is to be supplied to the preceding patch antenna element. According to the above configuration, a radio wave radiated from the preceding patch antenna element coincides with a radio wave radiated from the subsequent patch antenna element, and it is possible to reliably increase the gain of a radio wave radiated from the antenna device.

In the antenna device, the patch antenna device according to any one of is the previous embodiments may advantageously be used as the patch antenna element.

Still another embodiment of an antenna device includes a pair of patch antenna elements, each of which is formed so that electrodes are provided respectively on at least two substantially parallel facing faces of a dielectric substrate, wherein the pair of patch antenna elements are arranged parallel to each other at a predetermined interval so that the electrode of one of the patch antenna elements faces the electrode of the other one of the patch antenna elements, and wherein a pair of power supply lines extended respectively from the pair of patch antenna elements can be connected through a change-over switch to an RF power supply unit. According to the above configuration, when the one of the patch antenna elements is connected to the power supply unit by switching the change-over switch, the one of the patch antenna elements serves as a feeding element, and the other one of the patch antenna elements serves as a parasitic element. As a result, an electromagnetic wave having a predetermined frequency is radiated from the one of the patch antenna elements. Then, the radiated electromagnetic wave is electromagnetically coupled with the other one of the patch antenna elements, and the other one of the patch antenna elements resonates at the predetermined frequency. At this time, by appropriately setting the reactance of the power supply line of the other one of the patch antenna elements and/or the interval between the pair of patch antenna elements, it is possible to make an electromagnetic wave, radiated from the other one of the patch antenna elements, interfere with an electromagnetic wave that travels from the one of the patch antenna elements toward the other one of the patch antenna elements. Specifically, by appropriately setting the length of the power supply line, the phase and/or amplitude of an electromagnetic wave radiated from the other one of the patch antenna elements is varied, and by setting the interval of the pair of patch antenna elements in association with the wavelength, it is possible to increase the gain of an electromagnetic wave radiated from the one of the patch antenna elements in the front direction, and, in addition, it is possible to increase the F/B ratio by attenuating an electromagnetic wave present in the rear direction. That is, in the above state, a high-gain electromagnetic wave is radiated in the front direction of the one of the patch antenna elements. Here, when the other one of the patch antenna elements is connected to the power supply unit by switching the change-over switch again, the other one of the patch antenna elements serves as a feeding element, and the one of the patch antenna elements serves as a parasitic element. As a result, a high-gain electromagnetic wave is radiated from the rear side of the other one of the patch antenna elements. That is, the electromagnetic wave that has been radiated from the front side of the antenna device is changed so as to be radiated from the rear side by switching the change-over switch.

An antenna device according to a further embodiment includes three patch antenna elements, each of which is formed so that electrodes are provided respectively on at least two substantially parallel facing faces of a dielectric substrate, wherein the three patch antenna elements are arranged parallel to one another at predetermined intervals so that the electrodes of the adjacent patch antenna elements face each other, and wherein the middle patch antenna element can be supplied with RF electric power to serve as a feeding element, and variable reactance circuits are respectively connected to the other patch antenna elements. According to the above configuration, when the middle patch antenna element, which is the feeding element, is supplied with an electric power, an electromagnetic wave having a predetermined frequency is radiated from that patch antenna element. Then, electromagnetic waves radiated toward both sides from this patch antenna element are electromagnetically coupled with the patch antenna elements located on both sides, and the patch antenna elements located on both sides resonate at the predetermined frequency. At this time, by appropriately setting the interval between the patch antenna elements, and varying the reactance using the variable reactance circuits, one of the patch antenna elements, which serve as parasitic elements, located on both sides is made capacitive and the other one is made inductive. Thus, the inductive patch antenna element operates just like a reflector. By so doing, the electromagnetic wave radiated from the middle patch antenna element toward the inductive patch antenna element returns as if it was reflected by the inductive patch antenna element, and interferes with an electromagnetic wave radiated toward the capacitive patch antenna element and is amplified. As a result, an electromagnetic wave having a high gain and high F/B ratio is radiated from the middle patch antenna element toward the capacitive patch antenna element. In addition, when the capacitive and inductive patch antenna elements located on both sides are inverted by varying the reactance using the variable reactance circuits, the direction of an electromagnetic wave radiated from the middle patch antenna element is also inverted.

In this embodiment, any one of the patch antenna devices described above may be used as the patch antenna element.

Further, each variable reactance circuit may advantageously comprise a variable capacitance diode.

In addition, each variable reactance circuit may be advantageously configured to change a plurality of fixed reactance circuits having different reactances using a switch.

As described above in detail, according to a patch antenna device described above, because the width of each of the first and second electrodes is smaller than or equal to a quarter of the length, and the width of the dielectric substrate is equal to the width of each of the first and second electrodes, it is possible to miniaturize the patch antenna device as a whole. In addition, the thickness of the dielectric substrate is larger than or equal to the width of the first and second electrodes and, therefore, a decrease in gain of an electromagnetic wave is suppressed. Thus, it is possible to ensure a sufficient gain. That is, it is advantageous in that miniaturization of the device may be achieved while a desired gain is ensured. Thus, even when the size of the volume is reduced to about half the size of the existing patch antenna device, it is possible to obtain the equivalent gain. Specifically, when both end portions of any one of the first and second electrodes are bent and arranged on the corresponding end surfaces of the dielectric substrate, it is possible to further miniaturize the patch antenna device. In addition, if the length of the second electrode is longer than the length of the first electrode, it is possible to effectively increase the gain in the front direction while ensuring the miniaturized patch antenna device.

According to another antenna device described above, the antenna device includes a pair of patch antenna elements, each of which is formed so that electrodes are provided on a dielectric substrate, and with this configuration, it is possible to increase the gain and/or F/B ratio of an electromagnetic wave radiated in the front direction. Thus, it is advantageous in that it is possible to provide an antenna device that can achieve miniaturization while ensuring a sufficient gain in the front direction and an F/B ratio. In addition, it is possible to provide an antenna device that further achieves miniaturization, a high gain, and a high F/B ratio. Specifically, because a parasitic element-side reactance may be increased without increasing the size of the patch antenna element, it is possible to further miniaturize the antenna device. Furthermore, it is possible to obtain the antenna device that ensures an optimal gain and F/B ratio.

According to yet another antenna device it is possible to achieve miniaturization by suppressing an area in the planar direction. As a result, it is possible to easily mount the antenna device on an electronic device having a narrow antenna mounting area as well. In addition, the gain of a radio wave from the antenna device may be increased in association with the number of patch antenna elements. That is, according to the antenna device, it is advantageous in that it is possible to obtain a high gain and it is possible to achieve miniaturization. In addition, because the patch antenna element is used as a component, it is advantageous in that it is easy to achieve matching with an unbalanced circuit, such as a coaxial line, and it is possible to efficiently supply RF electric power from the power supply unit to the antenna device. Specifically, it is advantageous in that it is possible to reliably increase the gain of a radio wave from the antenna device. In addition, because it is possible to increase the reactance of the second patch antenna element without increasing the size of the second patch antenna element of each sub-array unit, it is possible to further miniaturize the antenna device.

According to a further antenna device described above, the antenna device includes a pair of patch antenna elements, each of which is formed so that electrodes are provided on a dielectric substrate, and both the patch antenna elements serve as feeding elements. Thus, it is possible to increase the gain and/or F/B ratio of an electromagnetic wave radiated in the front direction. Hence, it is advantageous in that it is possible to provide an antenna device that achieves miniaturization while ensuring a sufficient gain and F/B ratio in the front direction. In addition, it is possible to obtain an antenna device that ensures an optimal gain and F/B ratio.

According to yet another antenna device, it is advantageous in that it is possible to provide a miniaturized antenna device that is able to easily change the directivity of an electromagnetic wave having a high gain and high F/B ratio using a change-over switch. In addition, it is advantageous in that it is possible to provide a miniaturized antenna device that is able to easily change the directivity of an electromagnetic wave having a high gain and high F/B ratio by varying the reactance of the variable reactance circuit.

Other features and advantages will become apparent from the following description of embodiments, which refers to the accompanying drawings.

BRIEF DESCRIPTION OF DRAWINGS

FIG. 6 is a front view that schematically shows the existing patch antenna device and its current distribution.

FIGS. 7(*a*) and 7(*b*) are perspective views that illustrate the relationship between the width of an electrode and the thickness of a dielectric substrate.

DETAILED DESCRIPTION

Reference Numerals

Figure 1:
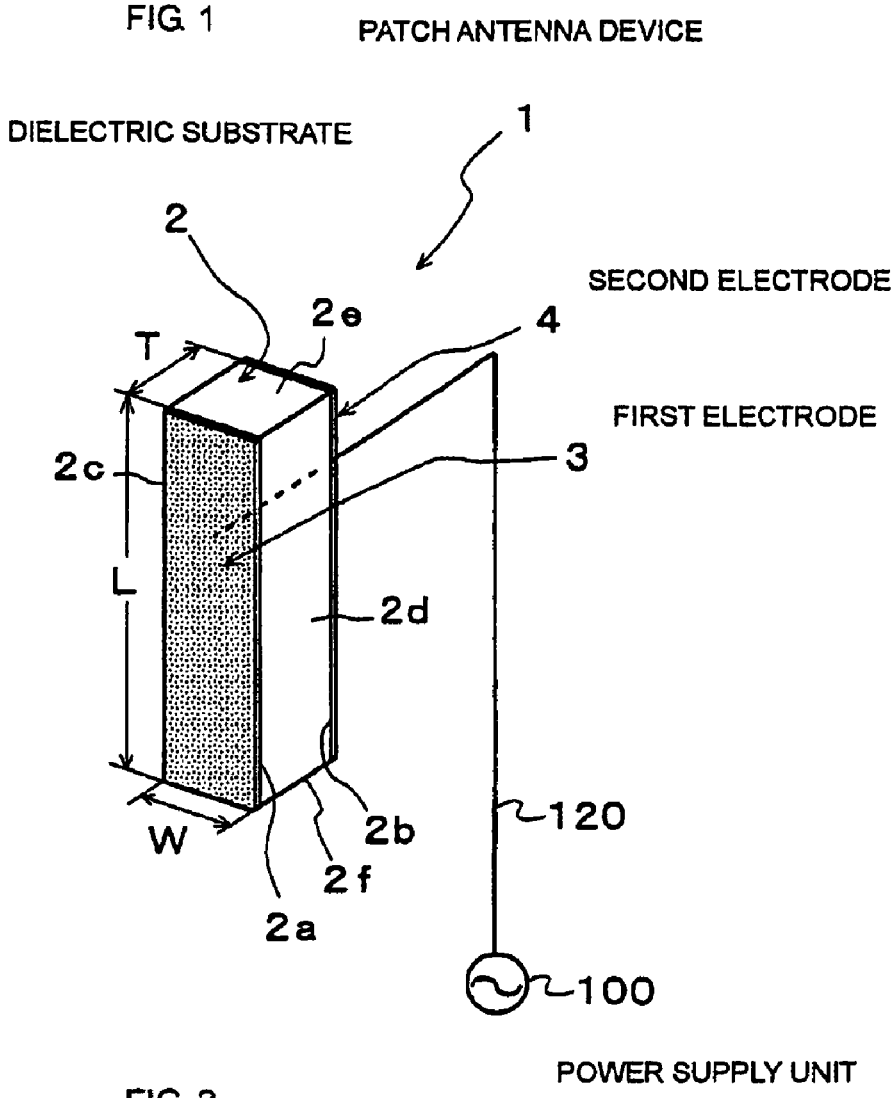
FIG. 1 is a perspective view that shows a patch antenna device according to a first embodiment.

1 patch antenna device
1A, 1B patch antenna element
2, 2A, 2B dielectric substrate
2*a*, 2Aa, 2Ba front surface
2*b*, 2Ab, 2Bb rear surface 2*c*, 2*d*, 2Ac, 2Ad, 2Bc, 2Bd side surface
2*e*, 2*f*, 2Ae, 2Af, 2Be, 2Bf end surface
2*g*, 4*a*, 2Ag, 4Aa, 2Bg, 4Ba hole
2*h* space
3, 4, 3A, 4A, 3B, 4B electrode
5 reactance circuit
6 distributor
31, 32 bent portion
33, 43, 51, 52 extended portion
41, 42 end portion
53 variable capacitance diode
54 inductor
55 change-over switch
56 to 59 fixed reactance circuit
61 movable contact
62, 63 fixed contact
100 power supply unit
110, 120 coaxial cable
111, 121 internal conductor
122 external conductor
130, 131, 140, 141 conductor wire
200 to 205 antenna device
210-1 to **210-*n*** sub-array unit
D, D1 interval
L length
T thickness
U1 to Un, V2, V3 radio wave
W width
W0, W1 to Wn electric power Hereinafter, embodiments will be described with reference to the accompanying drawings.

First Embodiment

Figure 2:
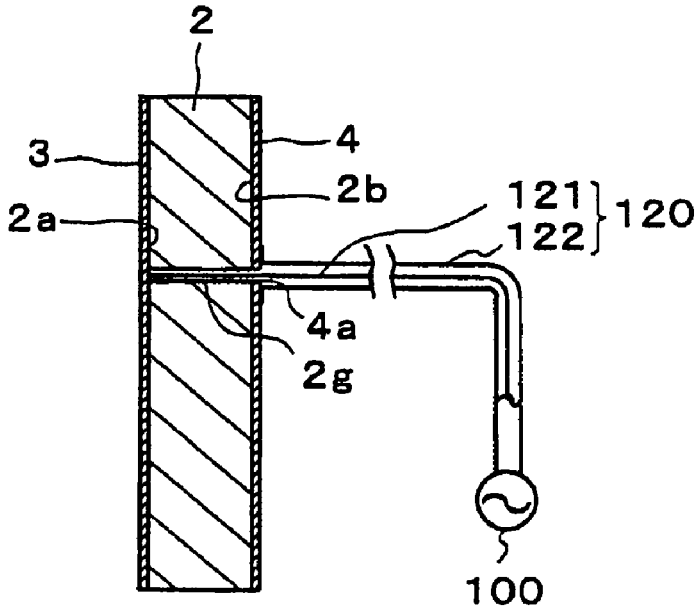
FIG. 2 is a longitudinal cross-sectional view of the patch antenna device shown in FIG. 1.
Figure 3:
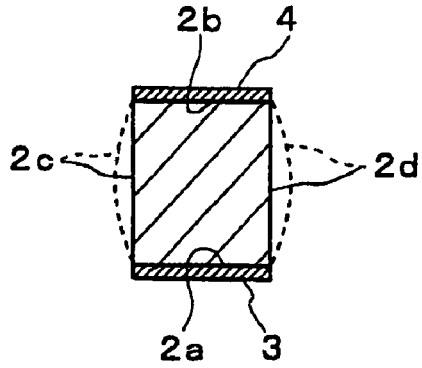
FIG. 3 is a transverse cross-sectional view of the patch antenna device shown in FIG. 1.
Figure 4:
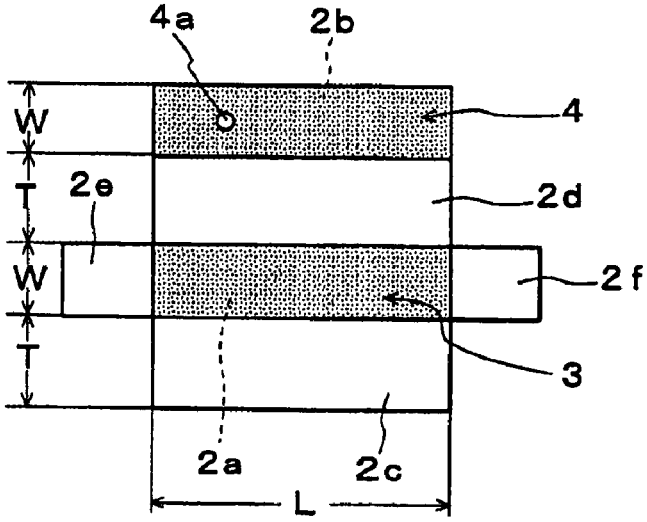
FIG. 4 is a development of the patch antenna device shown in FIG. 1.

FIG. 1 is a perspective view that shows a patch antenna device according to a first embodiment. FIG. 2 is a longitudinal cross-sectional view of the patch antenna device shown in FIG. 1. FIG. 3 is a transverse cross-sectional view of the patch antenna device shown in FIG. 1. FIG. 4 is a development of the patch antenna device shown in FIG. 1. As shown in FIG. 1, the patch antenna device 1 of this embodiment includes a dielectric substrate 2, a first electrode 3 and a second electrode 4.

The dielectric substrate 2 has a rectangular parallelepiped shape. Specifically, as shown in FIG. 2, a front surface 2*a* and rear surface 2*b* of the dielectric substrate 2 face each other. As shown in FIG. 3, a cross section taken perpendicularly to the front surface 2*a* and the rear surface 2*b* has a rectangular shape. That is, side surfaces 2*c* and 2*d* of the dielectric substrate 2 are not bulged at their centers as shown by the broken lines but are formed linearly as shown by the solid lines. As shown in FIG. 4, the first and second electrodes 3 and 4 are provided respectively on the entire front surface 2*a* and entire rear surface 2*b* of the dielectric substrate 2. That is, in this embodiment, the width of each of the front surface 2*a* and rear surface 2*b* of the dielectric substrate 2 is equal to the width W of each of the first and second electrodes 3 and 4. Furthermore, in this embodiment, the thickness T of the dielectric substrate 2 is larger than or equal to the width W of each of the first and second electrodes 3 and 4 to thereby provide an increased thickness for the dielectric substrate 2.

In FIG. 1, the first electrode 3 is a radiation electrode that is patterned on the front surface 2*a* of the dielectric substrate 2. The first electrode 3 is connected through a coaxial cable 120, which serves as an RF power supply line, to a power supply unit 100. The longitudinal direction (vertical direction in FIG. 1) of the first electrode is an excitation direction. Specifically, as shown in FIG. 2, holes 2*g* and 4*a* that reach the first electrode 3 are formed respectively in the dielectric substrate 2 and the second electrode 4, and an internal conductor 121 of the coaxial cable 120 is inserted into these holes 2*g* and 4*a* and connected to the first electrode 3. Thus, the first electrode 3 is electrically connected to the power supply unit 100. In addition, an external conductor 122 of the coaxial cable 120 is connected to the second electrode 4. The width W of the first electrode 3 is smaller than or equal to a quarter of the length L of the first electrode 3, which is oriented in the excitation direction.

In FIG. 1, the second electrode 4 is a parasitic electrode that is patterned on the rear surface 2*b* of the dielectric substrate 2. Similarly to the first electrode 3, the width W of the second electrode 4 is also smaller than or equal to a quarter of the length L of the second electrode 4. That is, the patch antenna device 1 of this embodiment is formed in a long slender rectangular parallelepiped shape, and is thereby formed smaller in size than the existing square patch antenna device.

Figure 5:
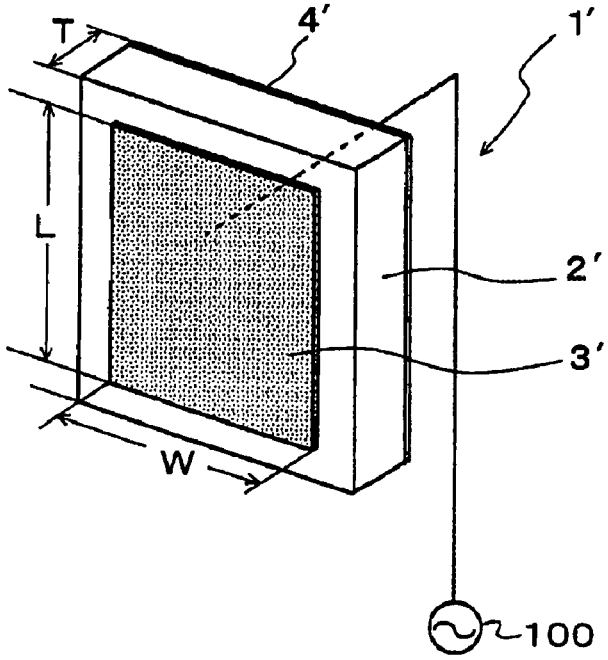
FIG. 5 is a perspective view that shows an existing patch antenna device.

Hereinafter, the manner of miniaturizing the patch antenna device 1 will be described. FIG. 5 is a perspective view that shows an existing patch antenna device. FIG. 6 is a front view that schematically shows the existing patch antenna device and its current distribution. As shown in FIG. 5, in the existing patch antenna device 1', a square first electrode 3' is arranged on the front surface of a dielectric substrate 2', whereas a second electrode 4' is arranged on the rear surface of the dielectric substrate 2'. Then, when an electric power having a predetermined frequency is supplied from the power supply unit 100 to the first electrode 3', an electromagnetic wave of a predetermined resonant frequency is radiated toward the front side. However, in the above patch antenna device 1', for example, the width W and length L of the first electrode 3' both are set to the same length and, therefore, the occupied area is large. Furthermore, as shown in FIG. 6, an electric current at the time of excitation of the first electrode 3' concentrates on a region indicated by I adjacent to each side 3'*a* of the first electrode 3'. That is, as indicated by the broken line, because an electric current does not flow much adjacent to the center portion 3'*b* of the first electrode 3', the center portion 3'*b* of the first electrode 3' does not contribute to excitation and is idle.

The inventor studied patch antenna devices in order to eliminate the above idle portion to miniaturize the patch antenna device. FIGS. 7(*a*) and 7(*b*) are perspective views that illustrate the relationship between the current, the width of an electrode and the thickness of a dielectric substrate. As shown in FIG. 7(*a*), the width W of each of the first electrode 3' and the second electrode 4' is reduced to remove the region 3'*b*, shown in FIG. 6, in which an electric current rarely flows, so it is possible to miniaturize the patch antenna device 1'. However, in the patch antenna device 1', because the width W of the second electrode 4' is also reduced, an electric current I distributed over the first electrode 3' is also reduced. Thus, a gain in the front direction decreases. Therefore, as shown in FIG. 7(*b*), the thickness T of the dielectric substrate 2' is increased in association with the width W of the first electrode 3', so that an electric current I distributed over the first electrode 3' may be increased. As a result, a gain in the front direction is increased. However, when the widths W of the electrodes 3' and 4' are excessively reduced for miniaturization, it is necessary to increase the thickness T of the dielectric substrate 2' for obtaining a gain. Thus, the patch antenna device 1' is enlarged in the thickness direction. On the other hand, when the thickness T of the dielectric substrate 2' is not increased much, it is necessary to increase the widths W of the electrodes 3' and 4'. Thus, the patch antenna device 1' is enlarged in the width direction.

Then, the inventor studied the following simulation, within which ranges are set for the width W of the first electrode 3' and/or the thickness T of the dielectric substrate 2', the volume of the patch antenna device is smaller than the existing patch antenna device and the gain is higher than or equal to the gain of the existing patch antenna device.

Figure 8:
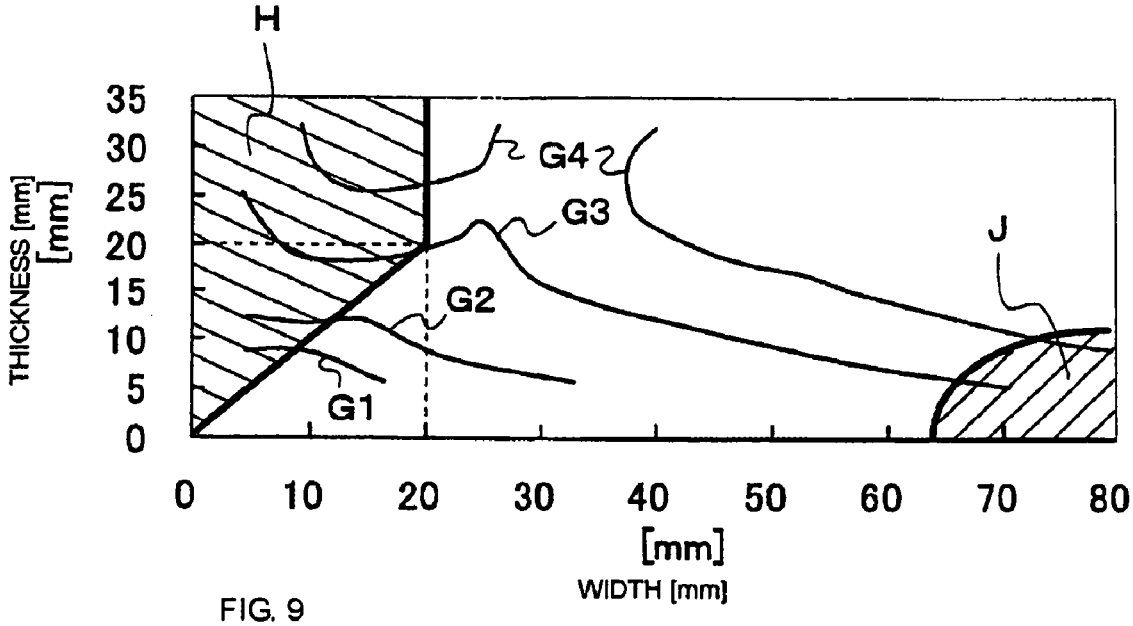
FIG. 8 is a graph that shows the relationship between the width and thickness of the patch antenna device and the gain.
Figure 9:
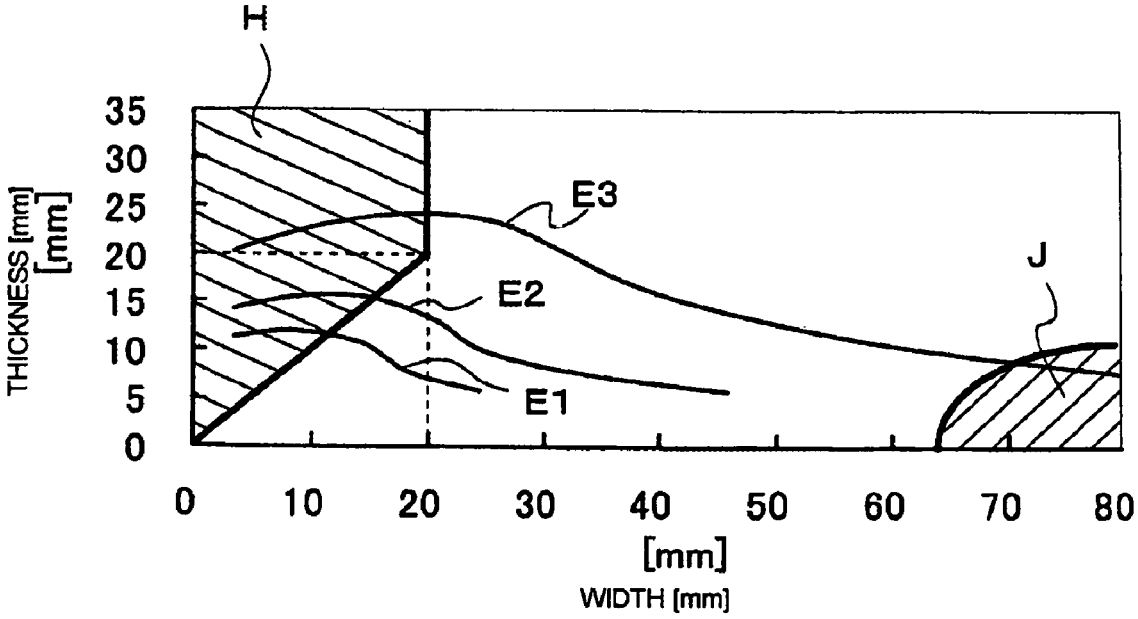
FIG. 9 is a graph that shows the relationship between the width and thickness of the patch antenna device and the efficiency.

FIG. 8 is a graph that shows the relationship between a width and thickness of the patch antenna device and a gain. FIG. 9 is a graph that shows the relationship between a width and thickness of the patch antenna device and an efficiency. The inventor used a dielectric substance having a relative dielectric constant of 6.4 and a dielectric loss (tan δ) of 0.002 as the dielectric substrate 2 of the patch antenna device 1, and set the length L of the dielectric substrate 2 to 80 mm. That is, the used patch antenna device 1 included the first and second electrodes 3 and 4 and the dielectric substrate 2, each having a length L of 80 mm, and then an RF signal having a frequency of 910 MHz was supplied thereto. Then, gains of the patch antenna device 1 were calculated through simulation while varying the width W (widths of the first and second electrodes 3 and 4 and width of the dielectric substrate 2) of the patch antenna device 1 and the thickness T (thickness of the dielectric substrate 2) of the patch antenna device 1. The results shown by the gain curves G1 to G4 in FIG. 8 were obtained. Here, the gain curves G1, G2, G3 and G4 respectively show the relationships between the widths W for gains 1 dBi, 2 dBi, 3 dBi, and 3.5 dBi and the thickness T. A region J indicates arrange of the width W and thickness T of the existing patch antenna device. A region H indicates a range of the width W and thickness T of the patch antenna device of this embodiment. As shown by the region J in FIG. 8, in the existing patch antenna device, when a gain of 3 dBi needs to be obtained, it is necessary to have a width W of about 65 mm or above and a thickness T of about 8 mm. Thus, the volume is at least about 41.6 cc. In contrast, as shown by the region H, in the patch antenna device 1 that is set to have a width W smaller than or equal to a quarter of the length 80 mm and a thickness T larger than or equal to the width W, when a gain of 3 dBi needs to be obtained, the width W just needs to be 20 mm, and the thickness T just needs to be about 20 mm. Thus, the volume just needs to be about 32 cc. That is, it has been confirmed that in the patch antenna device 1 having a length of 80 mm, when the width W is smaller than or equal to a quarter of the length and the thickness T is larger than or equal to the width W, it is possible to reduce the volume by about 25 percent or more against the volume of the existing patch antenna device while obtaining the same gain.

Next, the inventor used the patch antenna device 1 provided with the dielectric substrate 2 and the first and second electrodes 3 and 4 having the same relative dielectric constant, dielectric loss and length as described above, and then an electric power having a frequency of 910 MHz was supplied thereto. Then, efficiencies of the patch antenna device 1 were calculated through simulation while varying the width W and the thickness T. The results shown by efficiency curves E1 to E3 shown in FIG. 9 were obtained. Here, the efficiency curves E1, E2 and E3 respectively show the relationships between a width W and a thickness T in efficiencies 70%, 80% and 90%. As shown by the region J in FIG. 9, in the existing patch antenna device, when the efficiency 90% needs to be obtained, it is necessary to have a width W of about 70 mm or above and a thickness T of about 10 mm. Thus, the volume is at least about 56 cc. In contrast, as shown by the region H, in the patch antenna device 1 that is set to have a width W smaller than or equal to a quarter of the length 80 mm and a thickness T larger than or equal to the width W, when the efficiency 90% needs to be obtained, the width W just needs to be 20 mm, and the thickness T just needs to be about 25 mm. Thus, the volume just needs to be at most about 40 cc. That is, it has been confirmed that in the patch antenna device 1 having the length 80 mm, when the width W is smaller than or equal to a quarter of the length and the thickness T is larger than or equal to the width W, it is possible to reduce the volume by about 29 percent or above against the volume of the existing patch antenna device while obtaining the same efficiency.

The inventor considered the above results of simulations, and reached a conclusion that when the thickness T of the patch antenna device 1 is larger than or equal to the width W and the width W is smaller than or equal to a quarter of the length L, it is possible to reduce the size as compared with the existing patch antenna device with the same gain of 3 dBi and the same efficiency of 90% as those of the existing patch antenna device. Thus, in this embodiment, as described above, the thickness T of the dielectric substrate 2 of the patch antenna device 1 is larger than or equal to the width W of each of the first and second electrodes 3 and 4, and the width W of each of the first and second electrodes 3 and 4 is smaller than or equal to a quarter of the length L of each of the first and second electrodes 3 and 4.

Figure 10:
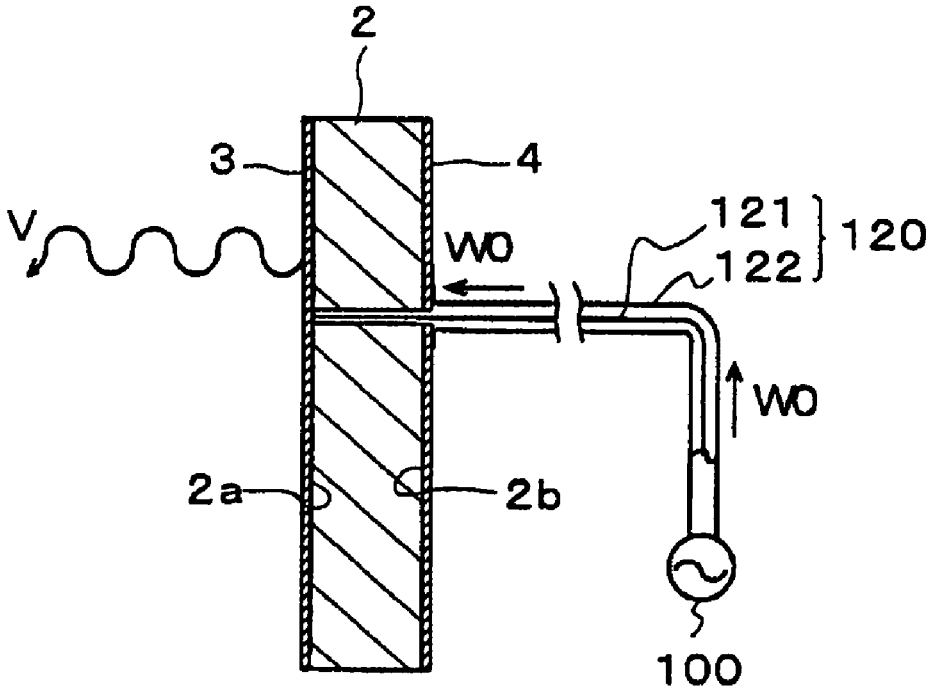
FIG. 10 is a cross-sectional view that illustrates the function and advantageous effects of the patch antenna device according to the embodiment.

Next, the function and advantageous effects of the patch antenna device 1 according to this embodiment will be described. FIG. 10 is a cross-sectional view that illustrates the function and advantageous effects of the patch antenna device 1 according to this embodiment. As shown in FIG. 10, when a signal W0 having a predetermined frequency is supplied from the power supply unit (RF source) 100 through the coaxial cable 120 to the first electrode 3, the first electrode 3 operates as a radiation electrode, and the second electrode 4 connected to a grounded external conductor 122 of the coaxial cable 120 operates as a ground electrode. As a result, an electromagnetic wave V having a predetermined frequency, excited in the first electrode 3, is radiated toward the front side (left-hand side in FIG. 10). At this time, the width W of each of the first and second electrodes 3 and 4 is smaller than or equal to a quarter of the length L thereof, and the width of each of the front surface 2*a* and rear surface 2*b* of the dielectric substrate 2 is also equal to the width W of each of the first and second electrodes 3 and 4. Thus, miniaturization of the entire patch antenna device 1 is achieved. Hence, even in an RFID handy terminal that packages electronic components in high density and that has a narrow antenna mounting region or in another transceiver as well, the patch antenna device 1 may be easily mounted. In addition, the thickness T of the dielectric substrate 2 is larger than or equal to the width W of each of the first and second electrodes 3 and 4, so that there is no decrease in gain of the electromagnetic wave V radiated from the first electrode 3. Thus, the electromagnetic wave V having a sufficient gain is radiated in the front direction of the patch antenna device 1. In this way, according to the patch antenna device 1 of this embodiment, it is possible to obtain a high gain in the front direction while the size is small.

Second Embodiment

Figure 11:
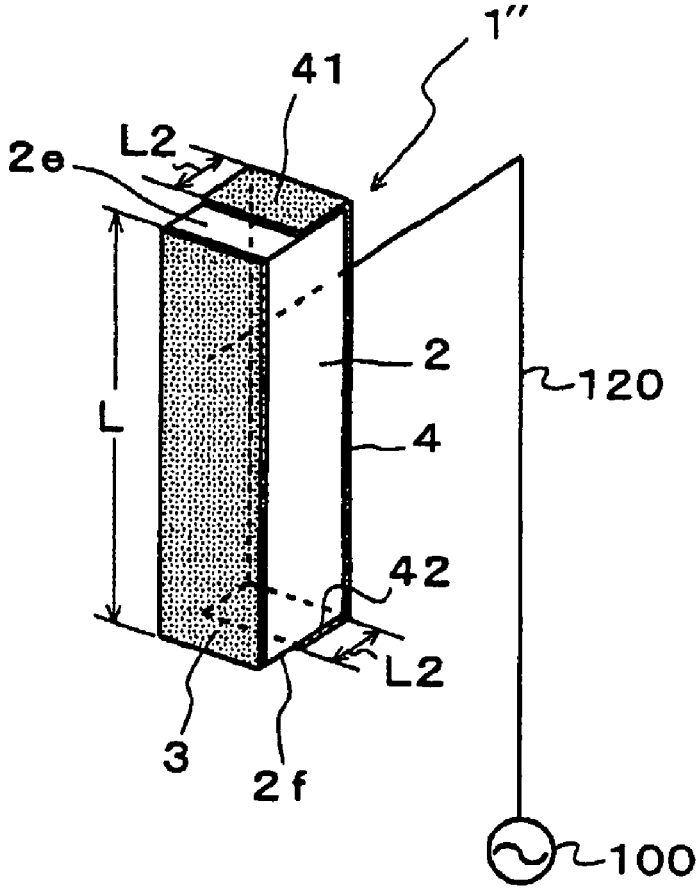
FIG. 11 is a perspective view that shows a patch antenna device according to a second embodiment.
Figure 12A:
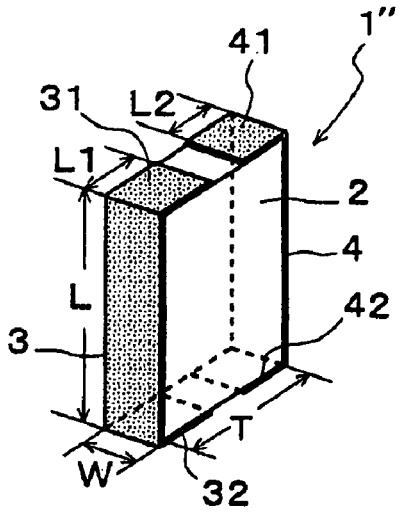
FIGS. 12(*a*)-12(*e*) are perspective views that show variations of the length of a second electrode.
Figure 12B:
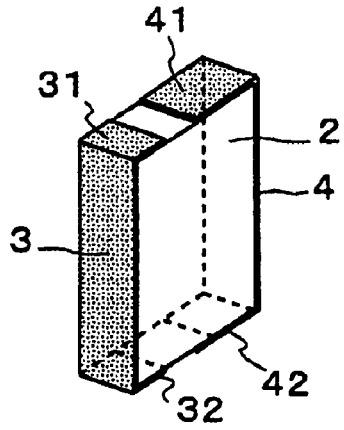
Figure 12C:
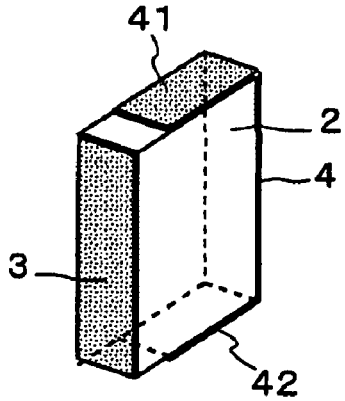
Figure 12D:
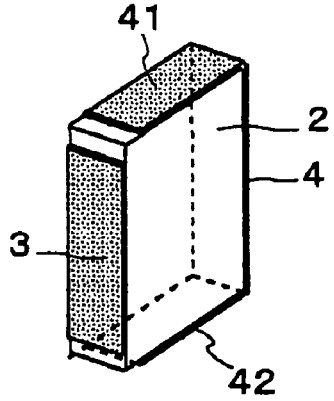
Figure 12E:
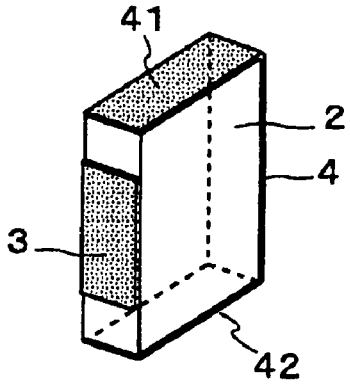

Next, a second embodiment of the invention will be described. FIG. 11 is a perspective view that shows a patch antenna device according to the second embodiment of the invention. This embodiment differs from the first embodiment in that the lengths of the first and second electrodes 3 and 4 are varied from each other. As shown in FIG. 11, in a patch antenna device 1" of this embodiment, the length of the second electrode 4 is longer than the length (L) of the first electrode 3. Specifically, the length L and width W of the first electrode 3 are the same as those of the first embodiment; however, the length of the second electrode 4 is longer than that of the first embodiment, and the length of the second electrode 4 is set to a length (L+L2×2) that is longer than the length L of the rear surface 2*b* of the dielectric substrate 2. Then, both end portions 41 and 42 of the second electrode 4 are bent and arranged on corresponding end surfaces 2*e* and 2*f* of the dielectric substrate 2.

The dielectric substrate does not need to have a length equal to the length of (L+L2×2) of the second electrode 4; with the above configuration, the dielectric substrate 2 just needs to have the length L as in the first embodiment. Thus, it is possible to miniaturize the patch antenna device by the amount of the lengths (L2×2) of the bent portions 41 and 42. In addition, by increasing the length of the second electrode 4 that operates as the ground electrode, it is possible to reduce an electromagnetic wave that travels from the first electrode 3 toward the rear surface side (second electrode 4 side). Thus, the F/B ratio is increased while maintaining the miniaturized patch antenna device. As a result, it is possible to increase the gain in the front direction (in the left-hand direction of the first electrode 3).

Incidentally, as in the case of this embodiment, when the patch antenna device 1" is designed to have the length of each of the first and second electrodes 3 and 4, it is necessary to achieve matching with a load (for example, 50Ω) at the side of the power supply unit 100. At a specific frequency, each of the first and second electrodes 3 and 4 has various lengths that can be matched with a load. When the length of the second electrode 4 matches with a load, the length of the first electrode 3 is also determined in association with the length of the second electrode 4. At a specific frequency, the length of the second electrode 4, which matches with a load, is not only the length of the rear surface 2*b* of the dielectric substrate 2, but includes the lengths of both the end surfaces 2*e* and 2*f* and the length of the front surface 2*a*. However, the radiation characteristic of the patch antenna device 1", such as gain, F/B ratio, and bandwidth, varies depending on the length of the second electrode 4. Thus, in consideration of gain, F/B ratio, bandwidth, and the like, it is necessary to appropriately design the patch antenna device 1".

Figure 13:
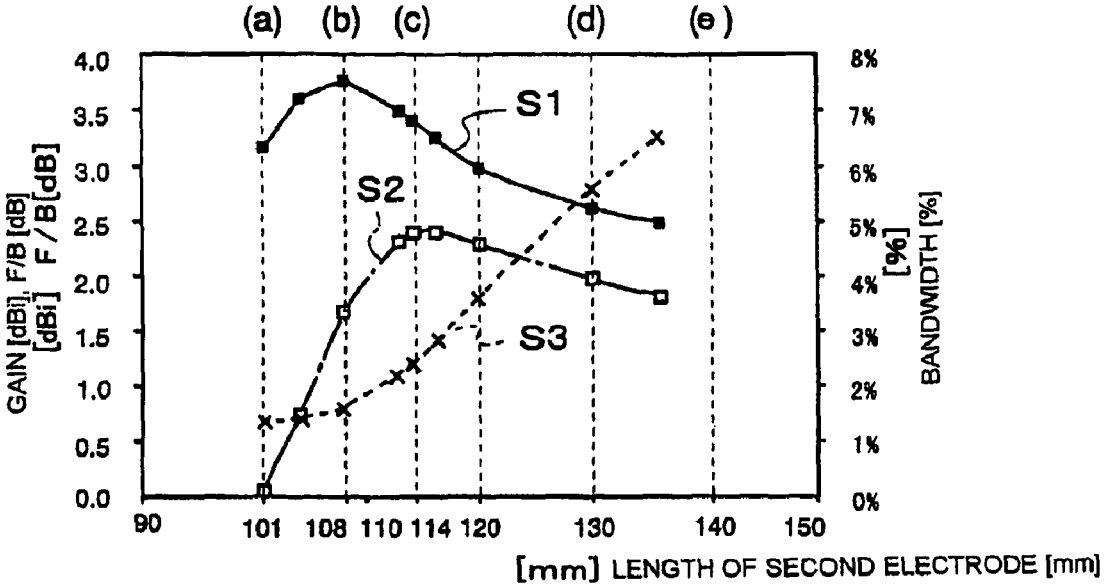
FIG. 13 is a graph that shows the correlation between a length of the second electrode, and a gain, an F/B ratio, or a band width.

The inventor formed the first and second electrodes 3 and 4 having different lengths on the dielectric substrate 2 having a relative dielectric constant of 6.4, a dielectric loss of 0.002, a length L of 80 mm, a width W of 10 mm, and a thickness T of 30 mm. Then, an electric power having a frequency of 910 MHz was supplied to the patch antenna device 1", and the gain, F/B ratio and band of the patch antenna device 1" were calculated through simulation while varying the length of the second electrode 4. FIGS. 12(*a*)-12(*e*) are perspective views that show variations of the length of the second electrode 4. FIG. 13 is a graph that shows the correlation between the length of the second electrode 4, and the gain (S1), F/B ratio (S2), and bandwidth (S3). FIG. 12(*a*), FIG. 12(*b*), FIG. 12(*c*), FIG. 12(*d*) and FIG. 12(*e*) respectively show the patch antenna device 1" when the overall length L+L2×2 of the second electrode 4 including the lengths of the bent portions 41 and 42 is set to 101 mm, 108 mm, 114 mm, 130 mm and 140 mm. In the above patch antenna device 1", in order to match with a load at a specific frequency, the overall length L+L1×2 of the first electrode 3 including the bent portions 31 and 32 is reduced as the length of the second electrode 4 is increased. Through simulations, for each of the patch antenna devices 1" of which the lengths of the second electrode 4 are shown in FIG. 12(*a*) to FIG. 12(*e*) and each of the patch antenna devices 1" of which the overall lengths of the second electrode 4 are 104 mm, 113 mm, 116 mm and 120 mm, an electric power having a frequency of 910 MHz was supplied, and the gain, F/B ratio and band in each length of the second electrode 4 were measured. Then, as shown by the gain curve S1 in FIG. 13, when the overall length of the second electrode 4 is around 108 mm, the gain is maximum. In addition, as shown by the F/B ratio curve S2, the F/B ratio is large when the overall length of the second electrode 4 is around 114 mm to 130 mm. Then, as shown by the bandwidth curve S3, the bandwidth widens as the overall length of the second electrode 4 increases. However, in regard to the bandwidth, it widens as the length of the second electrode 4 is increased; by contrast, the gain and the F/B ratio decrease and, in addition, it becomes difficult to match with a load of 50Ω. Thus, there is no advantage in setting the length of the second electrode 4 so as to be 140 mm or above. From the results of the above simulations, when the dielectric substrate 2 having a relative dielectric constant of 6.4, a dielectric loss of 0.002, a length L of 80 mm, a width W of 10 mm, and a thickness T of 30 mm is used, it is desirable in terms of gain, F/B ratio and band that the length of the second electrode 4 is set within the range of 108 mm to 130 mm (modes shown in FIG. 12(*b*) to FIG. 12(*d*)). The other configuration, function and advantageous effects are similar to those of the first embodiment, so the description thereof is omitted.

Third Embodiment

Figure 14:
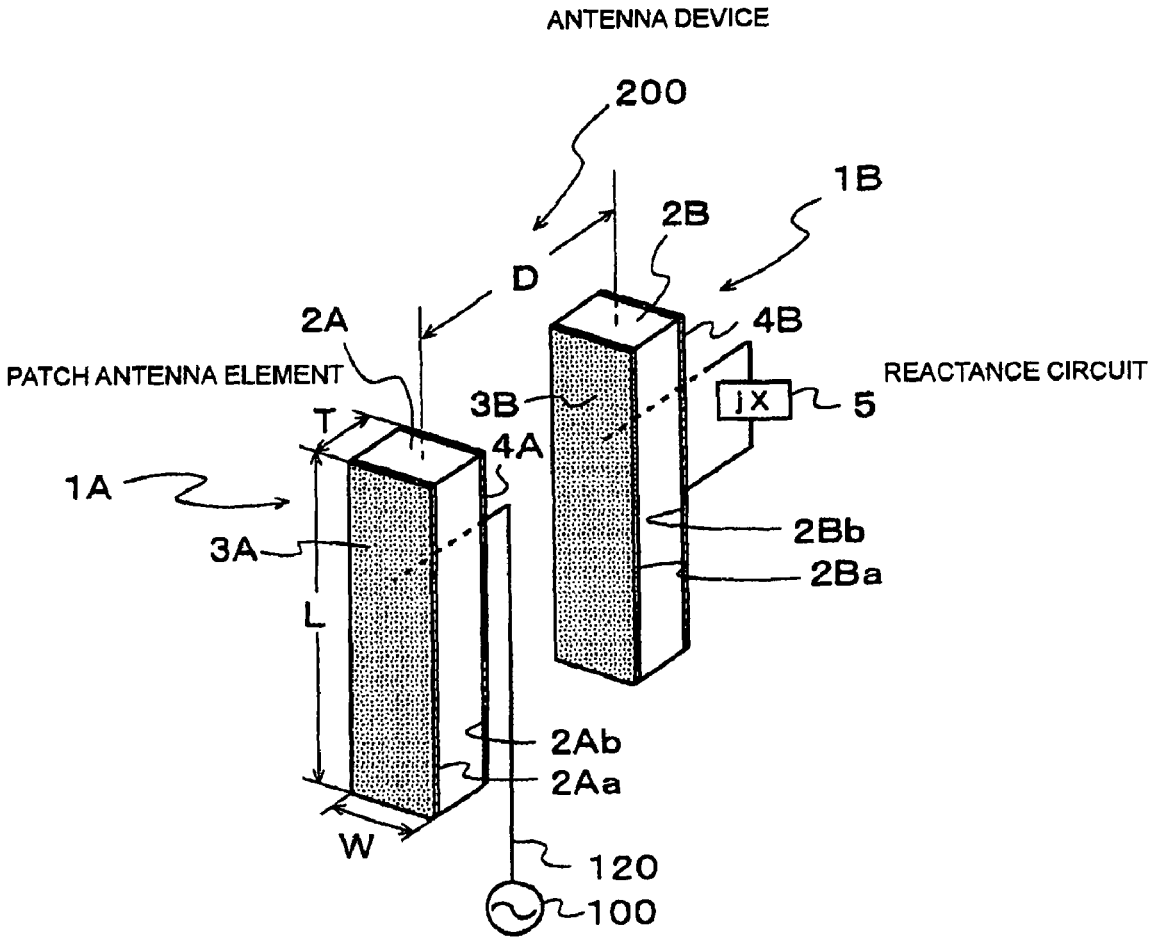
FIG. 14 is a schematic perspective view that shows an antenna device according to a third embodiment.
Figure 15:
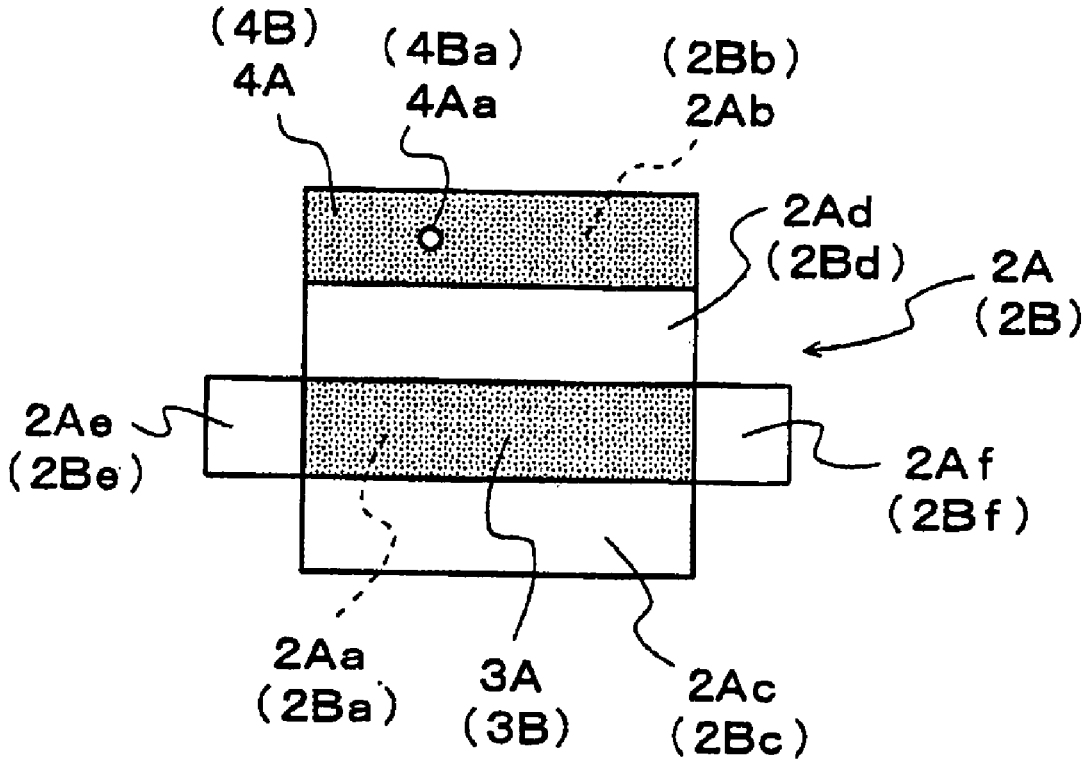
FIG. 15 is a development of a patch antenna element.
Figure 16:
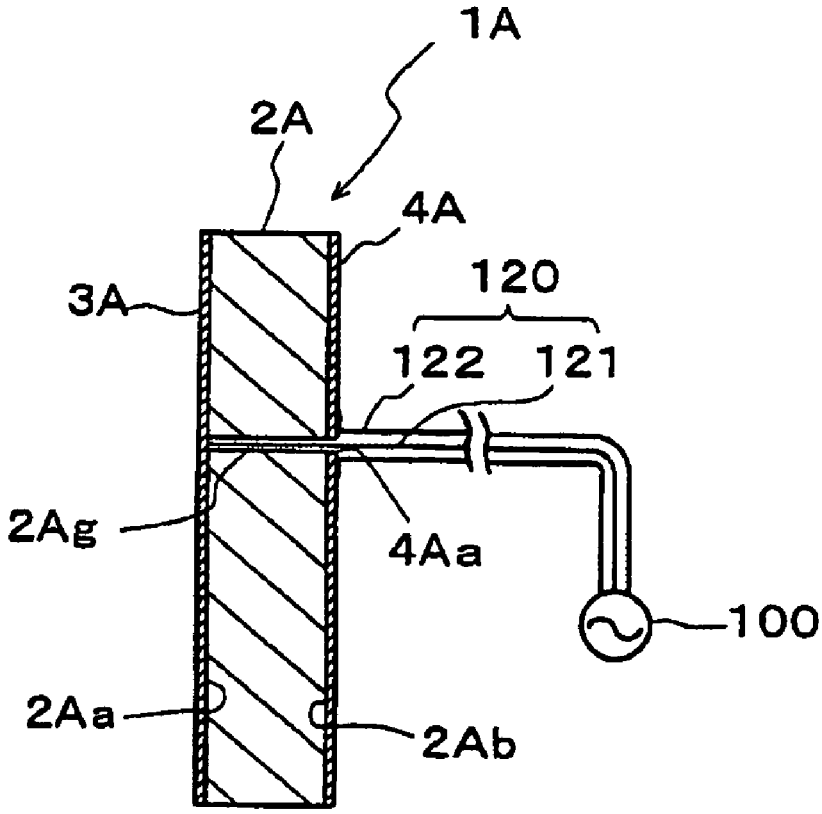
FIG. 16 is a schematic cross-sectional view of a patch antenna element, which serves as a feeding element.
Figure 17:
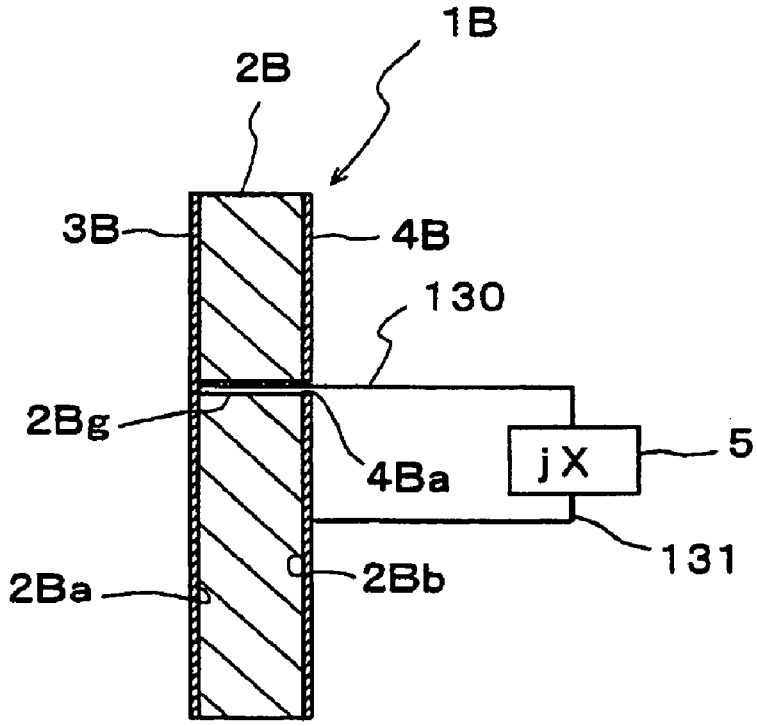
FIG. 17 is a schematic cross-sectional view of a patch antenna element, which serves as a parasitic element.

FIG. 14 is a schematic perspective view that shows an antenna device according to a third embodiment of the invention. FIG. 15 is a development of a patch antenna element. FIG. 16 is a schematic cross-sectional view of a patch antenna element, which serves as a feeding element. FIG. 17 is a schematic cross-sectional view of a patch antenna element, which serves as a parasitic element.

As shown in FIG. 14, the antenna device 200 of this embodiment includes a pair of patch antenna elements 1A and 1B that are arranged parallel to each other at a predetermined interval D. In this embodiment, the patch antenna device 1 of the first embodiment is used as each one of the pair of patch antenna elements. For easy understanding, the patch antenna element, which serves as a feeding element, and its components are assigned with reference numerals having the suffix "A", and the patch antenna element, which serves as a parasitic element, and its components are assigned with reference numerals having the suffix "B". Note that the patch antenna devices shown in FIG. 11 and FIG. 12, of course, may also be used as the patch antenna elements 1A and 1B. That is, the patch antenna element 1A (1B) is formed so that electrodes 3A and 4A (3B and 4B) are provided respectively on a facing front surface 2Aa (2Ba) and rear surface 2Ab (2Bb) of a rectangular parallelepiped-shaped dielectric substrate 2A (2B). Then, as shown in FIG. 15, the dielectric substrate 2A (2B) has a front surface 2Aa (2Ba), a rear surface 2Ab (2Bb), side surfaces 2Ac (2Bc) and 2Ad (2Bd), and end surfaces 2Ae (2Be) and 2Af (2Bf), and electrodes 3A and 4A (3B and 4B) are respectively formed substantially over the entire faces of the front surface 2Aa (2Ba) and rear surface 2Ab (2Bb).

As shown in FIG. 14, in the antenna device 200, the patch antenna elements 1A and 1B are arranged parallel to each other at an interval D so that the element 4A of the rear surface 2Ab of the patch antenna element 1A faces the electrode 3B of the front surface 2Ba of the patch antenna element 1B. A coaxial cable 120, which is extended from the power supply unit 100, is connected to the patch antenna element 1A, which is a feeding element. Specifically, as shown in FIG. 16, holes 2Ag and 4Aa are formed respectively in the dielectric substrate 2A and the electrode 4A so as to reach the electrode 3A of the patch antenna element 1A, and an internal conductor 121 of the coaxial cable 120 is inserted through the holes 2Ag and 4Aa and connected to the electrode 3A. In addition, an external conductor 122 of the coaxial cable 120 is connected to the electrode 4A.

In the patch antenna element 1B, which is a parasitic element, a reactance circuit 5 is connected between the front surface-side electrode and the rear surface-side electrode. Specifically, as shown in FIG. 17, holes 2Bg and 4Ba are formed respectively in the dielectric substrate 2B and the electrode 4B so as to reach the electrode 3B of the patch antenna element 1B, and a conductor wire 130 is inserted through the holes 2Bg and 4Ba. Thus, one end of the conductor wire 130 is connected to the electrode 3B, and the other end thereof is connected to an input end of the reactance circuit 5. Then, an output end of the reactance circuit 5 is connected to the conductor wire 131, while the conductor wire 131 is connected to the grounded rear surface-side electrode 4B.

As shown in FIG. 14 and FIG. 15, the patch antenna elements 1A and 1B have the same shape, and the width of each of the electrodes 3A and 3B (4A and 4B) is shorter than the length L. That is, both the patch antenna elements 1A and 1B each are formed into a long slender quadrangular prism in order to reduce in size in the width direction as compared with a typical square cylinder element. In addition, in this embodiment, the patch antenna element 1B, which is the parasitic element, is arranged on a side opposite to a radiation direction of the patch antenna element 1A. Specifically, the antenna device 200 sets the radiation direction of an electromagnetic wave to the electrode 3A side of the patch antenna element 1A. In order to increase the gain of an electromagnetic wave in this direction, the patch antenna element 1B is arranged on a side opposite to a radiation direction of an electromagnetic wave from the patch antenna element 1A, that is, arranged at the interval D on the right-hand side of the patch antenna element 1A in FIG. 14. Then, the interval D between the patch antenna elements 1A and 1B is set within the range of 0.12 times to 0.30 times a free space wavelength at the working frequency of a UHF band.

Figure 18:
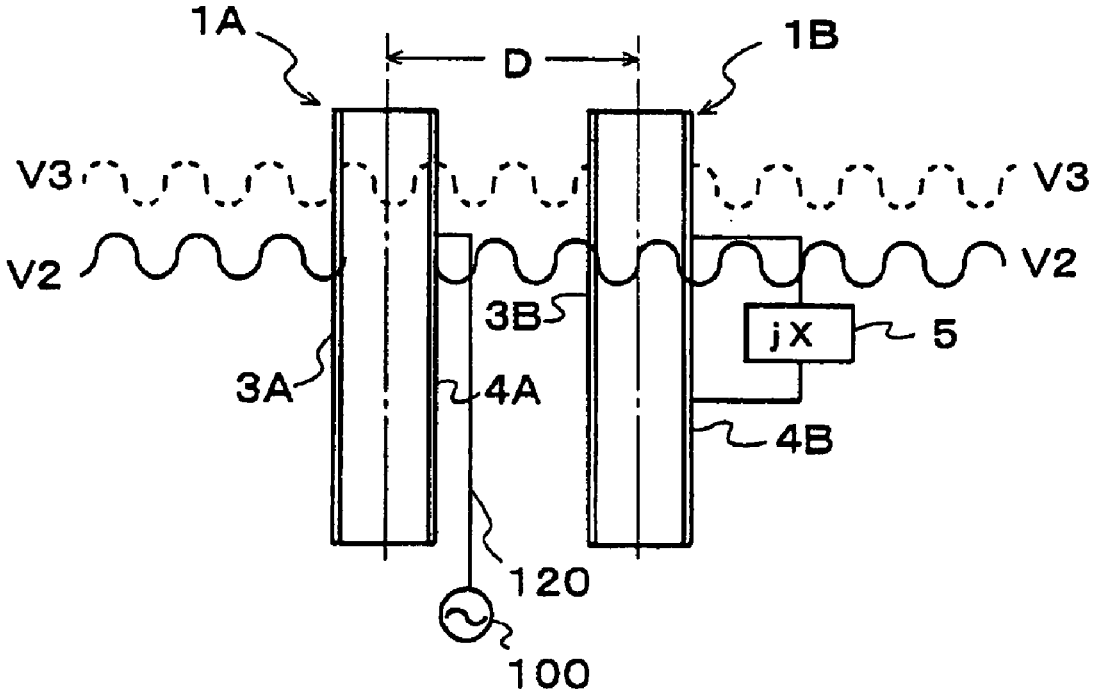
FIG. 18 is a schematic side view that illustrates the function and advantageous effects of the antenna device according to the third embodiment.

Next, the function and advantageous effects of the antenna device 200 according to this embodiment will be described. FIG. 18 is a schematic side view that illustrates the function and advantageous effects of the antenna device 200 according to this embodiment. As shown in FIG. 18, when a signal having a predetermined frequency is supplied from the power supply unit 100 through the coaxial cable 120 to the patch antenna element 1A, the patch antenna element 1A is excited, and as shown by the solid line, an electromagnetic wave V2 having a predetermined frequency is radiated from the electrodes 3A and 4A of the patch antenna element 1A toward the front side and rear side of the patch antenna element 1A. Then, the electromagnetic wave V2 radiated from the electrode 4A side is electromagnetically coupled with the patch antenna element 1B, and then the patch antenna element 1B resonates at the predetermined frequency. Thus, as shown by the broken line, the patch antenna element 1B radiates an electromagnetic wave V3 from the electrodes 3B and 4B toward the front side and rear side of the patch antenna element 1B. The phase and/or amplitude of the electromagnetic wave V3 may be adjusted by appropriately setting the reactance value of the reactance circuit 5 of the patch antenna element 1B and the element interval D between the patch antenna elements 1A and 1B. Thus, by appropriately adjusting the phase and/or amplitude of the electromagnetic wave V3 of the patch antenna element 1B, it is possible to make the electromagnetic wave V3, traveling toward the rear side of the patch antenna element 1B, interfere with the electromagnetic wave V2, radiated from the patch antenna element 1A, to suppress the electromagnetic waves V3 and V2. Then, it is possible to make the electromagnetic wave V3, traveling toward the front side of the patch antenna element 1B, interfere with the electromagnetic wave V2, radiated toward the front side of the patch antenna element 1A, to intensify the electromagnetic waves V3 and V2. By so doing, it is possible to increase the gain of an electromagnetic wave in the front direction of the antenna device 200 (in the left-hand direction in FIG. 18), while making it possible to increase the F/B ratio, which is the ratio of the gain of an electromagnetic wave in the front direction of the antenna device 200 to the gain of an electromagnetic wave in the rear direction.

Figure 19:
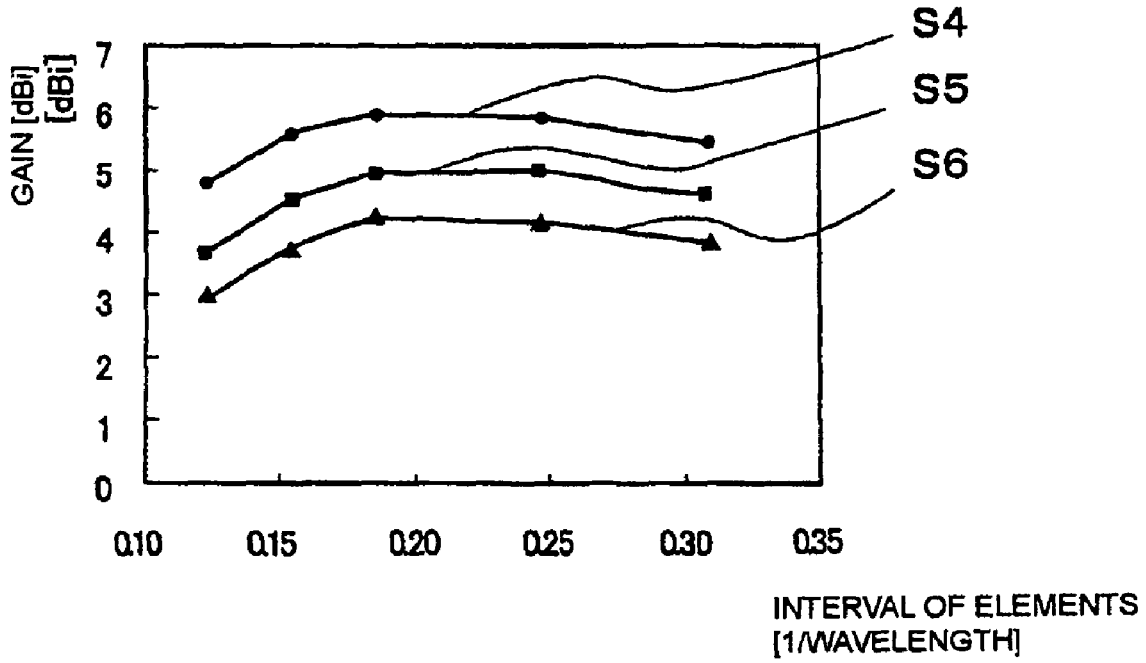
FIG. 19 is a correlation graph between an element interval and a gain.
Figure 20:
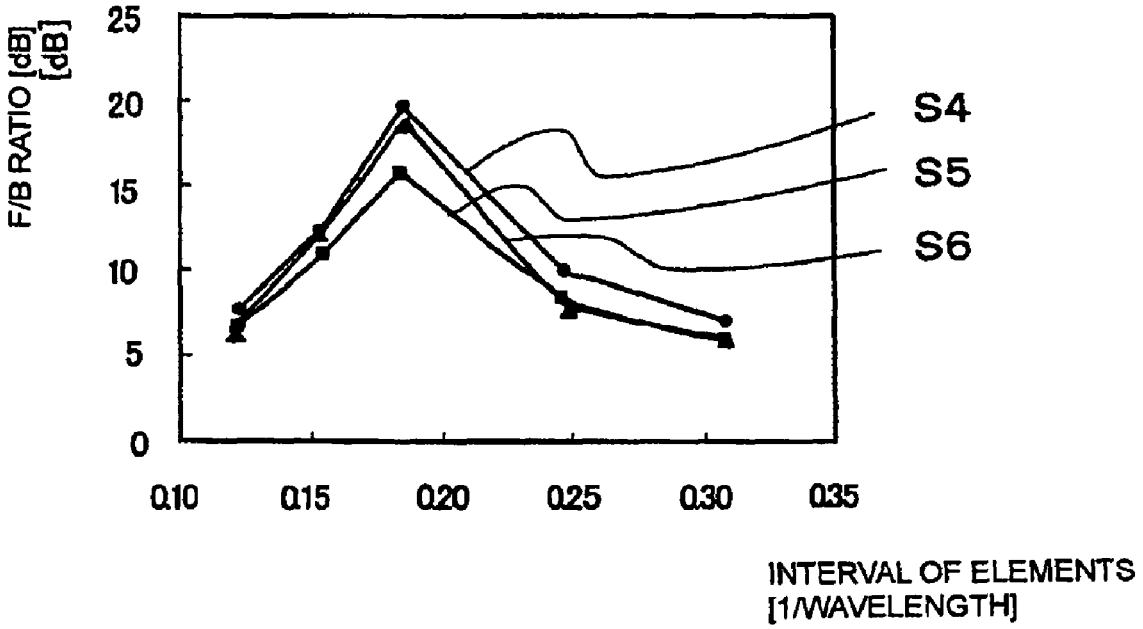
FIG. 20 is a correlation graph between an element interval and an F/B ratio.

The inventor conducted the following test in order to check the above advantageous effects. FIG. 19 is a correlation graph between an element interval D and a gain. FIG. 20 is a correlation graph between an element interval D and an F/B ratio. In this test, the patch antenna elements 1A and 1B were configured so that the dielectric substrates 2A and 2B each have a relative dielectric constant of 6.4, a width W of 15 mm, a length L of 80 mm, and a thickness T of 15 mm, and then a signal having a frequency of 920 MHz was supplied from the power supply unit 100 to the patch antenna element 1A. Then, while varying the element interval D between the patch antenna elements 1A and 1B, the gain and the F/B ratio were analyzed for each element interval D. The results shown by the curves S4 in FIG. 19 and FIG. 20 were obtained. Note that the element interval D in this test indicates a multiple of wavelength at the working frequency 920 MHz. As is apparent from the curve S4 in FIG. 19, it has been confirmed that in the antenna device 200, by setting the element interval D to 0.12 times to 0.30 times the wavelength, a gain higher than or equal to about 5 dB may be obtained. In addition, for the F/B ratio as well, as shown by the curve S4 in FIG. 20, by setting the element interval D to 0.12 times to 0.30 times the wavelength, about 7.5 dB or above may be obtained.

Next, the relative dielectric constant of each of the dielectric substrates 2A and 2B was changed to miniaturize the patch antenna elements 1A and 1B. Specifically, the relative dielectric constant of each of the dielectric substrates 2A and 2B was set to 21, the width W, length L and thickness T of each of the patch antenna elements 1A and 1B were respectively set to 10 mm, 55 mm and 15 mm, and then the test similar to the above test was conducted. As shown by the curve S5 in FIG. 19, when the element interval D ranges from 0.12 times to 0.30 times the wavelength, a gain higher than or equal to about 4 dB may be obtained, and as shown by the curve S5 in FIG. 20, an F/B ratio larger than or equal to about 6 dB may be obtained. Furthermore, the relative dielectric constant of each of the dielectric substrates 2A and 2B is increased to 38, the width W, length L and thickness T of each of the patch antenna elements 1A and 1B were respectively set to 10 mm, 40 mm and 15 mm, and then the test similar to the above test was conducted. As shown by the curve S6 in FIG. 19, when the element interval D ranges from 0.12 times to 0.30 times the wavelength, a gain higher than or equal to about 3 dB may be obtained, and as shown by the curve S6 in FIG. 20, an F/B ratio larger than or equal to about 5 dB may be obtained. That is, it has been confirmed that according to the antenna device 200 of this embodiment, when the element interval D between the patch antenna elements 1A and 1B is set within the range of 0.12 times to 0.30 times the wavelength at the working frequency, a gain higher than or equal to about 3 dB and an F/B ratio larger than or equal to about 5 dB may be obtained even when the microminiaturized patch antenna elements 1A and 1B having a length of 40 mm are used.

Figure 21:
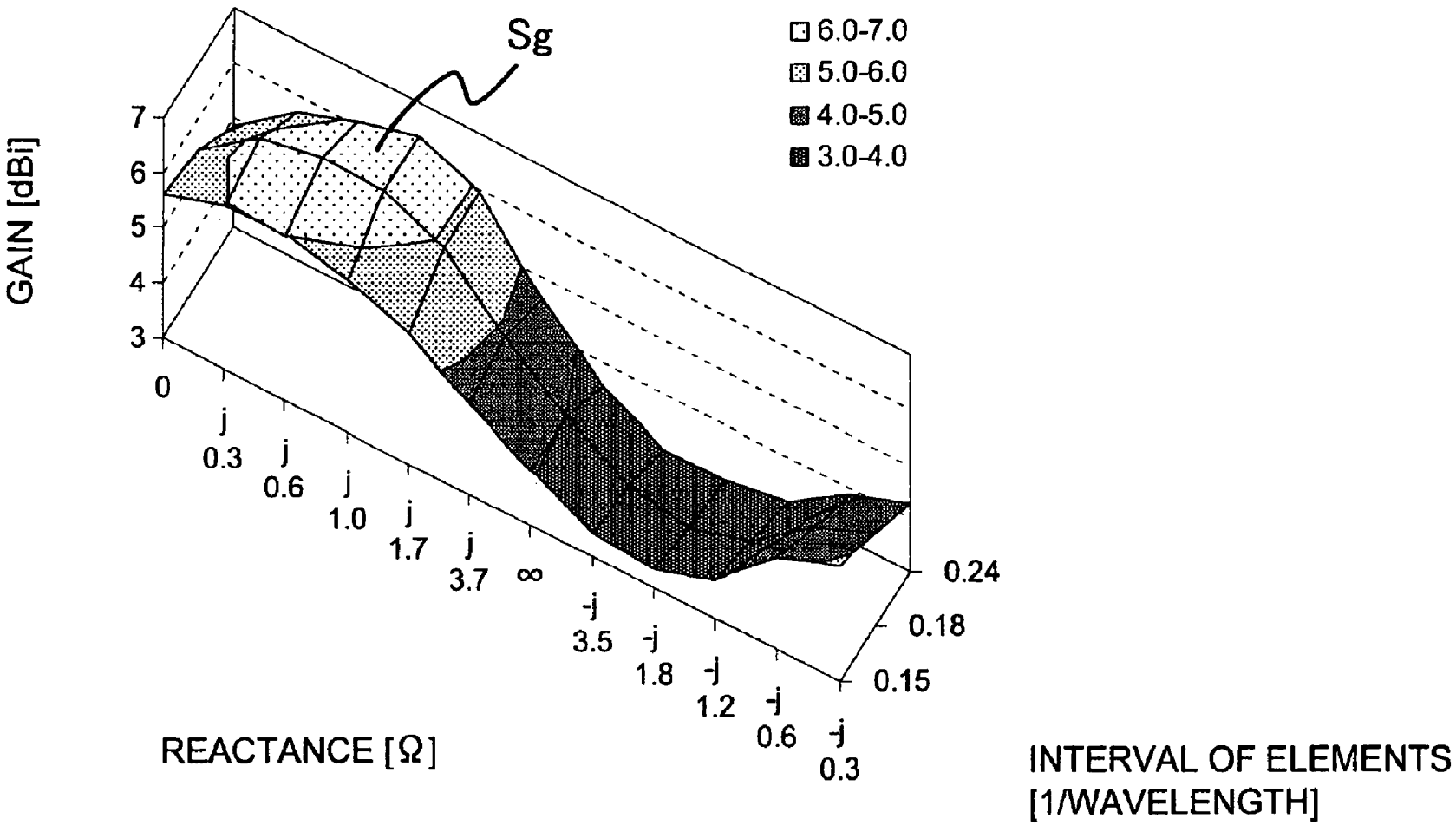
FIG. 21 is a correlation graph between a reactance and an element interval, and a gain.
Figure 22:
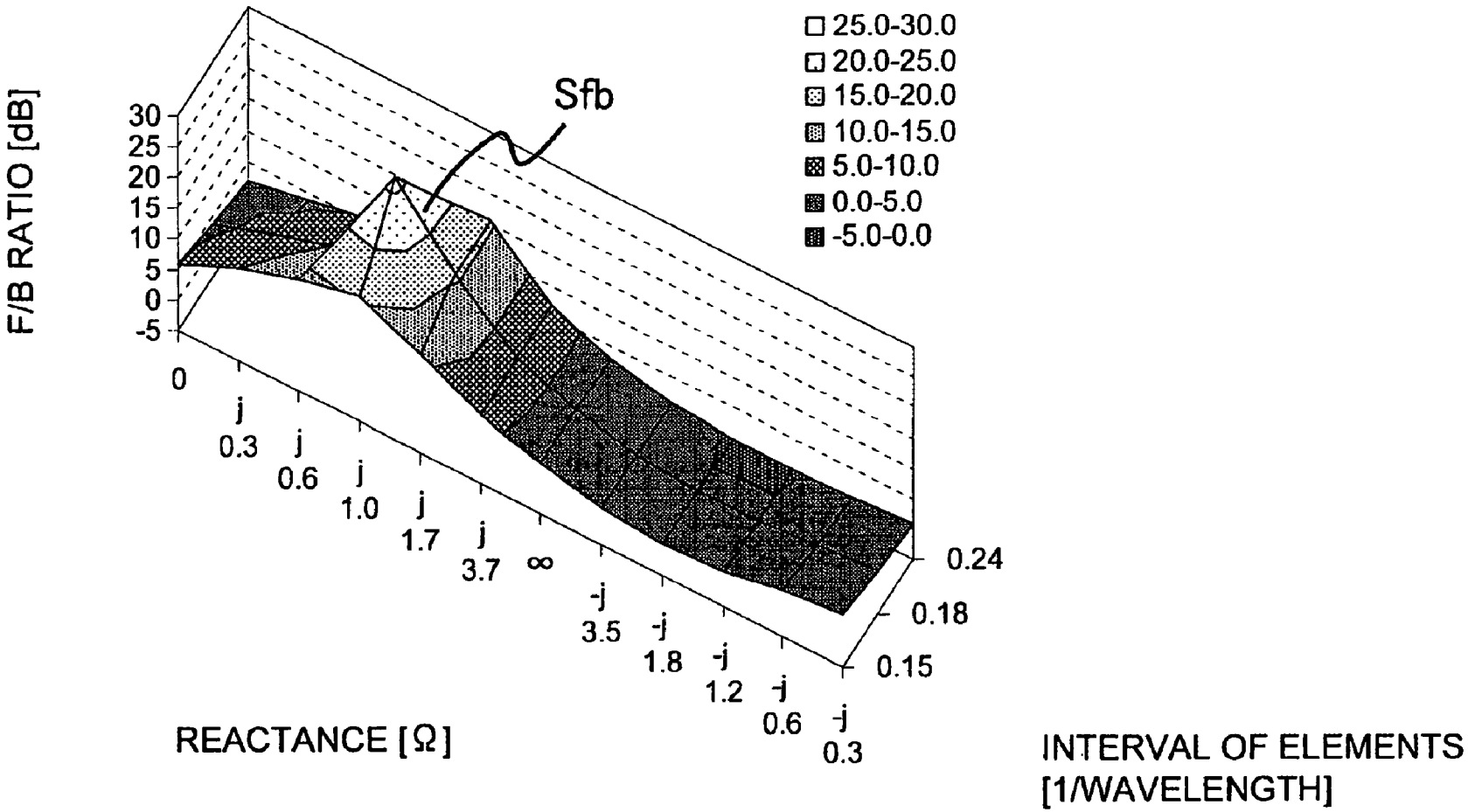
FIG. 22 is a correlation graph between a reactance and an element interval, and an F/B ratio.

Next, the inventor checked the relationship between a reactance of the reactance circuit 5 of the patch antenna element 1B and a gain of the antenna device 200 and the relationship between a reactance and an F/B ratio while varying the element interval D within the range of 0.15 times to 0.24 times the wavelength. FIG. 21 is a correlation graph between a reactance and an element interval D, and a gain. FIG. 22 is a correlation graph between a reactance and an element interval D, and an F/B ratio. In this test, the patch antenna elements 1A and 1B were configured so that the dielectric substrates 2A and 2B each have a relative dielectric constant of 6.4, a width W of 15 mm, a length L of 80 mm, and a thickness T of 15 mm, and then a signal having a frequency of 920 MHz was supplied from the power supply unit 100 to the patch antenna element 1A. Then, while varying the reactance of the reactance circuit 5 of the patch antenna element 1B, the gain and the F/B ratio were analyzed for each element interval D. Then, the results shown by the curved surfaces Sg and Sfb in FIG. 21 and FIG. 22 were obtained. As is apparent from the curved surface Sg in FIG. 21, when the reactance of the reactance circuit 5 is set to a value around j1.0Ω, a gain higher than or equal to 6 dB may be obtained. Normally, when the unit patch antenna elements having the same size are used, the limit is about 3 to 4 dB, whereas in the antenna device 200 of this embodiment, it is possible to obtain a gain higher by about 2 to 3 dB with the same size. In addition, as is apparent from the curved surface Sfb in FIG. 22, when the reactance of the reactance circuit 5 is set to a value around j1.0Ω, it is possible to obtain an F/B ratio larger than or equal to 10 dB. In addition, when the reactance of the reactance circuit 5 and the element interval D are set to optimal values, it is possible to obtain an F/B ratio larger than or equal to 20 dB.

As described above, according to the antenna device 200 of this embodiment, while the antenna device 200 is small, it is possible to obtain a high gain in the front direction and a large F/B ratio. In addition, because the patch antenna elements 1A and 1B are used as the elements, it is easy to match with an unbalanced circuit, such as a coaxial line. Thus, it is possible to efficiently supply a signal from the power supply unit 100 to the antenna device 200. Furthermore, between the patch antenna elements 1A and 1B, the patch antenna element 1B serves as a non-power supplied parasitic element. Thus, in comparison with an antenna that uses both the patch antenna elements 1A and 1B as driven elements, the structure is simple because a distribution circuit for a signal, or the like, is unnecessary. Hence, it is possible to reduce the cost of the antenna device 200. The other configuration, function and advantageous effects are similar to those of the first and second embodiments, so the description thereof is omitted.

Fourth Embodiment

Figure 23:
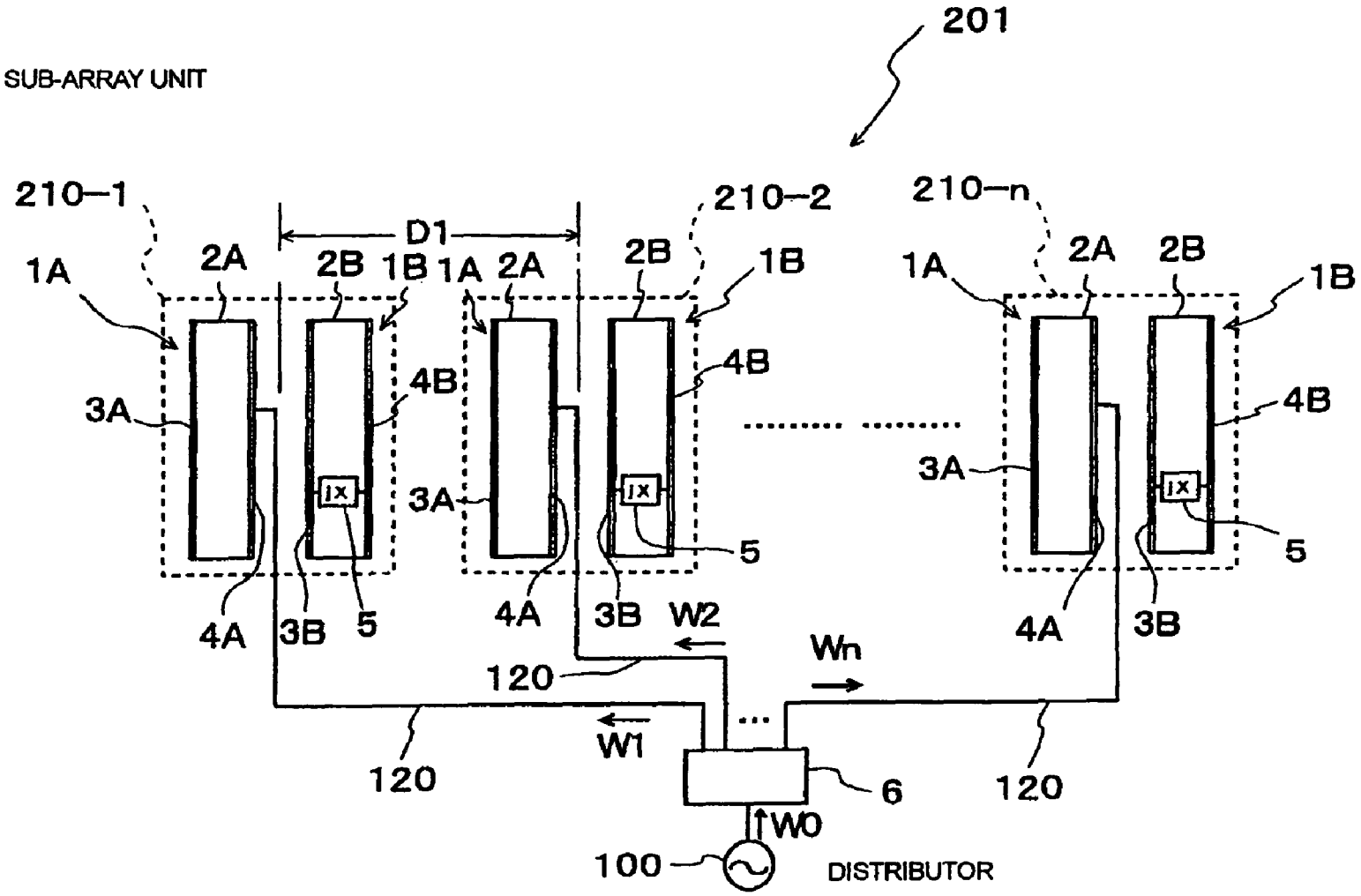
FIG. 23 is a schematic diagram that shows the configuration of an antenna device according to a fourth embodiment.
Figure 24:
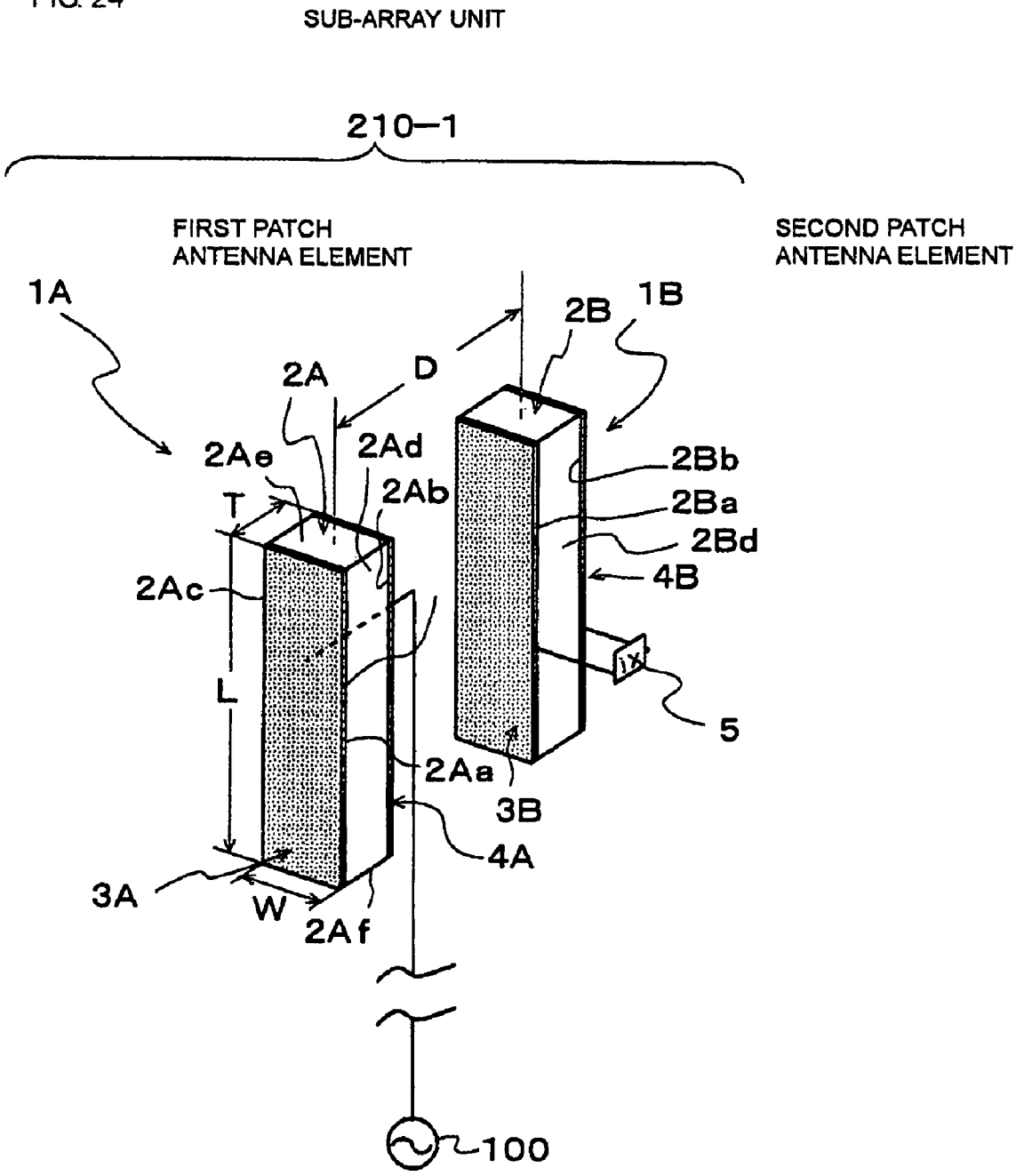
FIG. 24 is a perspective view that shows the configuration of each sub-array unit.
Figure 25:
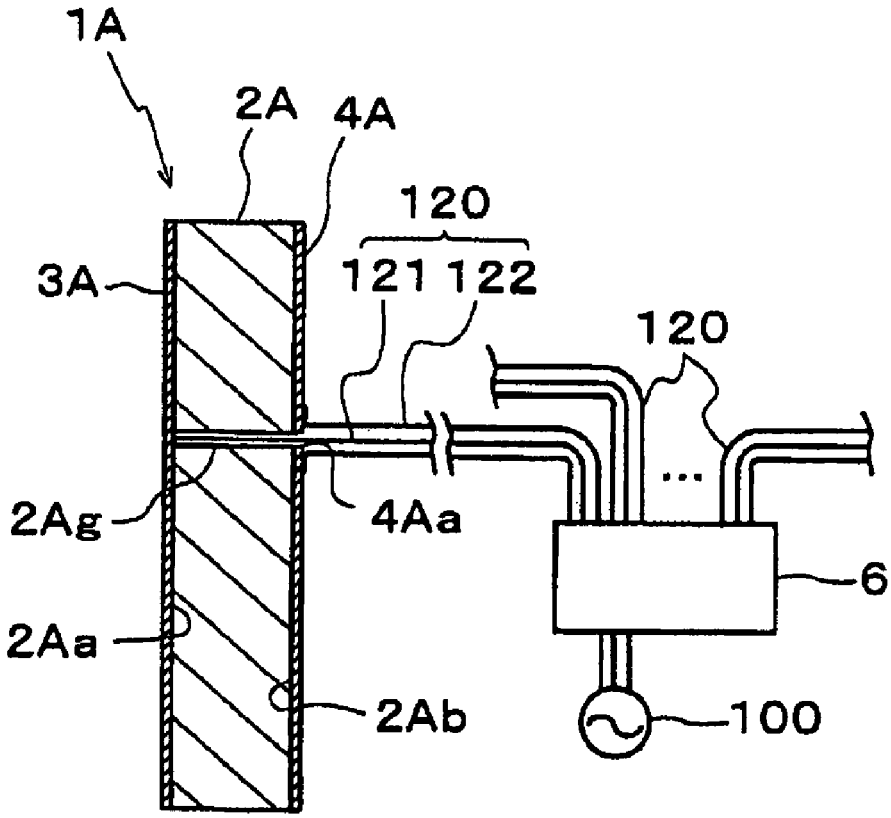
FIG. 25 is a schematic cross-sectional view of a first patch antenna element.

FIG. 23 is a schematic diagram that shows the configuration of an antenna device according to a fourth embodiment of the invention. FIG. 24 is a perspective view that shows the configuration of each sub-array unit. FIG. 25 is a schematic cross-sectional view of a first patch antenna element.

As shown in FIG. 23, an antenna device 201 of this embodiment includes n (n is integer larger than or equal to 2) sub-array units 210-1 to **210-*n*, and a distributor 6 for outputting an electric power (RF signal) from a power supply unit (RF source) 100 to the sub-array units 210-1 to 210-*n*** with a predetermined phase difference.

As shown in FIG. 24, each sub-array unit 210-1 (210-2 to **210-*n*) is formed of a first patch antenna element 1A, which is a feeding element placed on a front side, and a second patch antenna element 1B, which is a parasitic element placed on a rear side. That is, in this embodiment, the pair of patch antenna elements 1A and 1B used in the above third embodiment serve as the first patch antenna element 1A and the second patch antenna element 1B that constitute each sub-array unit 210-1 (210-2 to 210-*n***).

The first patch antenna element 1A is formed of a dielectric substrate 2A, a first electrode 3A and a second electrode 4A. The first electrode 3A and the second electrode 4A are formed respectively on the facing front face 2Aa and rear face 2Ab of the rectangular parallelepiped-shaped dielectric substrate 2A. Then, as shown in FIG. 23 and FIG. 25, a coaxial cable 120 is extended from the power supply unit 100 through the distributor 6 and connected to each first patch antenna element 1A.

Figure 26:
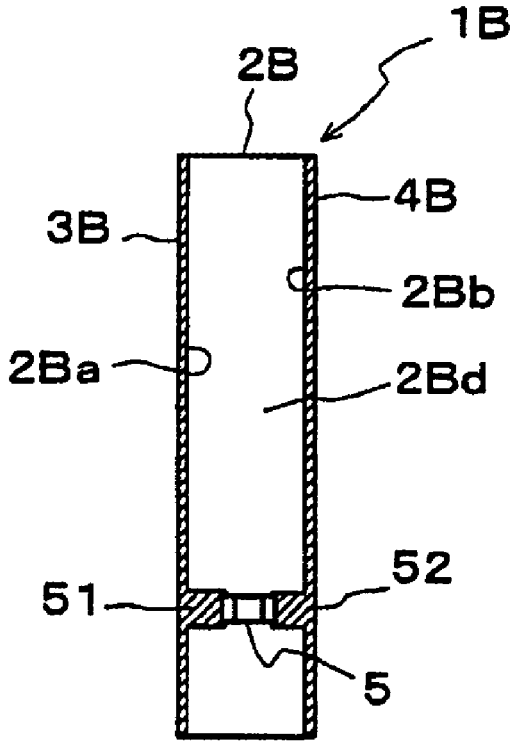
FIG. 26 is a side view of a second patch antenna element.
Figure 27:
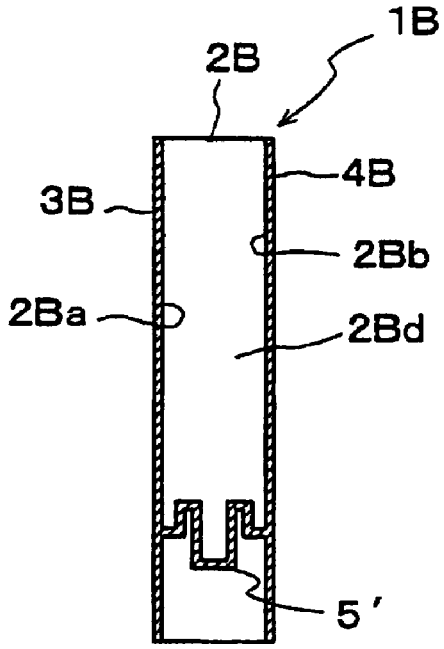
FIG. 27 is a side view of a second patch antenna element that shows an alternative embodiment of a reactance circuit.

As shown in FIG. 24, each second patch antenna element 1B, which is a parasitic element, is formed of a dielectric substrate 2B, a first electrode 3B and a second electrode 4B. The first electrode 3B and the second electrode 4B are formed respectively on the facing front face 2Ba and rear face 2Bb of the rectangular parallelepiped-shaped dielectric substrate 2B. Then, a reactance circuit 5 is connected to a side surface 2Bd side of the second patch antenna element 1B. By so doing, it is possible to adjust the reactance of the entire second patch antenna element 1B by the reactance circuit 5. FIG. 26 is a side view of the second patch antenna element 1B. The reactance circuit 5 may employ various circuits. For example, a discrete inductor, a discrete capacitor, a series resonant circuit or parallel resonant circuit formed of an inductor and a capacitor, a circuit in which an inductor or a capacitor is connected in series with this resonant circuit, a circuit that uses a variable capacitance element, such as a varactor, in place of a capacitor, or the like, may be employed. In this embodiment, the reactance circuit 5 employs an inductor. Specifically, as shown in FIG. 26, extended portions 51 and 52 of the first and second electrodes 3B and 4B of the second patch antenna element 1B are formed on the side surface 2Bd of the dielectric substrate 2B, and both ends of an inductor component 5 are connected respectively to the extended portions 51 and 52. Note that the inductor may be not only formed of the chip component-like inductor component 5 but also formed of an electrode. For example, as shown in FIG. 27, a meander-shaped electrode 5' having an appropriate length may be patterned on the side surface 2Bd of the dielectric substrate 2B, and both ends of the electrode may be connected to the first and second electrodes 3B and 4B. By so doing, it is possible to reduce the number of components.

In the above similarly shaped first and second patch antenna elements 1A and 1B, as shown in FIG. 23 and FIG. 24, the first patch antenna element 1A is arranged so as to be located in front of the second patch antenna element 1B. Specifically, the first and second patch antenna elements 1A and 1B are arranged parallel to each other at an interval D, the second electrode 4A of the first patch antenna element 1A located on the front side faces the first electrode 3B of the second patch antenna element 1B located on the rear side.

Figure 28:
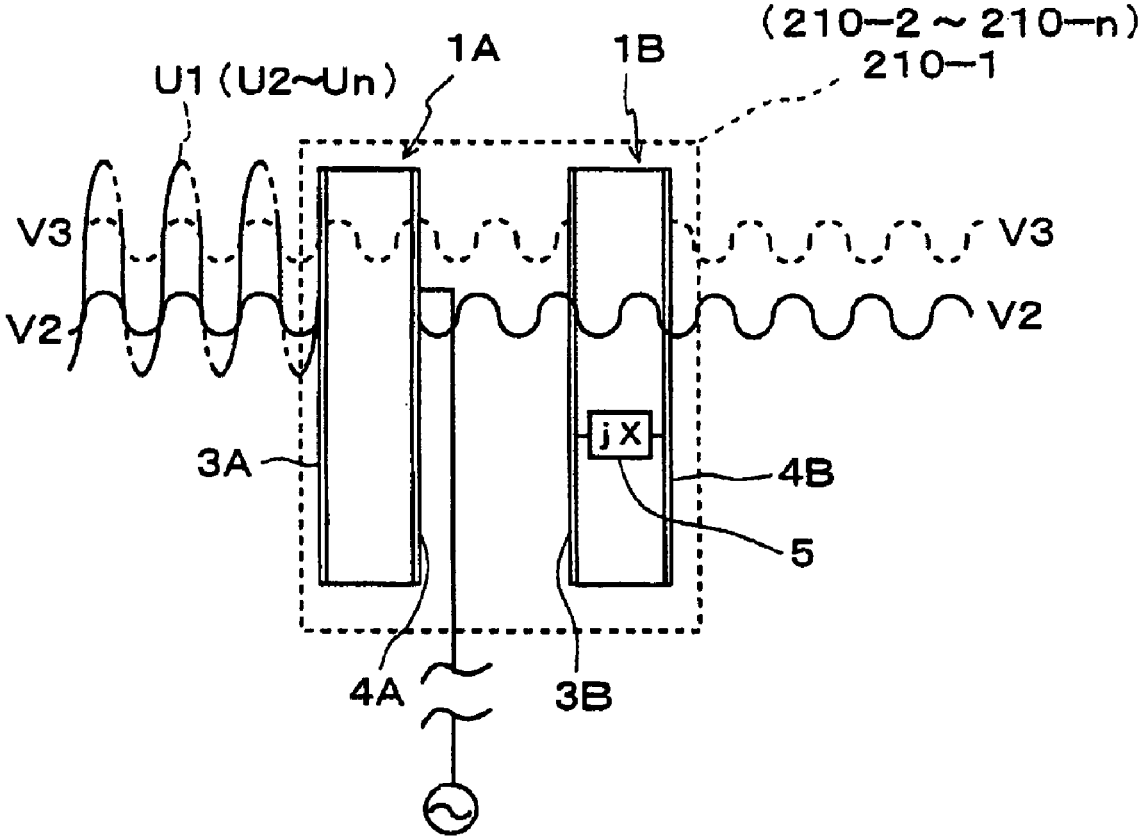
FIG. 28 is a schematic side view that illustrates radio wave radiation of each sub-array unit.

FIG. 28 is a schematic side view that illustrates radio wave radiation of each sub-array unit 210-1 (210-2 to **210-*n*). As shown in FIG. 23, when an electric power W1 (W2 to Wn) having a predetermined frequency is supplied from the power supply unit 100 through the distributor 6 and the coaxial cable 120 to the first patch antenna element 1A of each sub-array unit 210-1 (210-2 to 210-*n*), as shown by the solid line in FIG. 28, a radio wave V2 having a predetermined frequency is radiated frontward and rearward from the first electrode 3A of the first patch antenna element 1A. Then, the radio wave V2 radiated from the second electrode 4A side of the first patch antenna element 1A is electromagnetically coupled with the second patch antenna element 1B, and the second patch antenna element 1B resonates at the predetermined frequency. Thus, as shown by the broken line, the second patch antenna element 1B radiates a radio wave V3 from the first and second electrodes 3B and 4B in the front direction and rear direction of the second patch antenna element 1B. At this time, by appropriately adjusting the phase and/or amplitude of the radio wave V3 using the reactance circuit 5, it is possible to make the radio wave V3, traveling toward the rear side of the second patch antenna element 1B, interfere with the radio wave V2 from the first patch antenna element 1A to suppress the radio wave. Then, by superimposing the radio wave V3, traveling in the front direction of the second patch antenna element 1B, on the radio wave V2 radiated in the front direction of the first patch antenna element 1A, it is possible to intensify the radio wave. That is, by using each sub-array unit 210-1 (210-2 to 210-*n*), as shown by the alternate long and two short dashed lines, it is possible to radiate a composite radio wave U1 (U2 to Un) of the radio waves V2 and V3, having a high gain, toward the front side (in the left-hand direction in FIG. 28) of each sub-array unit 210-1 (210-2 to 210-*n***).

As shown in FIG. 23, the n sub-array units 210-1 to **210-*n* are arranged in a line at intervals D1, the second electrode 4B of the second patch antenna element 1B of the preceding sub-array unit 210-*m* ($1 \leqq m < n$) is arranged so as to face the first electrode 3A of the first patch antenna element 1A of the subsequent sub-array unit 210-($m$+1). That is, the radio wave radiation direction of each of the sub-array units 210-1 to 210-*n* is oriented toward the front side (left-hand side in FIG. 23). Then, the interval D1 between the preceding sub-array unit 210-*m* and the subsequent sub-array unit 210-($m$+1) is set to substantially half the free space wavelength at the working frequency. Specifically, the interval D1 is set to half the wavelength at the frequency of the electric power W0 supplied from the power supply unit 100**.

The distributor 6 is a known distributor, and gives a predetermined phase difference to the electric power W0 supplied from the power supply unit 100 and distributes the electric signals W1 to Wn, whose phases are deviated, respectively to the sub-array units 210-1 to **210-*n*. Specifically, the distributor 6 operates so that a phase difference between electric signals Wm and Wm+1 supplied respectively to the preceding sub-array unit 210-*m* and the subsequent sub-array unit 210-($m$+1) is 180°. In addition, the distributor 6 operates so that the electric signal Wm+1 supplied to the subsequent sub-array unit 210-($m$+1) advances by a phase difference of 180° from the electric signal Wm supplied to the preceding sub-array unit 210-*m*. Thus, the phase of a radio wave radiated from the subsequent sub-array unit 210-($m$+1) advances by 180° from the phase of a radio wave radiated from the preceding sub-array unit 210-*m***.

Figure 29:
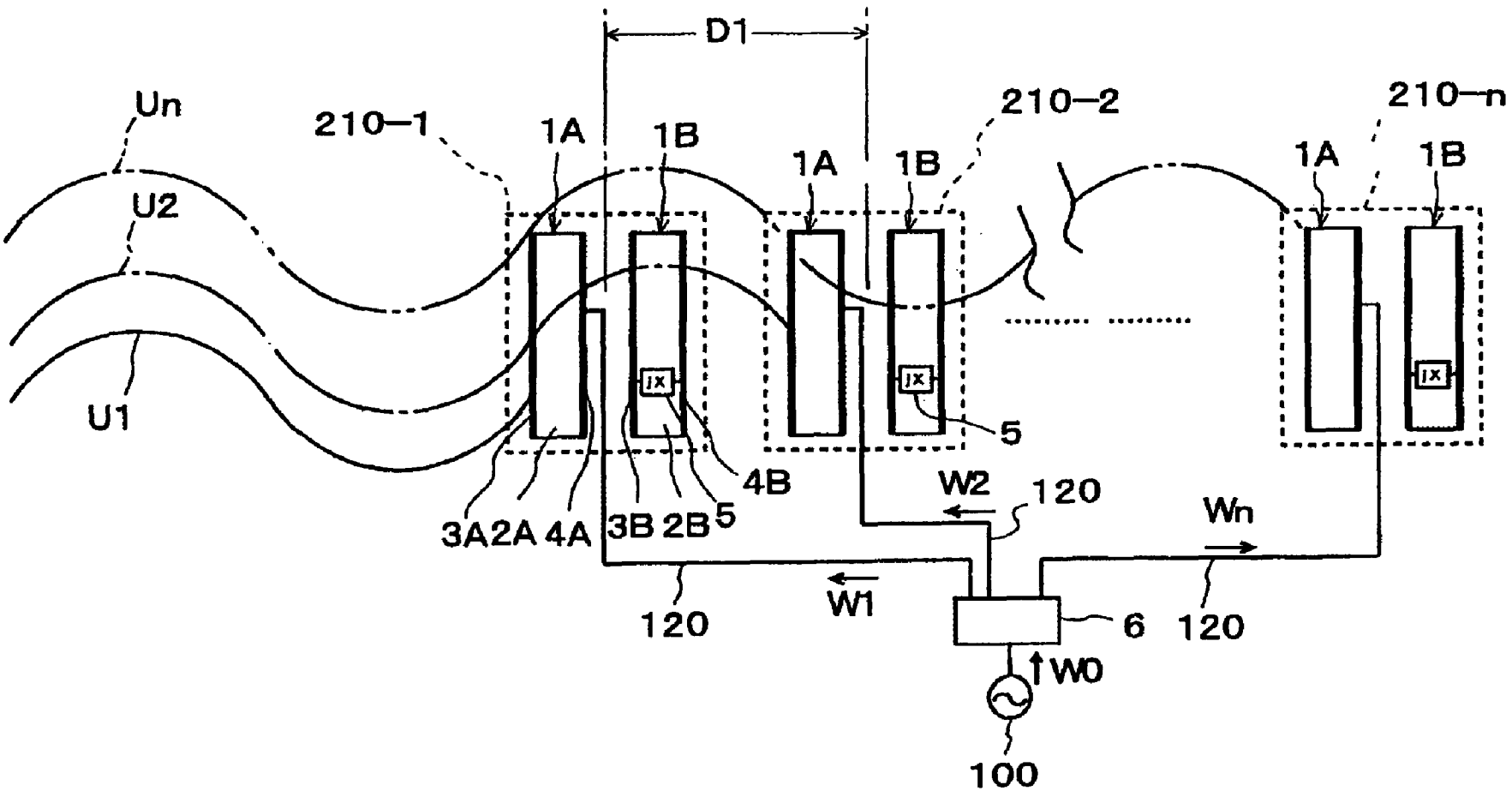
FIG. 29 is a schematic diagram that illustrates the function and advantageous effects of the antenna device.

Next, the function and advantageous effects of the antenna device according to this embodiment will be described. FIG. 29 is a schematic diagram that illustrates the function and advantageous effects of the antenna device. As shown in FIG. 29, when an electric signal W0 is output from the power supply unit 100, electric signals W1 to Wn sequentially having a phase difference of 180° are generated by the distributor 6, and these electric signals W1 to Wn are respectively supplied to the first patch antenna elements 1A of the sub-array units 210-1 to **210-*n*. Thus, the radio wave Un indicated by the alternate long and two short dashed lines is radiated from the last sub-array unit 210-*n*, and the radio wave Un−1 is radiated from the preceding sub-array unit 210-($n$−1) with the phase delayed by 180° from the radio wave Un. Then, the radio wave U2 indicated by the alternate long and short dashed line is radiated from the sub-array unit 210-2 with the phase delayed by 180°×(n−2) from the radio wave Un, and finally the radio wave U1 shown by the solid line is radiated from the sub-array unit 210-1 with the phase delayed by 180°×(n−1) from the radio wave Un. At this time, because the interval D1 between the adjacent sub-array units 210-*m* and 210-($m$+1) is set to half the wavelength of the radio wave U1 (U2 to Un) radiated from the sub-array unit 210-1 (210-2 to 210-*n*), all the radio waves U1 to Un radiated in the front direction of the sub-array unit 210-1 coincide with one another. As a result, the radio waves U1 to Un are superimposed, and the gain of a radio wave radiated from the antenna device 201** increases in association with the number n of sub-array units.

Figure 30:
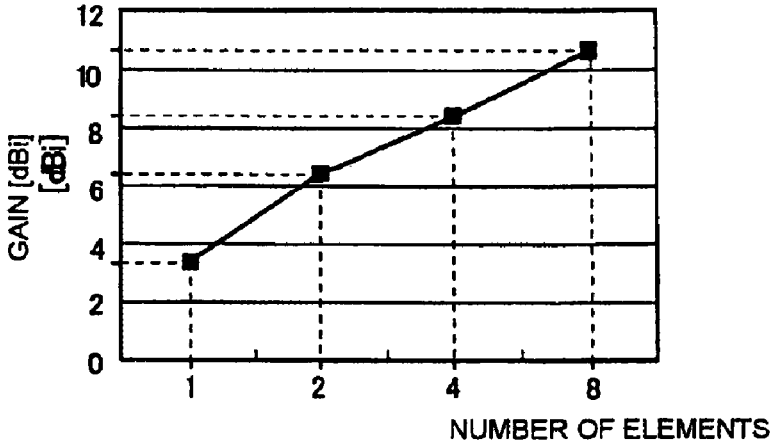
FIG. 30 is a correlation graph between the number of patch antenna elements and a gain.

The inventor conducted the following simulation in order to check the above advantageous effects. FIG. 30 is a correlation graph between the number of patch antenna elements and a gain. In this simulation, the patch antenna elements were configured so that the dielectric substrates 2A and 2B each have a relative dielectric constant of 6.4, a width W of 15 mm, a length L of 80 mm and a thickness T of 15 mm (see FIG. 24), and then an electric power having a frequency of 920 MHz was supplied to the patch antenna element. Then, the number of patch antenna elements was varied, and the gain was analyzed for each number of elements. The results shown in FIG. 30 were obtained. Note that in this simulation, the gain when the number of elements is "1" is a gain when only the first patch antenna element 1A was simulated without the second patch antenna element 1B, which serves as a parasitic element, accompanied therewith; the number of elements "2" indicates a gain when the first and second patch antenna elements 1A and 1B that constitute each sub-array unit were simulated; the number of elements "4" indicates a gain when two sub-array units, each of which is formed of the first and second patch antenna elements 1A and 1B, were arranged in a line and simulated; the number of elements "8" indicates a gain when four sub-array units were arranged in a line and simulated. As is apparent from FIG. 30, when the number of patch antenna elements doubles, the gain also increases by about 3 dBi. Thus, as in the case of the antenna device 201 of this embodiment, it has been confirmed that by using the n sub-array units 210-1 to **210-*n***, the gain may be increased in association with the number n of sub-array units.

As described above, according to the antenna device 201 of this embodiment, because the gain of the radio wave may be increased in association with the number of sub-array units and/or the number of patch antenna elements, it is possible to implement the antenna device that radiates a radio wave with a high gain. Furthermore, because the first and second patch antenna elements 1A and 1B are arranged in a line in the radiation direction of the radio wave, it is possible to implement the miniaturized antenna device 201 in a small area in the planar direction. As a result, it is possible to easily mount the antenna device 201 of this embodiment on an electronic device having a narrow antenna mounting area as well. In addition, because the patch antenna elements 1A and 1B are used as components, it is easy to match with an unbalanced circuit, such as a coaxial line and, therefore, it is possible to efficiently supply an electric power from the power supply unit 100 to the antenna device 201. The other configuration, function and advantageous effects are similar to those of the first to third embodiments, so the description thereof is omitted.

Fifth Embodiment

Figure 31:
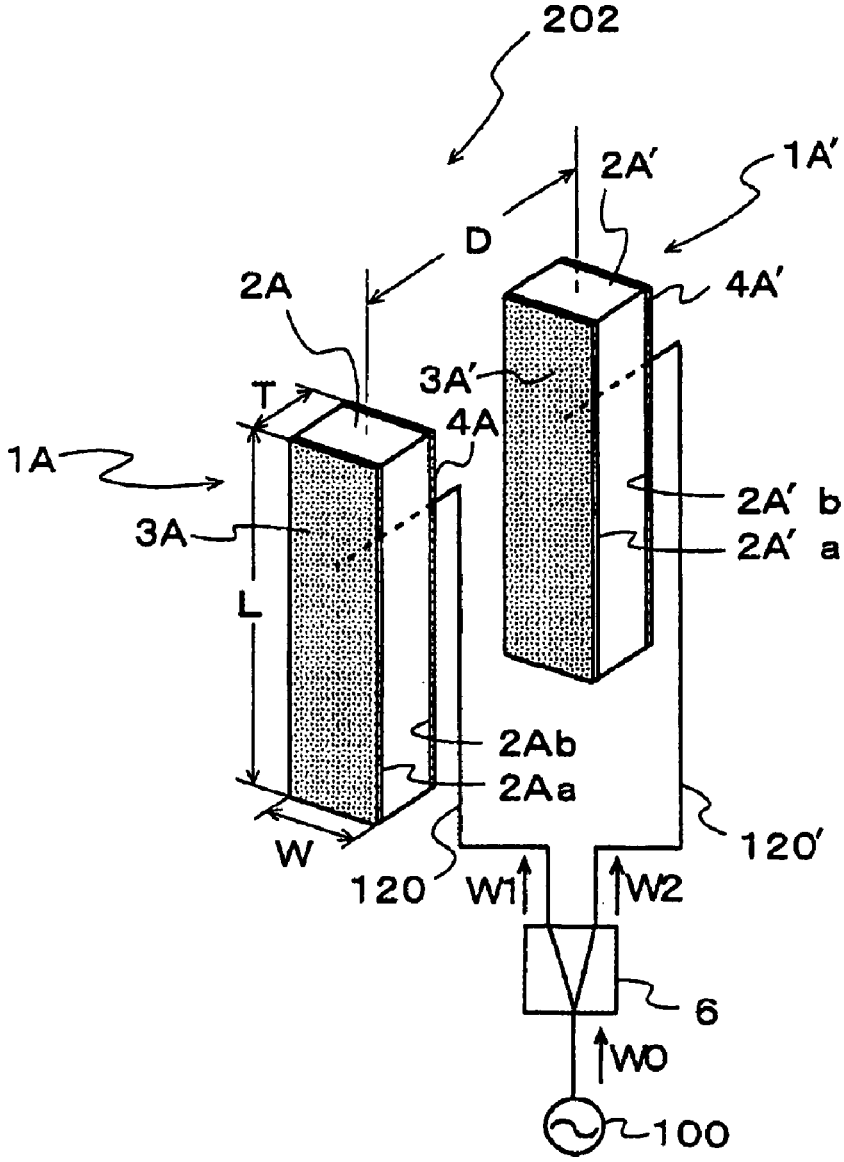
FIG. 31 is a schematic perspective view that shows an antenna device according to a fifth embodiment.
Figure 32:
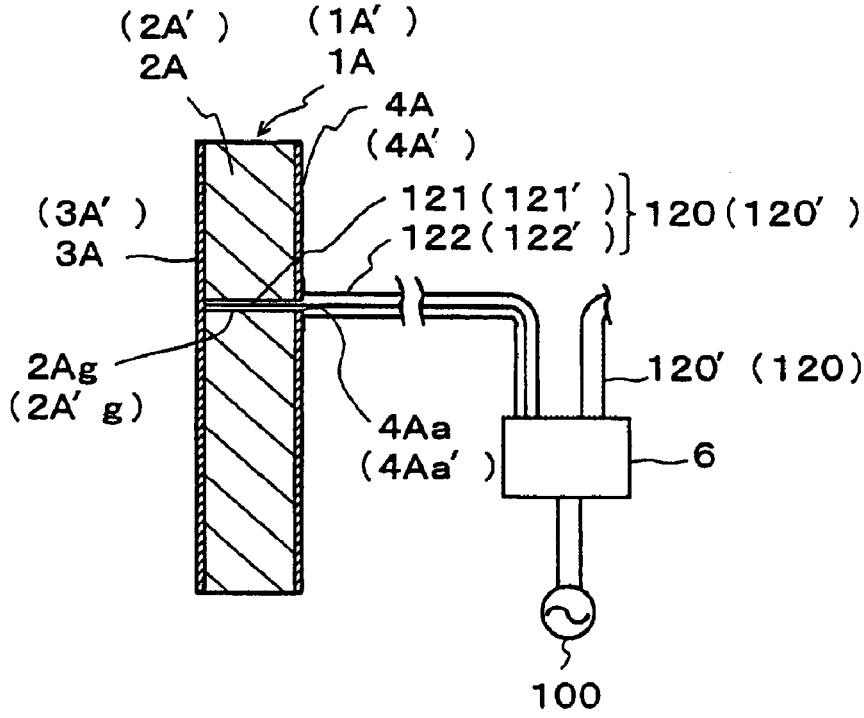
FIG. 32 is a schematic cross-sectional view of each patch antenna element.

FIG. 31 is a schematic perspective view that shows an antenna device according to a fifth embodiment of the invention. FIG. 32 is a schematic cross-sectional view of each patch antenna element.

As shown in FIG. 31, the antenna device 202 of this embodiment includes a pair of patch antenna elements 1A and 1A' that are arranged parallel to each other at a predetermined interval D. The patch antenna element 1A (1A') is the patch antenna device 1 of the first embodiment, and is a feeding element such that electrodes 3A and 4A (3A' and 4A') are provided respectively on an opposite front surface 2Aa (2Aa') and rear surface 2Ab (2Ab') of a rectangular parallelepiped-shaped dielectric substrate 2A (2A').

As shown in FIG. 31, in the antenna device 202, the patch antenna elements 1A and 1A' are arranged parallel to each other at the interval D so that the electrode 4A of the rear surface 2Ab of the patch antenna element 1A faces the electrode 3A' of the front surface 2Aa' of the patch antenna element 1A', and coaxial cables 120 and 120' of the patch antenna elements 1A and 1A' are connected through a distributor 6 to a power supply unit (RF source) 100.

As shown in FIG. 32, the coaxial cable 120 (120') is extended from the distributor 6 and connected to the patch antenna element 1A (1A').

As shown in FIG. 31, the above patch antenna elements 1A and 1A' have the same shape, and the width W of each of the electrodes 3A and 3A' (4A and 4A') is shorter than the length L. That is, both the patch antenna elements 1A and 1A' each are formed into a long slender quadrangular prism in order to reduce in size in the width direction as compared with a typical square element.

The distributor 6 distributes an electric signal W0 having a predetermined frequency, supplied from the power supply unit 100, to electric signals W1 and W2, and supplies the electric signals W1 and W2 to the patch antenna elements 1A and 1A'. The distributor 6, when distributing, has a function to output the electric signals W1 and W2 by providing a difference between the phase of the electric power W1 and the phase of the electric signals W2. In this embodiment, the phase difference between the electric signals W1 and W2 ranges from 60 degrees to 120 degrees. Note that when a distributor is not operable to output by providing a phase difference, by varying the lengths of the coaxial cables 120 and 120' to the elements, it is possible to provide the above phase difference. In addition, the distributor 6 may not only be one that equalizes a distribution ratio of the electric signal W1 and a distribution ratio of the electric signal W2, but may also be one that makes the distribution ratio unequal. However, in this embodiment, the selected distributor 6 sets a distribution ratio of the electric signal W1 to the electric signal W2 so that the amplitude of a radio wave radiated from one of the patch antenna elements 1A and 1A' is higher by a value ranging from 2 dB to 6 dB than the amplitude of a radio wave radiated from the other one. The above distributor 6 is a known circuit, and may be, for example, a 90-degree hybrid coupler, a combining T, a delay line, or the like, and a circuit whose output-side distribution ratio is appropriately set is employed.

Figure 33:
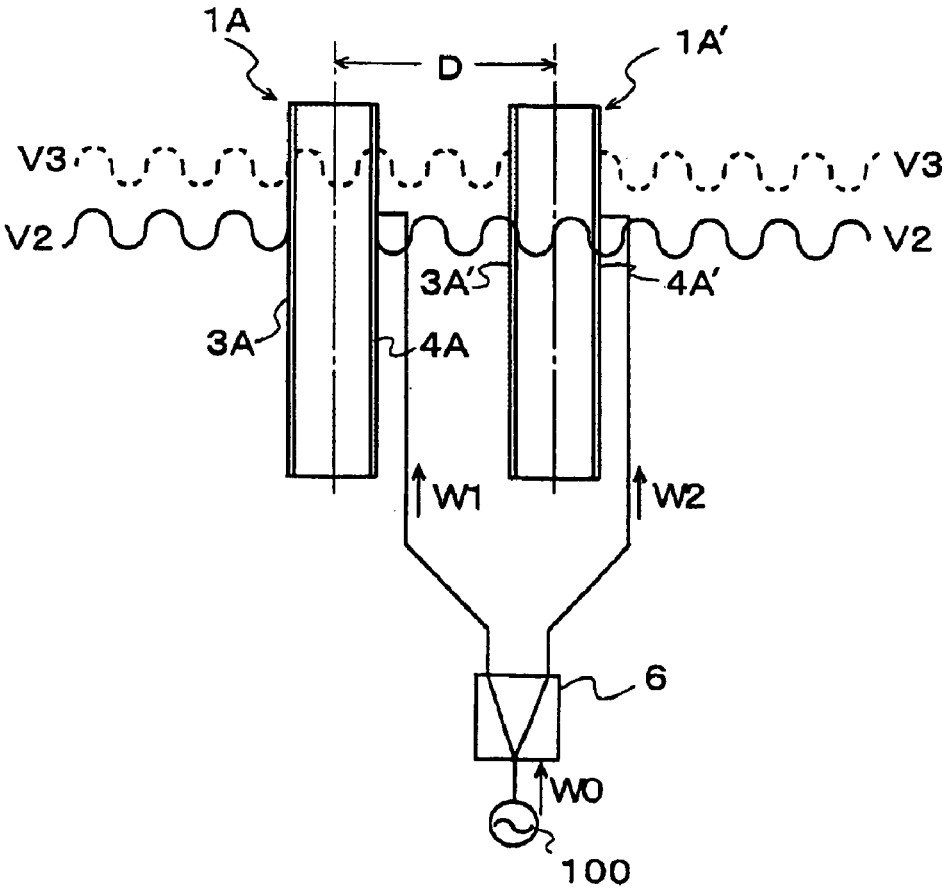
FIG. 33 is a schematic side view that illustrates the function and advantageous effects of the antenna device according to the fifth embodiment.

Next, the function and advantageous effects of the antenna device 202 according to this embodiment will be described. FIG. 33 is a schematic side view that illustrates the function and advantageous effects of the antenna device 202 according to this embodiment. As shown in FIG. 33, when an electric signal W0 having a predetermined frequency is supplied from the power supply unit 100, the electric signal W1 and the electric signal W2, distributed by the distributor 6, are respectively supplied through the coaxial cables 120 and 120' to the patch antenna elements 1A and 1A'. Thus, the patch antenna elements 1A and 1A' both are excited, and as shown in the solid line, a radio wave V2 having a predetermined frequency is radiated from the electrodes 3A and 4A of the patch antenna element 1A toward the front side and rear side of the patch antenna element 1A, and as shown by the broken line, a radio wave V3 having a predetermined frequency is radiated from the electrodes 3A' and 4A' of the patch antenna element 1A' toward the front side and rear side of the patch antenna element 1A'. At this time, by appropriately setting a phase difference between the radio waves V2 and V3, it is possible to increase the gain of the antenna device 202 in a desired radiation direction and the F/B ratio of the antenna device 202. In addition, by setting the amplitude ratio of the radio waves V2 and V3, it is possible to further increase the gain in the radiation direction.

For example, when the radiation direction of the antenna device 202 is set to the front direction (left-hand direction in FIG. 33) of the patch antenna element 1A, the distributor 6 is selected so that the phase of the electric signal W1 supplied to the patch antenna element 1A is delayed by 60 degrees to 120 degrees from the phase of the electric signal W2 supplied to the patch antenna element 1A'. By so doing, the radio wave V2 traveling toward the front side of the patch antenna element 1A is amplified by the radio wave V3 from the patch antenna element 1A', and the gain in the front direction of the antenna device 202 increases. In addition, the radio wave V3 traveling toward the rear side of the patch antenna element 1A' interferes with the radio wave V2 of the rear side of the patch antenna element 1A and is suppressed, so the F/B ratio of the antenna device 202 increases. In addition, in the above phase difference, when the gain in the front direction of the antenna device 202 is further increased, the distributor 6 is selected so as to have a distribution ratio such that the amplitude of the radio wave V2 from the patch antenna element 1A is larger than the amplitude of the radio wave V3 from the patch antenna element 1A'.

Conversely, when the radiation direction of the antenna device 202 is set to the rear direction (right-hand direction in FIG. 33) of the patch antenna element 1A', the distributor 6 is selected so that the phase of the electric signal W2 supplied to the patch antenna element 1A' is delayed by 60 degrees to 120 degrees from the phase of the electric signal W1 supplied to the patch antenna element 1A. By so doing, the radio wave V3 traveling toward the rear side of the patch antenna element 1A' is amplified by the radio wave V2 from the patch antenna element 1A, and the gain in the rear direction of the antenna device 202 increases. In addition, the radio wave V2 traveling toward the front side of the patch antenna element 1A interferes with the radio wave V3 of the front side of the patch antenna element 1A' and is suppressed, so the F/B ratio of the antenna device 202 increases. In addition, in the above phase difference, when the gain in the rear direction of the antenna device 202 is further increased, the distributor 6 is selected so as to have a distribution ratio such that the amplitude of the radio wave V3 from the patch antenna element 1A' is larger than the amplitude of the radio wave V2 from the patch antenna element 1A. Note that in this embodiment, the distributor 6 having the above distribution ratio and phase difference is selected; however, when a distributor that is able to vary these distribution ratio and phase difference is used, it is not only possible to improve a gain and/or an F/B ratio without replacing the distributor 6 but also possible to selectively change the directivity of the antenna device 202.

Figure 34:
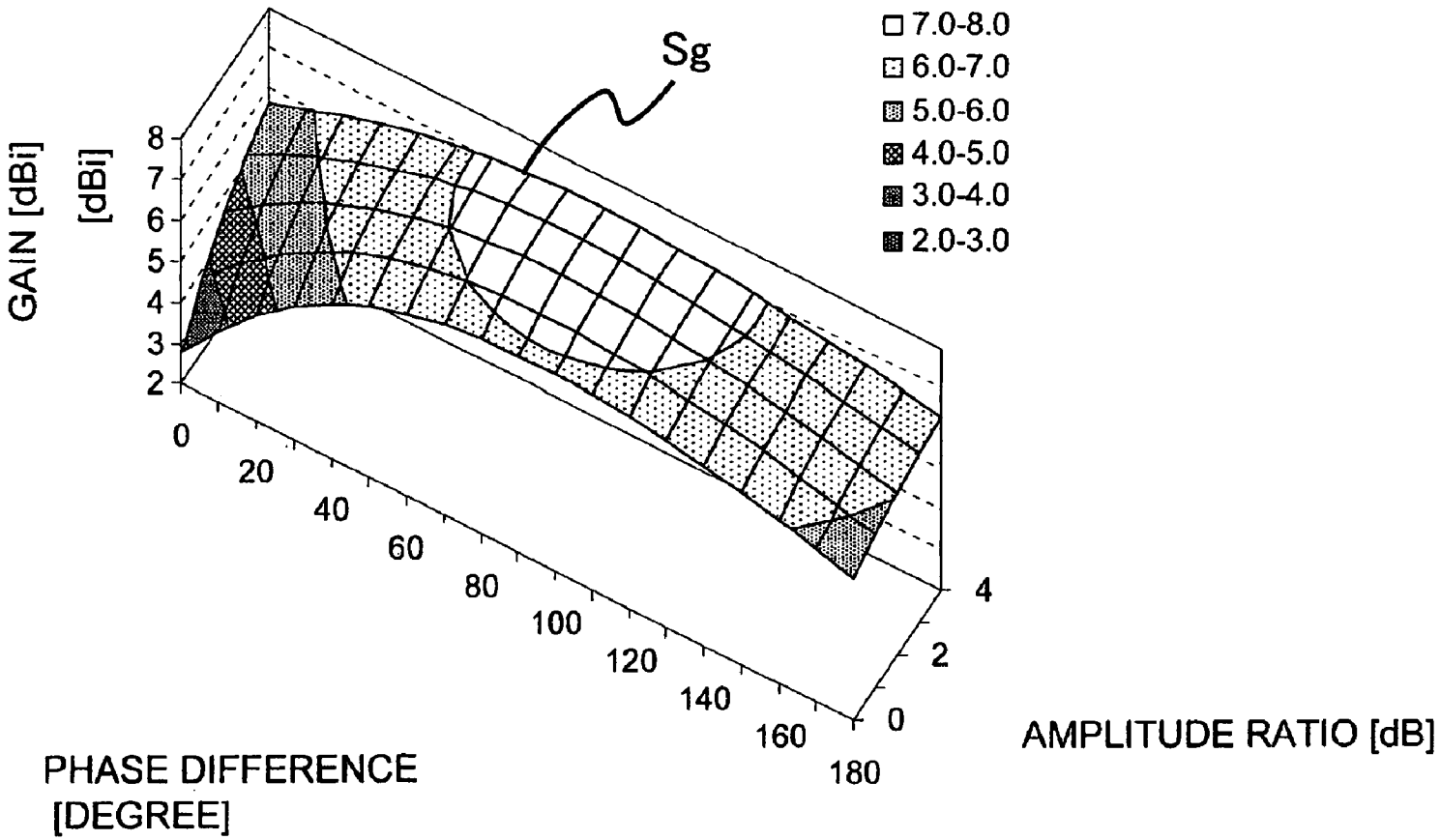
FIG. 34 is a correlation graph between a phase difference and an amplitude ratio, and a gain.
Figure 35:
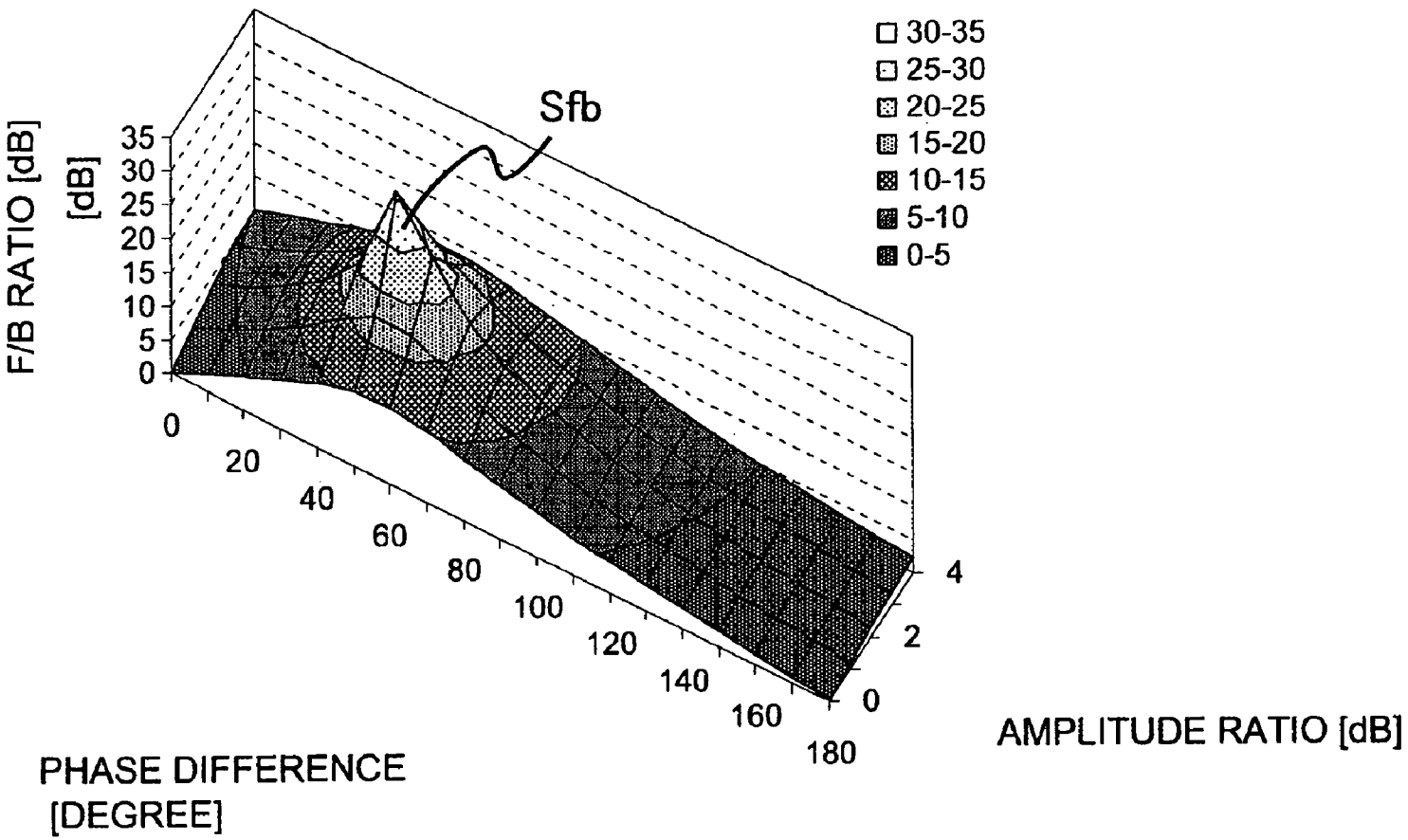
FIG. 35 is a correlation graph between a phase difference and an amplitude ratio, and an F/B ratio.

The inventor conducted the following simulation in order to check the optimal phase difference and amplitude ratio for obtaining the above function and advantageous effects. FIG. 34 is a correlation graph between a phase difference and an amplitude ratio, and a gain. FIG. 35 is a correlation graph between a phase difference and an amplitude ratio, and an F/B ratio. In this simulation, the patch antenna elements 1A and 1A' were configured so that the dielectric substrates 2A and 2A' each have a relative dielectric constant of 6.4, a width W of 15 mm, a length L of 80 mm and a thickness T of 15 mm, and arranged at an element interval D of 60 mm, and then an electric power having a frequency of 900 MHz was supplied from the power supply unit 100 to the patch antenna elements 1A and 1A'. Then, while varying the phase difference of the electric power W1 of the patch antenna element 1A against the electric power W2 of the patch antenna element 1A', the gain and the F/B ratio were analyzed for each amplitude ratio. The results are shown by the curved surfaces Sg and Sfb in FIG. 34 and FIG. 35. Here, in regard to the phase difference, as shown by the curved surfaces Sg and Sfb, when the phase difference is set within the range of about 60 degrees to 120 degrees, the gain and F/B ratio higher than or equal to 6 dB may be obtained. Normally, when the unit patch antenna elements having substantially the same size as the patch antenna elements of the antenna device 202 in this embodiment are used, the gain is about 3 to 4 dB, whereas in the antenna device 202 of this embodiment, it is possible to obtain a gain higher by about 2 dB with the same size. In addition, as shown by the curved surface Sg in FIG. 34, within the range of the above phase difference, even when there is no difference in amplitude between the radio waves from the patch antenna elements 1A and 1A' ("amplitude ratio is 0 dB" in FIG. 34 and FIG. 35), it is possible to obtain a gain higher than or equal to 5 dB. However, as shown by the curved surface Sfb in FIG. 35, when the amplitude of the radio wave of the patch antenna element 1A is set so as to be higher by 2 dB to 6 dB than the amplitude of the radio wave of the patch antenna element 1A', it is not only possible to increase the gain in the front direction of the antenna device 202 but also possible to considerably increase the F/B ratio.

As described above, according to the antenna device 202 of this embodiment, while the antenna device 202 is small, it is possible to obtain a high gain in the front direction and a large F/B ratio. In addition, because the patch antenna elements 1A and 1A' are used as elements, it is easy to match with an unbalanced circuit, such as a coaxial line. Thus, it is possible to efficiently supply an electric power from the power supply unit 100 to the antenna device 202. The other configuration, function and advantageous effects are similar to those of the first to fourth embodiments, so the description thereof is omitted.

Sixth Embodiment

Figure 36:
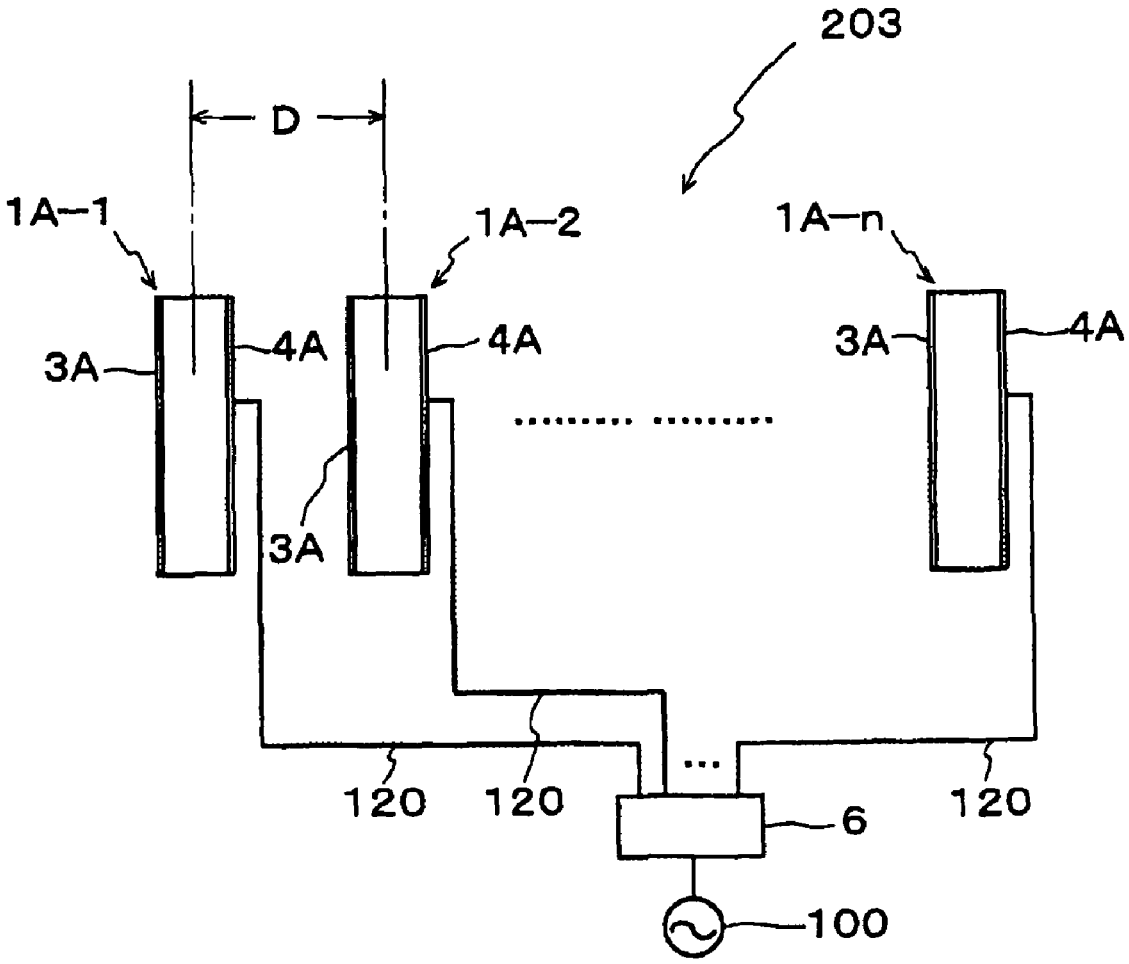
FIG. 36 is a schematic diagram that shows the configuration of an antenna device according to a sixth embodiment of the invention.
Figure 37:
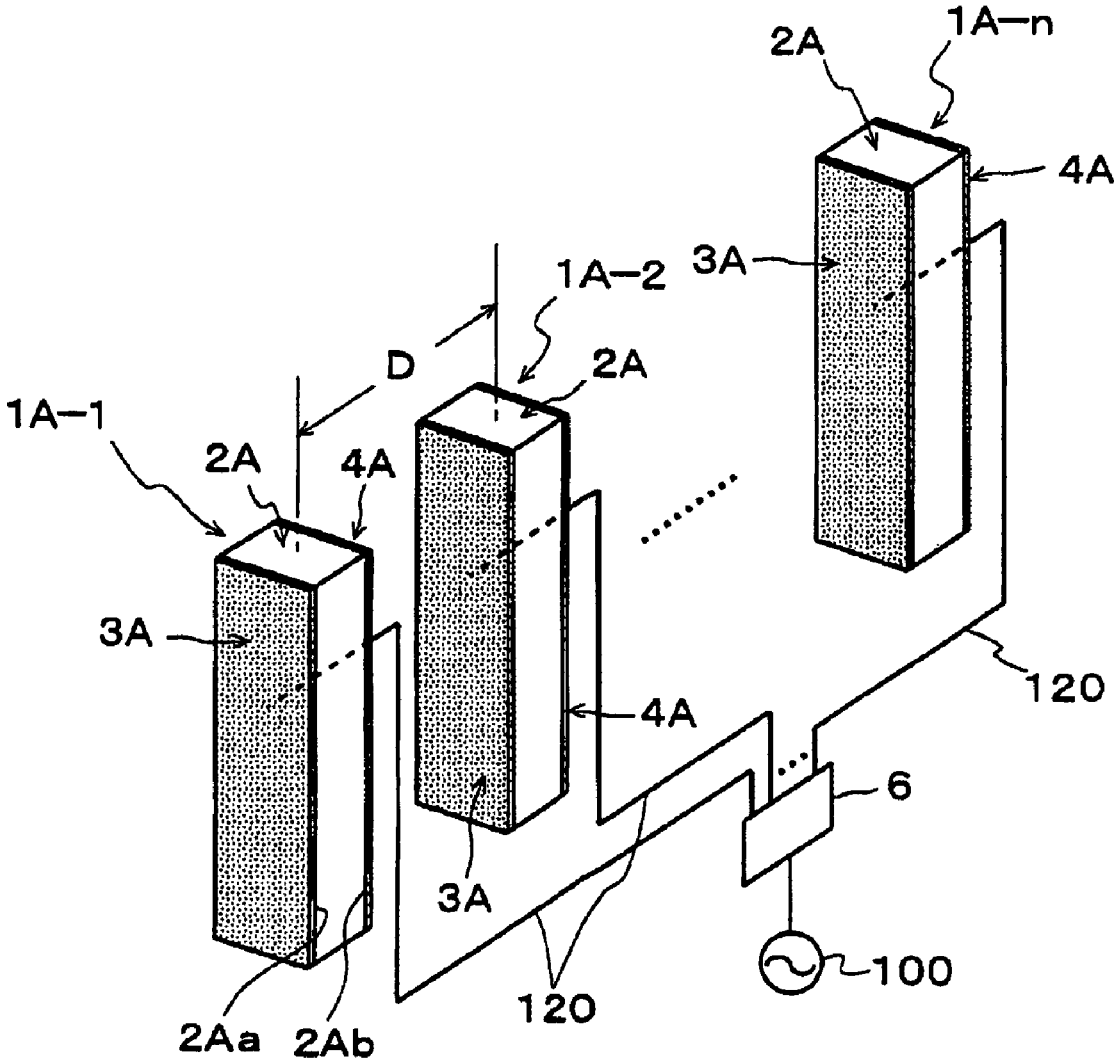
FIG. 37 is a perspective view that shows the configuration of the antenna device.

Next, a sixth embodiment of the invention will be described. FIG. 36 is a schematic diagram that shows the configuration of an antenna device according to the sixth embodiment of the invention. FIG. 37 is a perspective view that shows the configuration of the antenna device. As shown in FIG. 36, the antenna device 203 of this embodiment includes n (n is integer larger than or equal to 2) patch antenna elements 1A-1 to 1A-n, and a distributor 6 for outputting an electric power from a power supply unit 100 to the patch antenna elements 1A-1 to 1A-n with a predetermined phase difference.

Each patch antenna element 1A-1 (1A-2 to 1A-n) is a feeding element, and, as shown in FIG. 37, has the same structure as the first patch antenna element 1A that is employed in the fourth embodiment. That is, each patch antenna element 1A-1 (1A-2 to 1A-n) is formed of a dielectric substrate 2A, a first electrode 3A and a second electrode 4A, and is connected to a coaxial cable 120 that is extended from the power supply unit 100 through the distributor 6. The first electrode 3A and the second electrode 4A are formed respectively on the facing front face 2Aa and rear face 2Ab of the rectangular parallelepiped-shaped dielectric substrate 2A.

As shown in FIG. 36 and FIG. 37, the n patch antenna elements 1A-1 to 1A-n are arranged in a line at intervals D, and the subsequent patch antenna element 1A-(m+1) is located behind the preceding patch antenna element 1A-m ($1 \leqq m < n$). That is, the second electrode 4A of the preceding patch antenna element 1A-m ($1 \leqq m < n$) is arranged so as to face the first electrode 3A of the subsequent patch antenna element 1A-(m+1), and the radio wave radiation direction of each of the patch antenna elements 1A-1 to 1A-n is oriented in the front direction (left-hand side in FIG. 36). Then, the interval D between the preceding patch antenna element 1A-m and the subsequent patch antenna element 1A-(m+1) is set to substantially a quarter of the free space wavelength at the working frequency.

The distributor 6 is a known distributor. This distributor 6 operates so that the phase difference between the electric signals Wm and Wm+1 respectively supplied to the preceding and subsequent patch antenna elements 1A-m and 1A-(m+1) becomes 90°. In addition, the distributor 6 operates so that the electric signal Wm+1 supplied to the subsequent patch antenna element 1A-(m+1) advances by a phase difference of 90° from the electric signal Wm supplied to the preceding patch antenna element 1A-m. Thus, the phase of a radio wave radiated from the subsequent patch antenna element 1A-(m+1) advances by 90° from the phase of a radio wave radiated from the preceding patch antenna element 1A-m.

Figure 38:
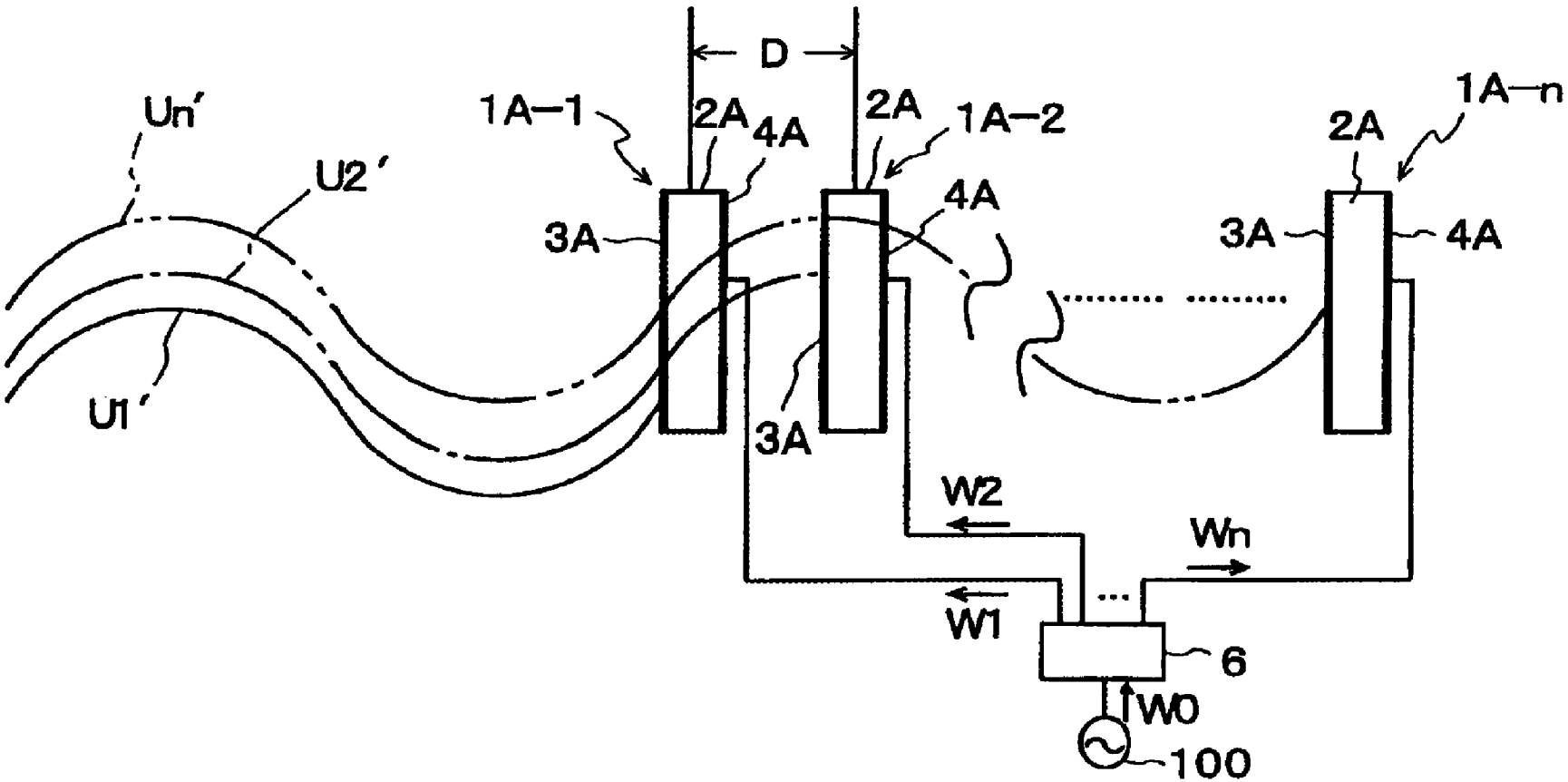
FIG. 38 is a schematic diagram that illustrates the function and advantageous effects of the antenna device.

Next, the function and advantageous effects of the antenna device according to this embodiment will be described. FIG. 38 is a schematic diagram that illustrates the function and advantageous effects of the antenna device. As shown in FIG. 38, when an electric signal W0 is output from the power supply unit 100, electric signals W1 to Wn having a phase difference of 90° are generated by the distributor 6, and these electric signal W1 to Wn are respectively supplied to the patch antenna elements 1A-1 to 1A-n. Thus, the radio wave Un' indicated by the alternate long and two short dashed lines is radiated from the last patch antenna element 1A-n, and the radio wave Un−1' is radiated from the preceding patch antenna element 1A-(n−1) with the phase delayed by 90° from the radio wave Un'. Then, the radio wave U2' indicated by the alternate long and short dashed line is radiated from the patch antenna element 1A-2 with the phase delayed by 90°×($n$−2) from the radio wave Un', and finally the radio wave U1' shown by the solid line is radiated from the patch antenna element 1A-1 with the phase delayed by 90°×(n−1) from the radio wave Un'. At this time, because the interval D between the adjacent patch antenna elements 1A-m and 1A-(m+1) is set to a quarter of the wavelength of each of the radio waves U1' to Un' radiated from the patch antenna elements 1A-1 to 1A-n, all the radio waves U1' to Un' radiated in the front direction of the patch antenna element 1A-1 coincide with one another. As a result, the gain of a radio wave radiated from the antenna device 203 increases in association with the number n of patch antenna elements.

Figure 39:
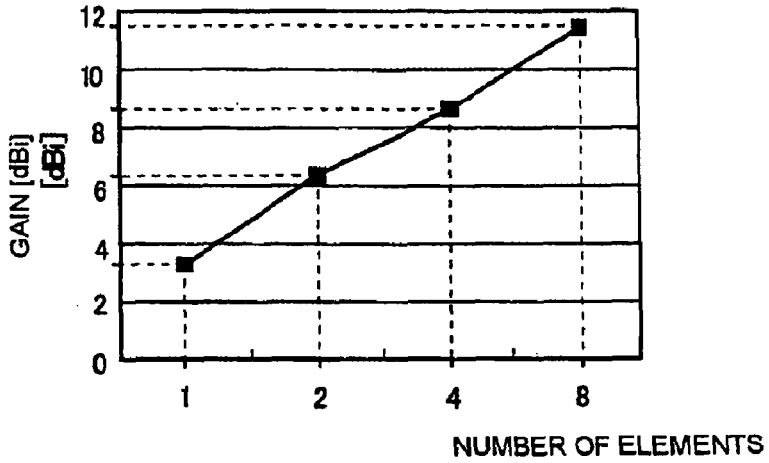
FIG. 39 is a correlation graph between the number of elements and a gain.

The inventor conducted the following simulation in order to check the above advantageous effects. FIG. 39 is a correlation graph between the number of elements and a gain. In this simulation as well, as in the case of the simulation of the fourth embodiment, the patch antenna elements were configured so that the dielectric substrates 2A each have a relative dielectric constant of 6.4, a width W of 15 mm, a length L of 80 mm and a thickness T of 15 mm, and then an electric signal having a frequency of 920 MHz was supplied to the patch antenna elements. Then, the number of patch antenna elements was varied, and the gain was analyzed for each number of elements. The results shown in FIG. 39 were obtained. As is apparent from the results shown in FIG. 39, it has been confirmed that in the antenna device 203 of this embodiment as well, by using the n patch antenna elements 1A-1 to 1A-n, the gain may be increased in association with the number n of patch antenna elements. The other configuration, function and advantageous effects are similar to those of the fourth embodiment, so the description thereof is omitted.

Seventh Embodiment

Figure 40:
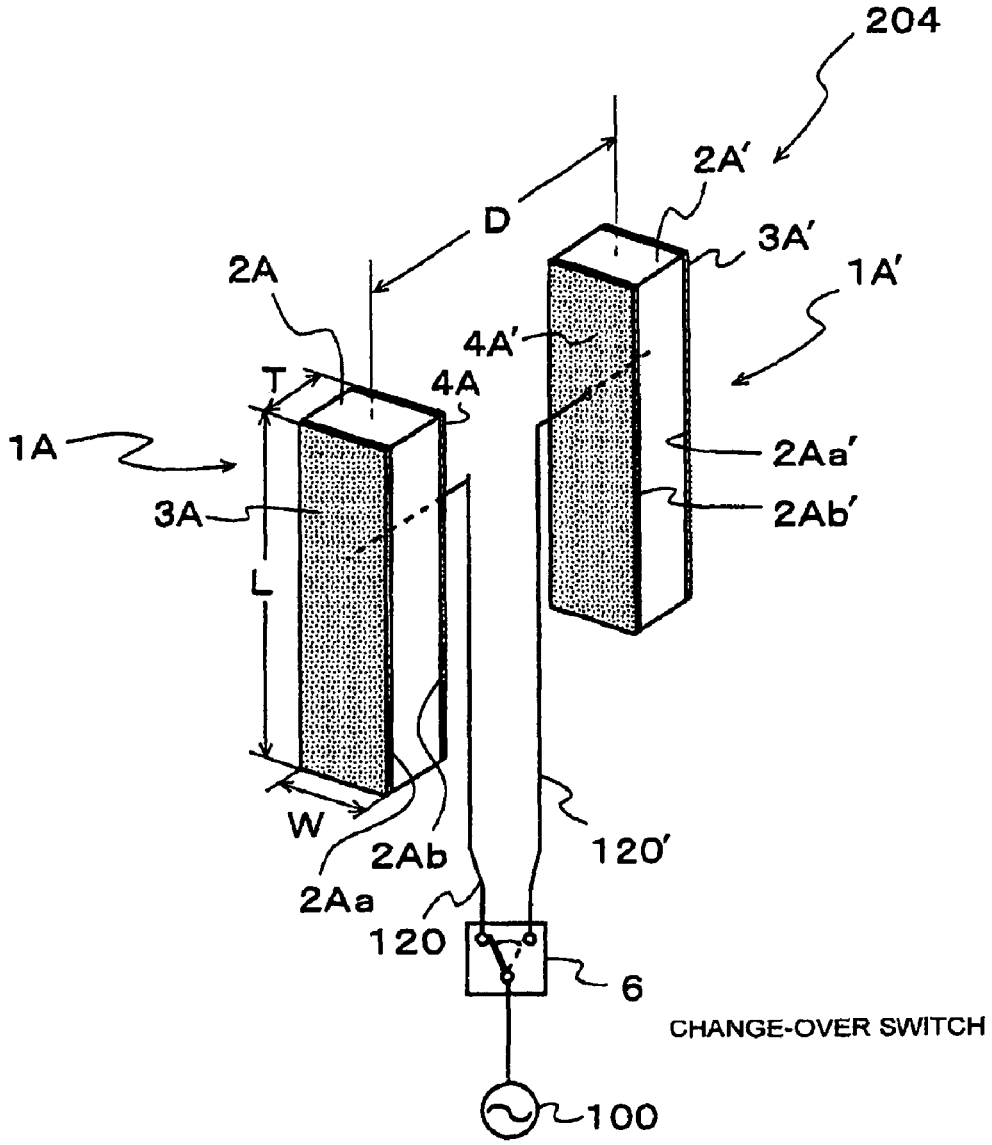
FIG. 40 is a schematic perspective view that shows an antenna device according to a seventh embodiment of the invention.
Figure 41:
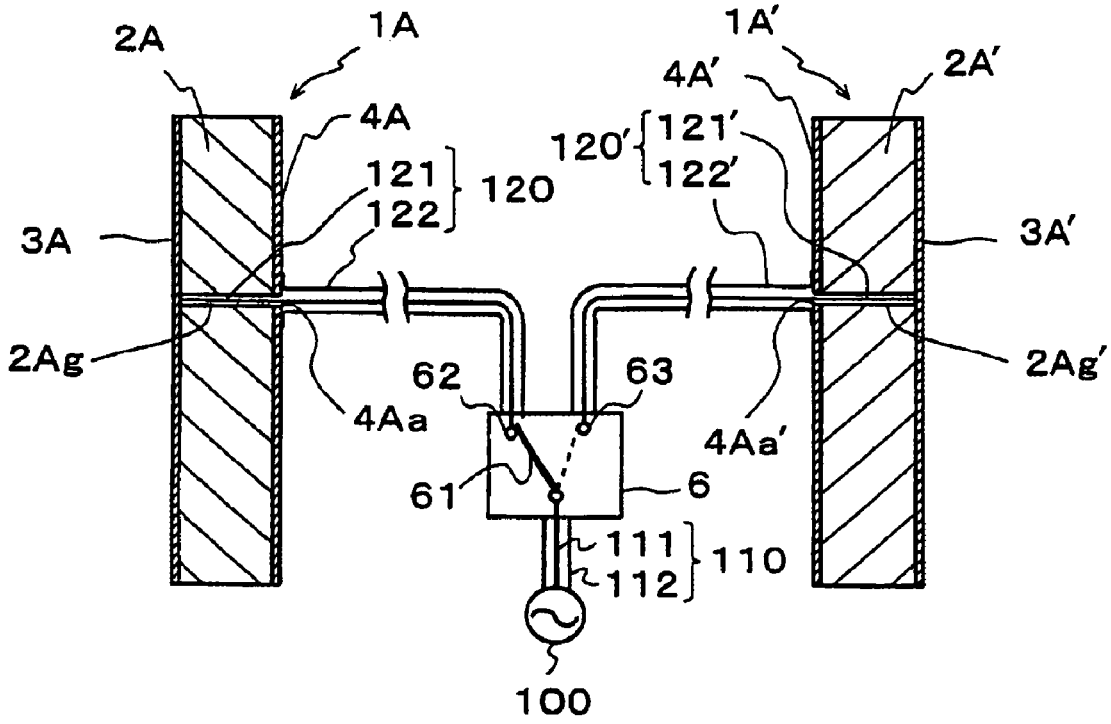
FIG. 41 is a schematic cross-sectional view that shows a state of connection among each patch antenna element, a change-over switch and a power supply unit.

FIG. 40 is a schematic perspective view that shows an antenna device according to a seventh embodiment of the invention. FIG. 41 is a schematic cross-sectional view that shows a state of connection among each patch antenna element, a change-over switch 6 and a power supply unit 100. As shown in FIG. 40, the antenna device 204 of this embodiment includes a pair of patch antenna elements 1A and 1A' arranged parallel to each other at a predetermined interval D; and the change-over switch 6. Specifically, in the antenna device 204, the patch antenna elements 1A and 1A' are arranged parallel to each other at the interval D so that an electrode 4A of a rear surface 2Ab of the patch antenna element 1A faces an electrode 4A' of a rear surface 2Ab' of the patch antenna element 1A', and coaxial cables 120 and 120' of the patch antenna elements 1A and 1A' are connected through the change-over switch 6 to the power supply unit 100.

As shown in FIG. 40, these patch antenna elements 1A and 1A' have the same shape, and the width W of each of the electrodes 3A and 3A' (4A and 4A') is shorter than the length L. That is, both the patch antenna elements 1A and 1A' each are formed into a long slender quadrangular prism in order to reduce in size in the width direction as compared with a typical square element.

As shown in FIG. 40, the coaxial cables 120 and 120' are respectively extended from these patch antenna elements 1A and 1A', and these coaxial cables 120 and 120' are connected through the change-over switch 6 to the power supply unit 100.

On the other hand, as shown in FIG. 41, the change-over switch 6 has a movable contact 61 and a pair of fixed contacts 62 and 63. Then, the movable contact 61 is connected to an internal conductor 111 of a coaxial cable 110 extended from the power supply unit 100, and the fixed contacts 62 and 63 are connected to internal conductors 121 and 121' of the respective coaxial cables 120 and 120'. Thus, when the movable contact 61 of the change-over switch 6 is brought into contact with the fixed contact 62 as shown by the solid line, the patch antenna element 1A serves as a feeding element, and the patch antenna element 1A' serves as a parasitic element. On the other hand, when the movable contact 61 is brought into contact with the fixed contact 63 as shown by the broken line, the patch antenna element 1A serves as a parasitic element, and the patch antenna element 1A' serves as a feeding element.

Figure 42:
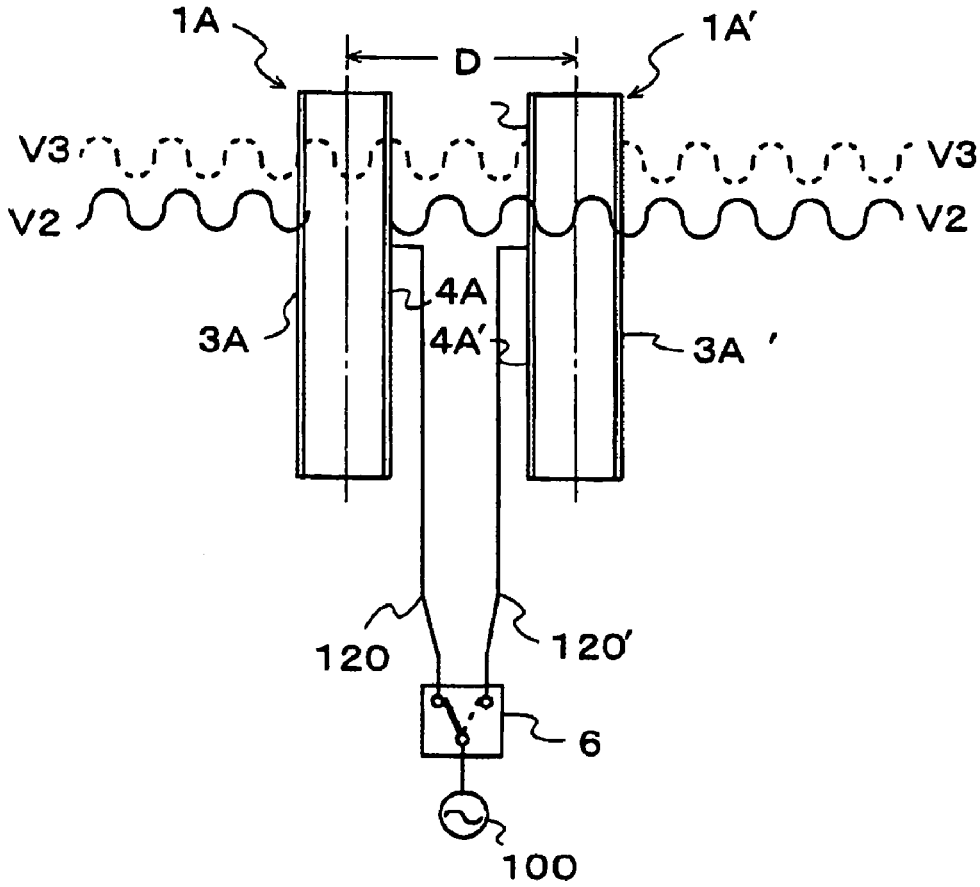
FIG. 42 is a schematic side view that illustrates the function and advantageous effects of the antenna device according to the seventh embodiment.
Figure 43:
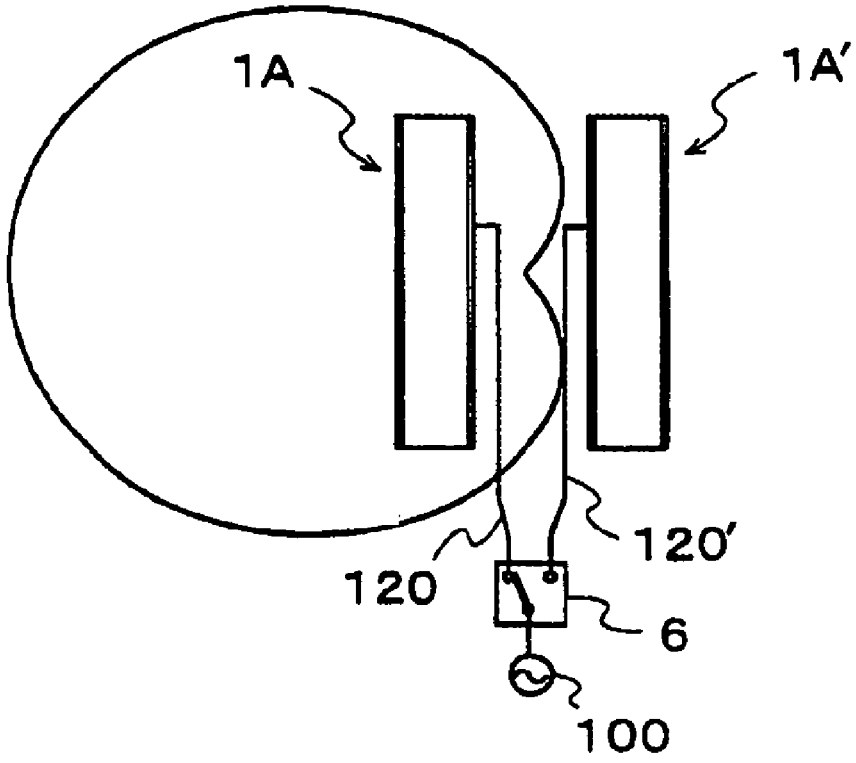
FIG. 43 is a schematic side view that shows the directivity when the left-hand side patch antenna element serves as a feeding element.
Figure 44:
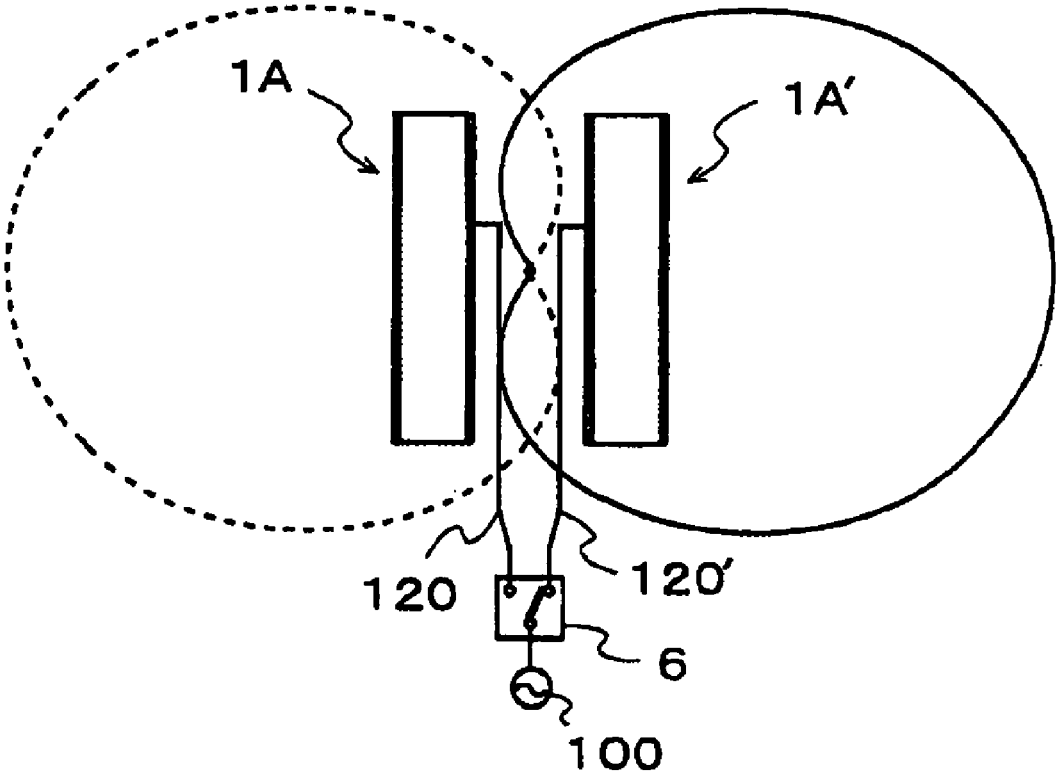
FIG. 44 is a schematic side view that shows the directivity when the right-hand side patch antenna element serves as a feeding element.

Next, the function and advantageous effects of the antenna device 204 according to this embodiment will be described. FIG. 42 is a schematic side view that illustrates the function and advantageous effects of the antenna device 204 according to this embodiment. FIG. 43 is a schematic side view that shows the directivity when the left-hand side patch antenna element 1A serves as a feeding element. FIG. 44 is a schematic side view that shows the directivity when the right-hand side patch antenna element 1A' serves as a feeding element. As shown by the solid line in FIG. 42, in a state where the movable contact 61 of the change-over switch 6 is in contact with the fixed contact 62, when a signal having a predetermined frequency is supplied from the power supply unit 100, the signal is supplied through the change-over switch 6 to the patch antenna element 1A. Thus, the patch antenna element 1A serves as a feeding element and is excited. As a result, the radio wave V2 shown by the solid line is radiated from the electrodes 3A and 4A of the patch antenna element 1A toward the front side and rear side of the patch antenna element 1A. On the other hand, in the above state, the patch antenna element 1A' serves as a parasitic element, and resonates with the radio wave V2 from the patch antenna element 1A. As a result, the radio wave V3 indicated by the broken line is radiated from the electrodes 3A' and 4A' of the patch antenna element 1A' toward the front side and rear side of the patch antenna element 1A'. At this time, when the length of the coaxial cable 120' extended from the patch antenna element 1A' is adjusted, and an additive reactance of the patch antenna element 1A' including the coaxial cable 120' is set, the patch antenna element 1A and the patch antenna element 1A' resonate with each other so as to have the same phase in the front direction (left-hand direction in FIG. 42) and, as a result, the gain of the antenna device 204 in the front direction increases. In addition, the radio wave V3 traveling toward the rear side (right-hand side in FIG. 42) of the patch antenna element 1A' is suppressed and, as a result, the F/B ratio of the antenna device 204 increases. That is, the patch antenna element 1A' operates as a reflector to increase the gain of a radio wave in the left-hand direction of the antenna device 204 and the F/B ratio of the antenna device 204. As a result, as shown in FIG. 43, the directivity of the antenna device 204 is biased in the left-hand direction.

Then, when the change-over switch 6 is changed, and, as shown by the broken line in FIG. 42, the movable contact 61 of the change-over switch 6 is brought into contact with the fixed contact 63, a signal from the power supply unit 100 is supplied through the change-over switch 6 to the patch antenna element 1A' and then the patch antenna element 1A' serves as a feeding element and is excited. As a result, the radio wave V3 indicated by the broken line is radiated from the patch antenna element 1A' toward the front side and rear side thereof. Then, in the above state, the patch antenna element 1A serves as a parasitic element and resonates with the radio wave V3 from the patch antenna element 1A', and then the radio wave V2 indicated by the solid line is radiated from the electrodes 3A and 4A of the patch antenna element 1A toward the front side and rear side of the patch antenna element 1A. At this time, as in the case of the above, when the length of the coaxial cable 120 extended from the patch antenna element 1A is adjusted, and an additive reactance of the patch antenna element 1A is adjusted, the patch antenna element 1A and the patch antenna element 1A' resonate with each other so as to have the same phase in the rear direction and, as a result, the gain of the antenna device 204 in the rear direction increases. In addition, the radio wave V2 traveling toward the front side of the patch antenna element 1A is suppressed. That is, when the change-over switch 6 is changed, the patch antenna element 1A operates as a reflector to increase the gain of a radio wave in the right-hand direction of the antenna device 204 and the F/B ratio of the antenna device 204. As a result, as shown in FIG. 44, the directivity of the antenna device 204 is changed in the right-hand direction.

As described above, according to the antenna device 204 of this embodiment, it is possible to obtain a high gain in the front direction or in the rear direction and a large F/B ratio while the size is small, and it is possible to easily change the directivity. In addition, because the patch antenna elements 1A and 1A' are used as elements, it is easy to match with an unbalanced circuit, such as a coaxial line. Thus, it is possible to efficiently supply a signal from the power supply unit 100 to the antenna device 204.

Figure 45A:
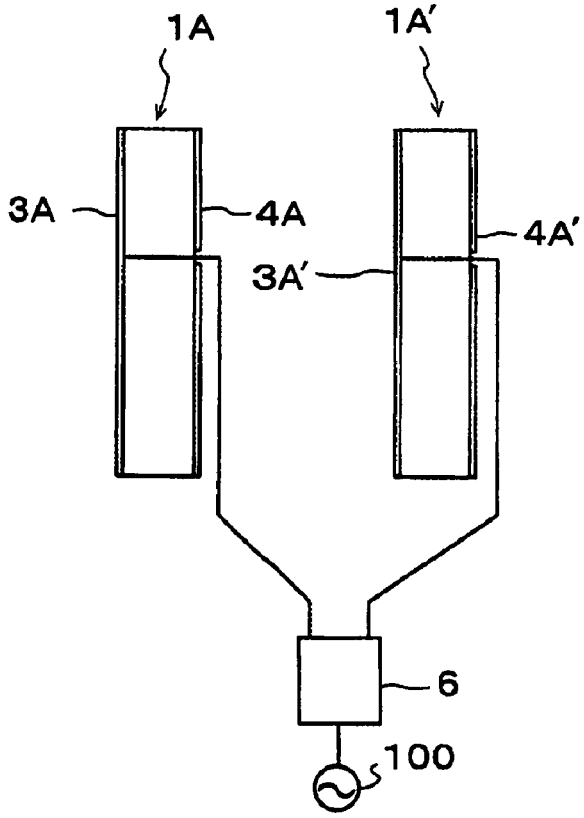
FIG. 45(*a*) and FIG. 45(*b*) are schematic side views that show the orientations of a pair of patch antenna elements, which serve as feeding elements.
Figure 45B:
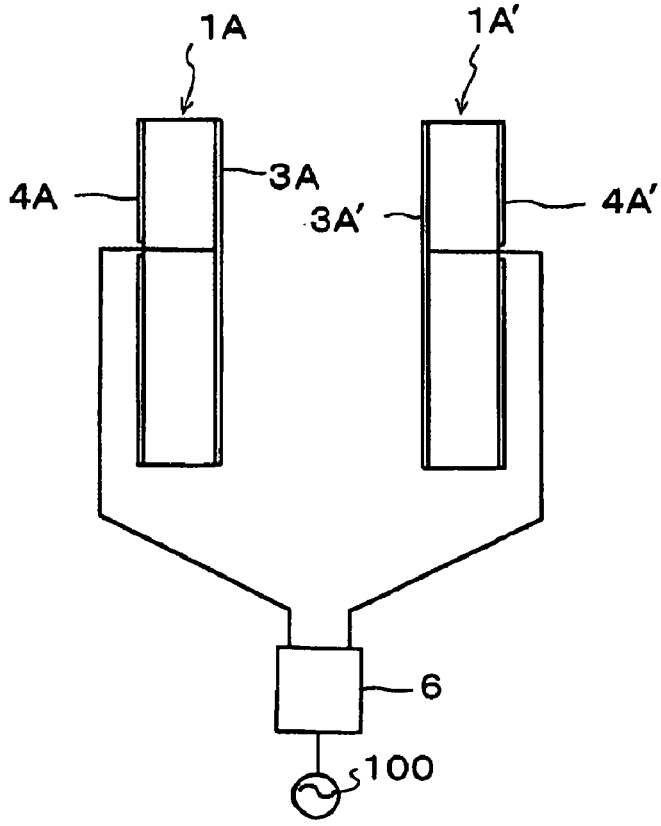

Note that in the antenna device 204 of this embodiment, the electrode 3A (3A') of the patch antenna element 1A (1A') is regarded as an antenna electrode, the electrode 4A (4A') is regarded as a ground electrode, and then the electrode 3A (3A') is oriented toward the front side, which is the radiation direction, whereas the electrode 4A (4A') is oriented toward the rear side. However, as in the case of this embodiment, when it is small and the electrodes 3A and 4A (3A' and 4A') have substantially the same size, it is difficult to clearly identify which is the ground electrode and which is the antenna electrode. Then, even when which one serves as the ground electrode and the other one serves as the antenna electrode, there is no large difference in antenna characteristic. Thus, even when the antenna device has the arrangement of the patch antenna elements 1A and 1A' as shown in FIG. 45, the similar function and advantageous effects to those of the antenna device 204 of the above embodiment are obtained. That is, even when the patch antenna element 1A' is oriented reversely with respect to the embodiment as shown in FIG. 45(*a*), or even when the patch antenna element 1A is oriented reversely with respect to the embodiment as shown in FIG. 45(*b*), the similar characteristic to that of the antenna device 204 of the embodiment may be achieved. The other configuration, function and advantageous effects are similar to those of the first to sixth embodiments, so the description thereof is omitted.

Eighth Embodiment

Figure 46:
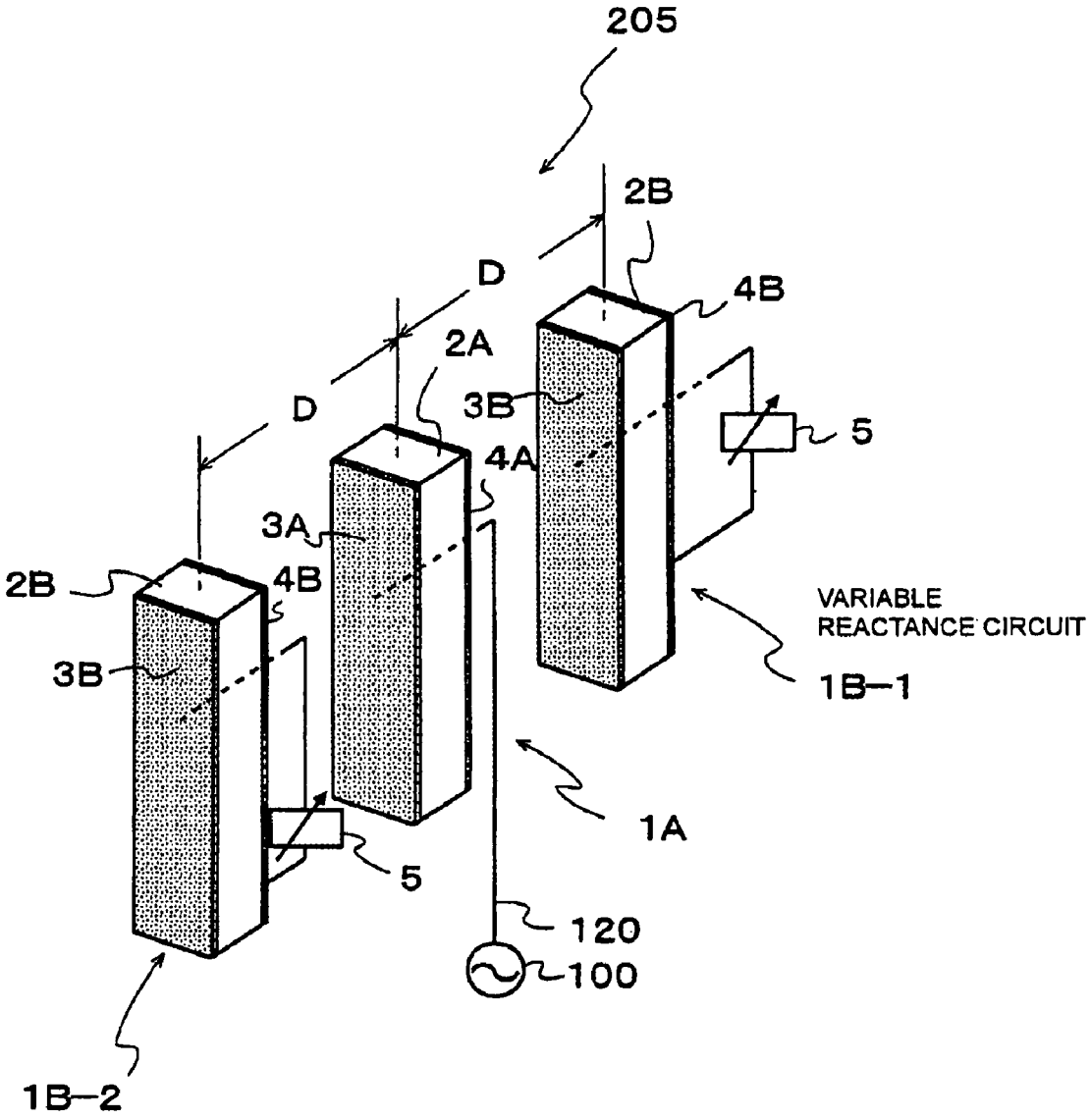
FIG. 46 is a schematic perspective view that shows an antenna device according to an eighth embodiment.
Figure 47:
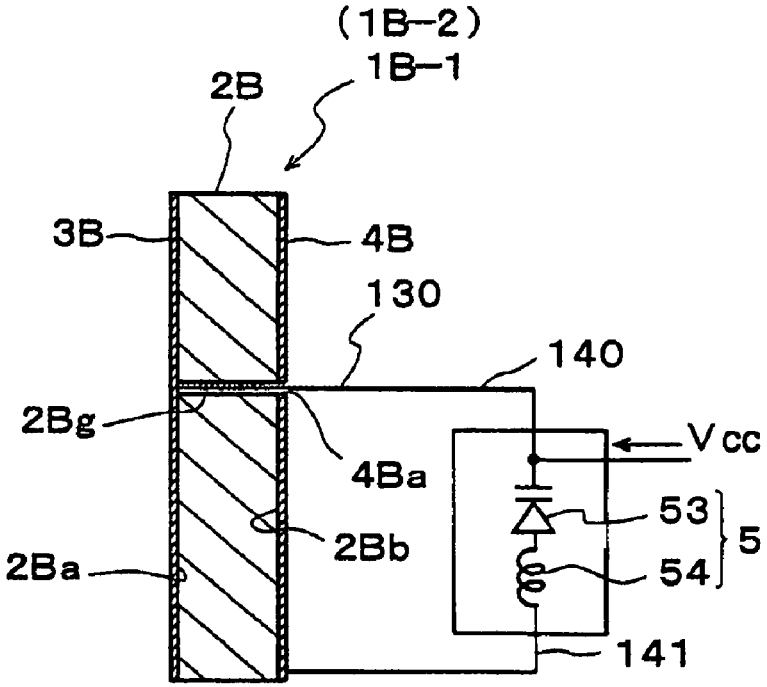
FIG. 47 is a schematic cross-sectional view that shows a patch antenna element, which serves as a parasitic element.

Next, an eighth embodiment of the invention will be described. FIG. 46 is a schematic perspective view that shows an antenna device according to the eighth embodiment of the invention. FIG. 47 is a schematic cross-sectional view that shows a patch antenna element, which serves as a parasitic element. As shown in FIG. 46, the antenna device 205 of this embodiment includes three patch antenna elements 1B-1, 1A, and 1B-2. These patch antenna elements 1B-1, 1A, and 1B-2 are arranged parallel to one another at predetermined intervals D so that electrodes 4A and 3B (4B and 3A) of the adjacent patch antenna elements 1A and 1B-1 (1B-2 and 1A) face each other. Then, the middle patch antenna element 1A serves as a feeding element that is connected to a power supply unit 100, and the patch antenna elements 1B-1 and 1B-2 located at both sides serve as parasitic elements, each having a variable reactance circuit 5.

The patch antenna element 1A is directly connected to the power supply unit 100 through a coaxial cable 120.

The variable reactance circuits 5 are respectively connected to the patch antenna elements 1B-1 and 1B-2, which serve as parasitic elements, and are terminated. Specifically, as shown in FIG. 47, holes 2Bg and 4Ba are formed respectively in the dielectric substrate 2B and the electrode 4B so as to reach the electrode 3B of each patch antenna element 1B-1 (1B-2), and a conductor wire 140 is inserted through the holes 2Bg and 4Ba. Thus, one end of the conductor wire 140 is connected to the electrode 3B, and the other end thereof is connected to an input end of the variable reactance circuit 5. Then, an output end of the variable reactance circuit 5 is connected to a conductor wire 141, while the conductor wire 141 is connected to the electrode 4B. The variable reactance circuit 5 may employ any known variable reactance circuit. In this embodiment, the variable reactance circuit 5 is formed of a variable capacitance diode. Specifically, a variable capacitance diode 53 and an inductor 54 are serially connected. The cathode side of the variable capacitance diode 53 is connected to the conductor wire 140, and one end of the inductor 54 is connected to the conductor wire 141. Thus, when the magnitude of a direct-current voltage Vcc applied to the cathode side of the variable capacitance diode 53 is varied to vary the capacitance of the variable capacitance diode 53, it is possible to adjust the reactance of the entire variable reactance circuit 5. Note that this variable reactance circuit 5, as well as a known variable reactance circuit, may vary its reactance from an inductive range to a capacitive range.

Figure 48:
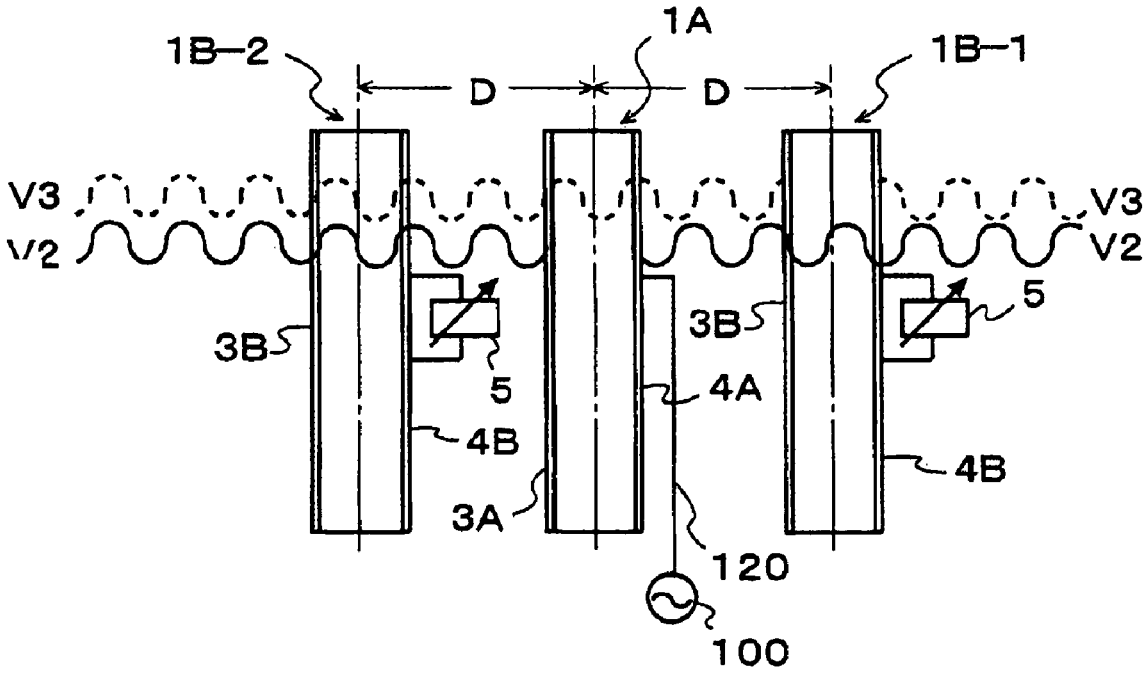
FIG. 48 is a schematic side view that illustrates the function and advantageous effects of the antenna device according to the eighth embodiment.
Figure 49:
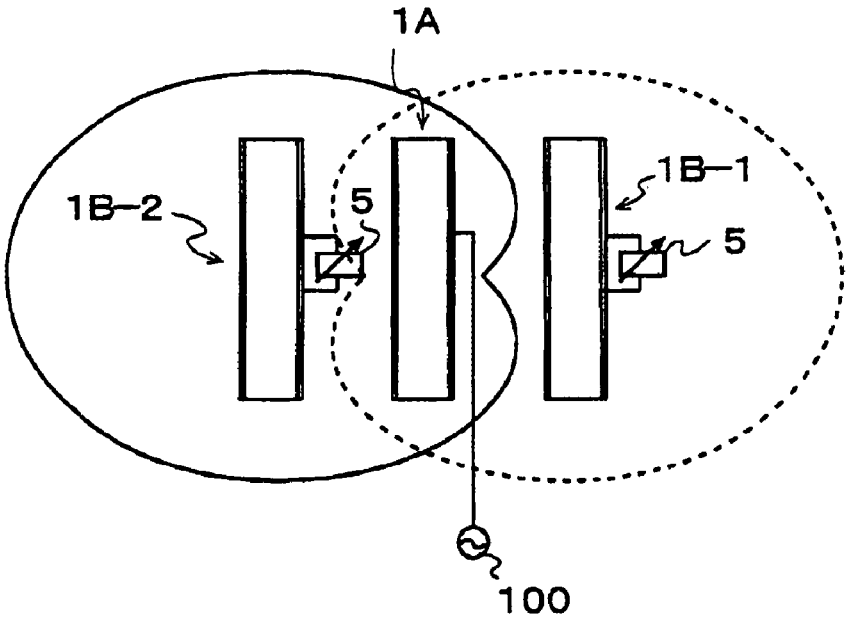
FIG. 49 is a schematic side view that shows the directivity of the antenna device.

Next, the function and advantageous effects of the antenna device 205 according to this embodiment will be described. FIG. 48 is a schematic side view that illustrates the function and advantageous effects of the antenna device 205 according to this embodiment. FIG. 49 is a schematic side view that shows the directivity of the antenna device 205. As shown in FIG. 48, a signal having a predetermined frequency is supplied from the power supply unit 100 through the coaxial cable 120 to the patch antenna element 1A, and the variable reactance circuit 5 of the patch antenna element 1B-1 is adjusted to an inductive reactance, while the variable reactance circuit 5 of the patch antenna element 1B-2 is adjusted to a capacitive reactance. Then, the patch antenna element 1B-1 serves as a reflector, the radio wave V2 traveling toward the rear side (right-hand direction in FIG. 48) of the patch antenna element 1A is suppressed, and the radio wave V2 traveling toward the front side (left-hand direction in FIG. 48) of the patch antenna element 1A increases. Thus, the gain of a radio wave in the front direction of the antenna device 205 increases, and the F/B ratio increases, and then the directivity shown by the solid line in FIG. 49 is obtained. On the other hand, when the variable reactance circuit 5 of the patch antenna element 1B-1 is adjusted to a capacitive reactance, and the variable reactance circuit 5 of the patch antenna element 1B-2 is adjusted to an inductive reactance, the patch antenna element 1B-2 serves as a reflector, and the antenna device 205 exhibits the directivity shown by the broken line in FIG. 49.

As described above, according to the antenna device 205 of this embodiment, while the antenna device 205 is small, it is not only possible to obtain a high gain in the front direction and a large F/B ratio but also possible to easily change the directivity of the antenna device 205 by the variable reactance circuits 5 of the patch antenna elements 1B-1 and 1B-2. The other configuration, function and advantageous effects are similar to those of the first to seventh embodiments, so the description thereof is omitted.

Ninth Embodiment

Figure 50:
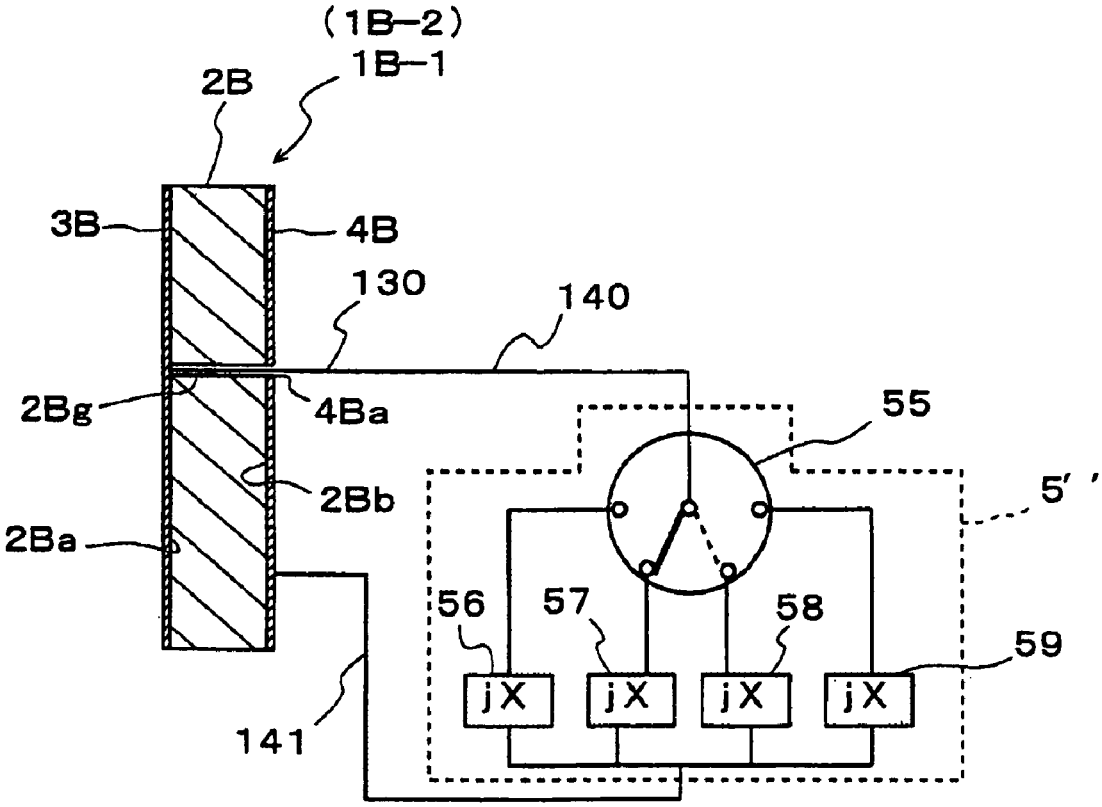
FIG. 50 is a cross-sectional view that shows a relevant part of an antenna device according to a ninth embodiment.

Next, a ninth embodiment of the invention will be described. FIG. 50 is a cross-sectional view that shows a relevant part of an antenna device according to the ninth embodiment of the invention. In the eighth embodiment, the variable reactance circuits 5 of the patch antenna elements 1B-1 and 1B-2 are configured as the variable capacitance diode 53 and the inductor 54, and the reactances of the variable reactance circuits 5 may be continuously varied. In contrast, in this embodiment, a variable reactance circuit 5", which is able to discretely vary the reactance, is employed. Specifically, as shown in FIG. 50, the variable reactance circuit 5" includes a change-over switch 55 and a plurality of fixed reactance circuits 56 to 59 having different reactances. Thus, by changing the change-over switch 55, any of the fixed reactance circuits 56 to 59 is connected to the patch antenna element 1B-1 (1B-2), thus making it possible to vary the reactance of the variable reactance circuit 5". The other configuration, function and advantageous effects are similar to those of the second embodiment, so the description thereof is omitted.

Further Embodiments

Note that the invention is not limited to the above embodiments, but it may be modified or changed in various forms within the scope of the invention.

Figure 51:
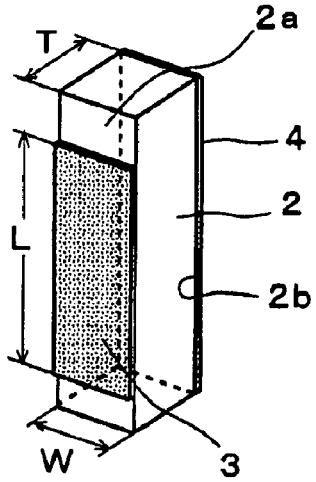
FIG. 51 is a perspective view that shows a first alternative embodiment of the above embodiments.

In the above embodiments, as shown in FIG. 1 or FIG. 11, it is illustrated that the overall length of the electrode 4 is equal or increased against the electrode 3 that is formed over the entire front surface 2*a* of the dielectric substrate 2. Of course, the scope of the invention encompasses the patch antenna device, as shown in FIG. 51, in which the first electrode 3, whose length L is shorter than the length of the front surface 2*a* of the dielectric substrate 2, is formed on the front surface 2*a*, and the overall length of the second electrode 4 is longer than the first electrode 3. In addition, in the second embodiment, it is illustrated that the electrode 4 is longer than the electrode 3, and the both end portions 41 and 42 are arranged so as to be bent onto the end surfaces 2*e* and 2*f* of the dielectric substrate 2. Instead, the length of at least one of the electrodes 3 and 4 may be longer than the length of each of the front surface 2*a* and rear surface 2*b* of the dielectric substrate 2, and that electrode may be arranged so as to be bent onto the end surfaces 2*e* and 2*f*. Thus, the scope of the invention also encompasses the invention in which the electrode 3 is longer than the electrode 4 and the end portion thereof is bent and arranged on the end surfaces 2*e* and 2*f* of the dielectric substrate 2.

Figure 52:
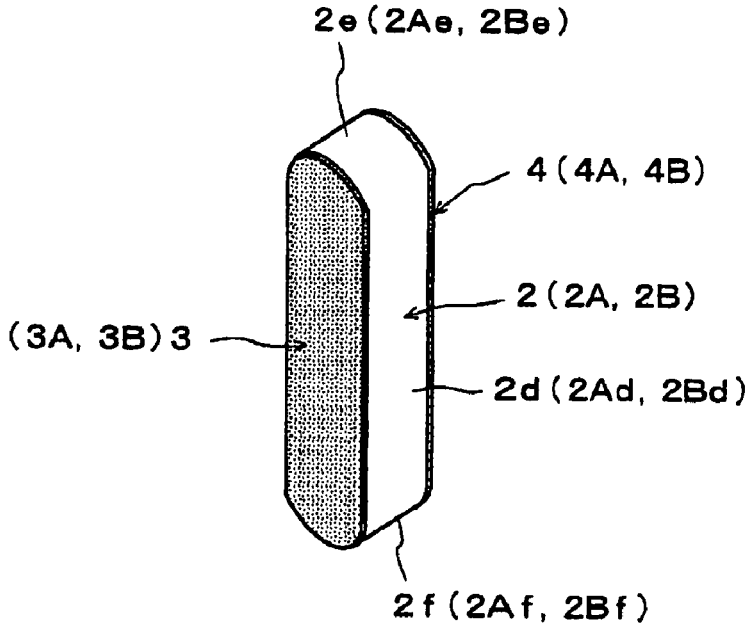
FIG. 52 is a perspective view that shows a second alternative embodiment of the above embodiments.
Figure 53:
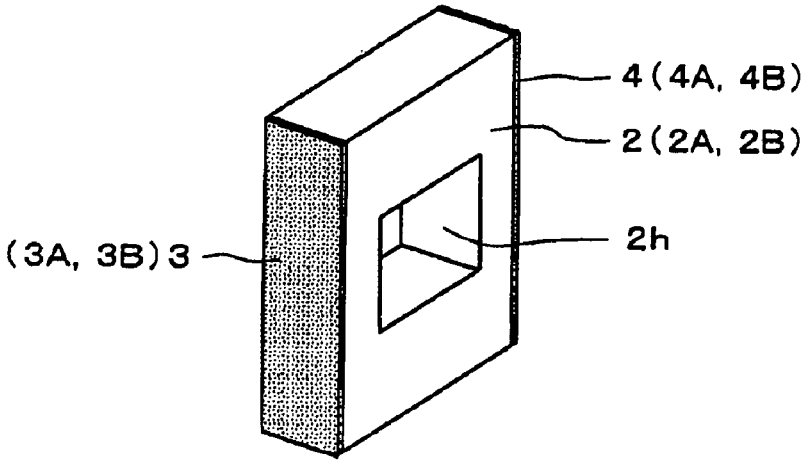
FIG. 53 is a perspective view that shows a third alternative embodiment of the above embodiments.

In addition, in the above embodiments, it is illustrated, as shown in FIG. 1, FIG. 14, or the like, the dielectric substrate 2 (2A, 2B) is formed into a rectangular parallelepiped shape, the electrodes 3 and 4 are formed all over the entire front surface 2*a* (2Aa, 2Ba) and rear surface 2*b* (2Ab, 2Bb), and then the patch antenna device (patch antenna element) is formed into a rectangular parallelepiped shape as a whole. Instead, as long as the width W, length L and thickness T of the patch antenna device 1 (patch antenna element) satisfy a predetermined condition, and the cross-sectional shape thereof has substantially a rectangular shape, the shape of the patch antenna device 1 (patch antenna element) is selectable. Thus, the scope of the invention also encompasses, for example, a patch antenna device (patch antenna element) whose end surfaces 2*e* and 2*f* (2Ae and 2Af, 2Be and 2Bf) have a circularly curved shape as shown in FIG. 52, and a patch antenna device (patch antenna element) in which a space 2*h* is provided at the center of the dielectric substrate 2 (2A, 2B) as shown in FIG. 53.

Figure 54:
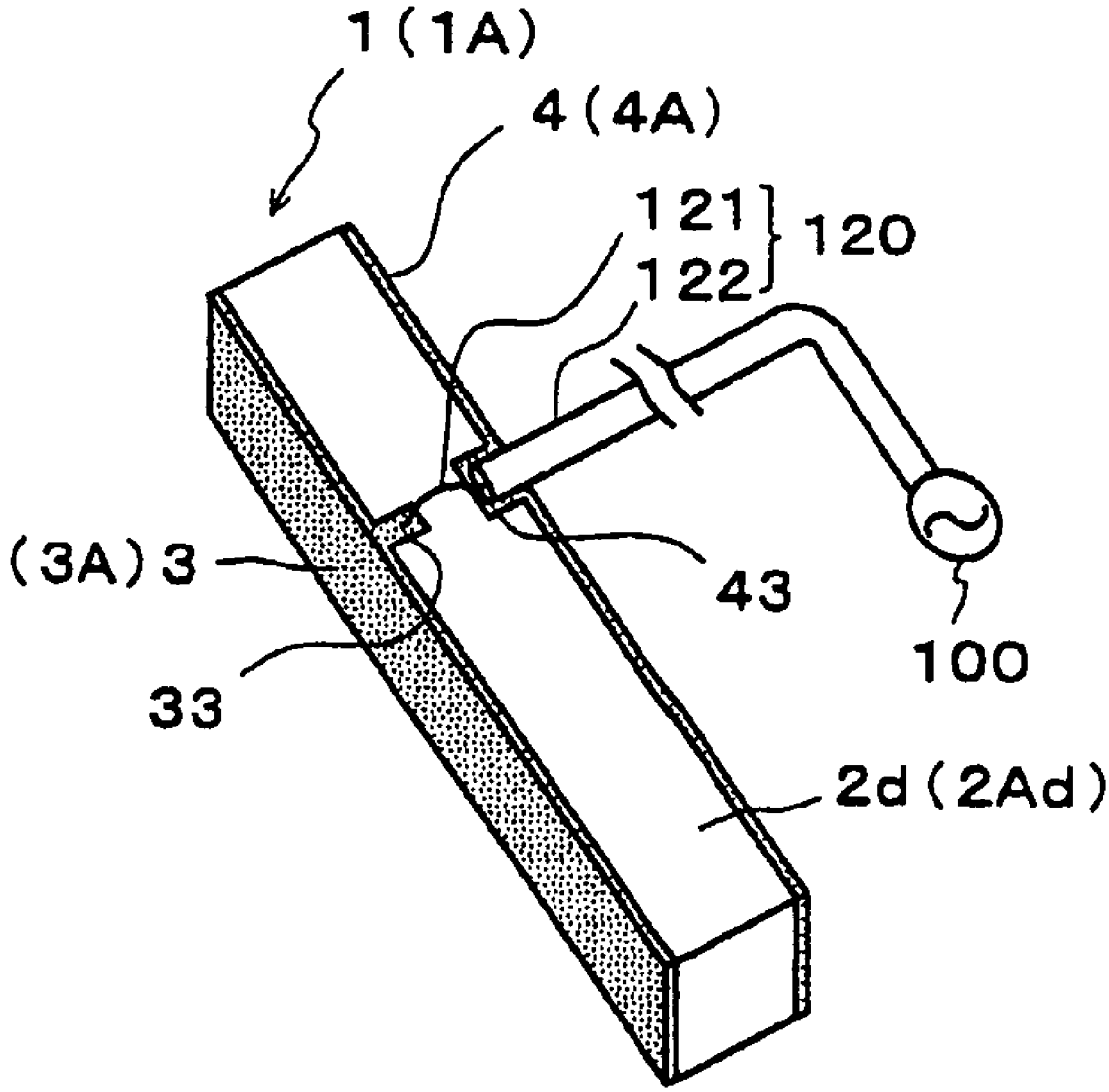
FIG. 54 is a perspective view that shows a fourth alternative embodiment of the above embodiments.

In the above embodiments, as shown in FIG. 2, FIG. 10, FIG. 16, FIG. 25, FIG. 32 and FIG. 41, the power supply structure that an electric power is supplied to the patch antenna device 1 (patch antenna element 1A), which serves as a feeding element, is such that the internal conductor 121 of the coaxial cable 120 extended from the power supply unit 100 is inserted into the holes 2*g* and 4*a* (2Ag and 4Aa) of the dielectric substrate 2 (2A) and electrode 4 (4A) of the patch antenna element 1 (1A) and connected to the electrode 3 (3A), and the external conductor 122 is connected to the electrode 4 (4A). However, the power supply structure is not limited to this. For example, as shown in FIG. 54, the coaxial cable 120 is connected to the side surface of the patch antenna device 1 (patch antenna element 1A) to thereby make it possible to supply an electric power without forming holes in the dielectric substrate 2 (2A) or in the electrode 4 (4A). That is, extended portions 33 and 43 of the electrode 3 and 4 (3A and 4A) are formed on the side surface 2*d* (2Ad) of the dielectric substrate 2 (2A), and the internal conductor 121 of the coaxial cable 120 is connected to the extended portion 33 of the electrode 3 (3A), and then the external conductor 122 is connected to the extended portion 43 of the electrode 4 (4A). Thus, it is possible to supply an electric power from the power supply unit 100 to the patch antenna device 1 (patch antenna element 1A). In addition, it is also possible to supply an electric power from the power supply unit 100 to the patch antenna device 1 (patch antenna element 1A) using electromagnetic coupling without using the coaxial cable 120.

Figure 55A:
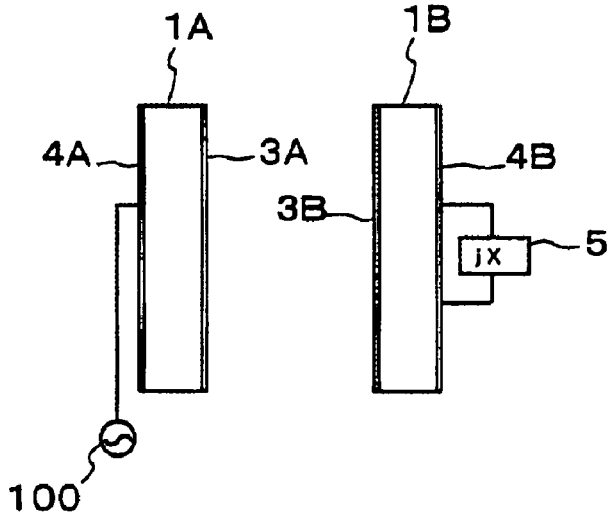
FIGS. 55(*a*)-55(*c*) are schematic side views that show fifth alternative embodiments of the above embodiments.
Figure 55B:
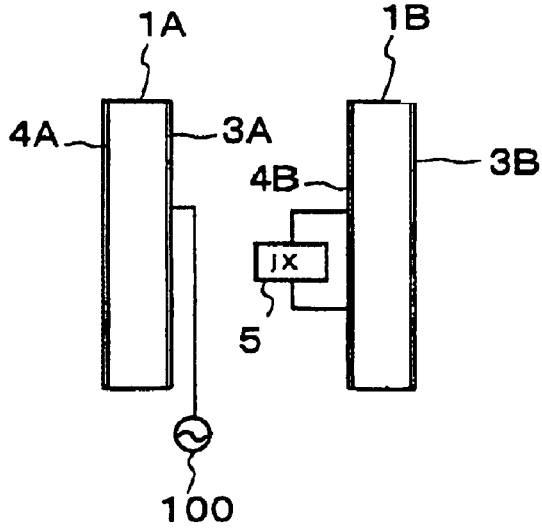
Figure 55C:
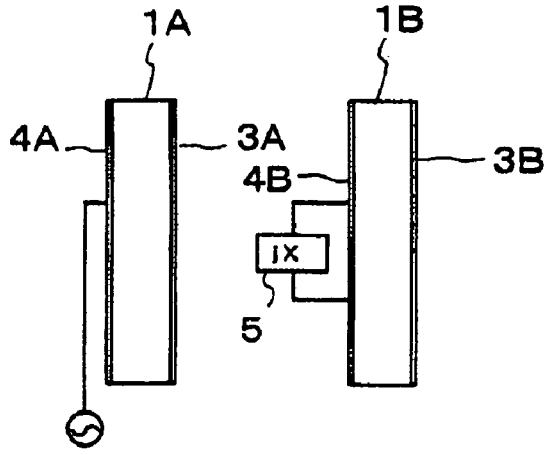

In addition, as described in the seventh embodiment, when it is small and the electrodes 3A and 4A (3B and 4B) have substantially the same size, it is difficult to clearly identify which is the ground electrode and which is the antenna electrode. Then, even when which one serves as the ground electrode and the other one serves as the antenna electrode, there is no large difference in antenna characteristic. Thus, even when the antenna device has the arrangement of the patch antenna elements 1A and 1B as shown in FIG. 55, the similar function and advantageous effects to those of the antenna device of the above embodiments are obtained. That is, even when the patch antenna element 1A is oriented reversely with respect to the normal orientation as shown in FIG. 55(*a*), or even when the patch antenna element 1B is oriented reversely with respect to the normal orientation as shown in FIG. 55(*b*), or both the patch antenna elements 1A and 1B are reversely oriented with respect to the normal orientation, the similar characteristic to those of the antenna devices of the above embodiments may be achieved. The scope of the invention also encompasses the antenna devices having the above described arrangements.

In addition, in the fourth embodiment, it is illustrated that, as shown in FIG. 23, the reactance circuit 5 is connected to the second patch antenna element 1B of each sub-array unit 210-1 (210-2 to 210-*n*). However, this is not intended to exclude the antenna device, which is formed of the sub-array units 210-1 to 210-*n* in which the reactance circuit 5 is not connected to each of the second patch antenna elements 1B, from the scope of the invention.

Although particular embodiments have been described, many other variations and modifications and other uses will become apparent to those skilled in the art. Therefore, the present invention is not limited by the specific disclosure herein.

What is claimed is:

1. An antenna device comprising:

a pair of patch antenna elements, each of which includes a dielectric substrate including at least two substantially parallel facing surfaces, and electrodes provided respectively on the at least two substantially parallel facing surfaces of the dielectric substrate; wherein the pair of patch antenna elements are arranged with said at least two substantially parallel facing surfaces substantially parallel to each other at a predetermined interval so that one of the electrodes of one of the pair of patch antenna elements faces one of the electrodes of the other one of the pair of patch antenna elements;

one of the pair of patch antenna elements is arranged to be connected to an RF source to serve as a feeding element, and the other one of the pair of patch antenna elements is arranged to serve as a parasitic element; and the pair of patch antenna elements are spaced apart from one another at the predetermined interval.

2. An antenna device comprising a pair of patch antenna elements, each of which has electrodes provided respectively on at least two substantially parallel facing faces of a dielectric substrate, wherein the pair of patch antenna elements are arranged with said faces substantially parallel to each other at a predetermined interval so that an electrode of one of the patch antenna elements faces an electrode of the other one of the patch antenna elements, and wherein one of the patch antenna elements is for being connected to an RF source to serve as a feeding element, and the other one of the patch antenna elements is for serving as a parasitic element; wherein each of said patch antenna elements is provided by a patch antenna device comprising:

a dielectric substrate which has a front surface and a rear surface facing each other and whose cross section taken perpendicularly to said front surface and said rear surface has substantially a rectangular shape;

a first electrode formed on the front surface of the dielectric substrate, for being connected to an RF source; and a second electrode formed on the rear surface of the dielectric substrate, wherein the width of the first electrode is smaller than or equal to a quarter of the length of the first electrode, said length defining an excitation direction, and the width of the second electrode is smaller than or equal to a quarter of the length of the second electrode, said second electrode being oriented in the excitation direction, and wherein the widths of each of the front surface and rear surface of the dielectric substrate is equal to the widths of each of the first and second electrodes, respectively and the thickness of the dielectric substrate is larger than or equal to the width of each of the first and second electrodes.

3. The patch antenna device according to claim 2, wherein the length of at least one of the first and second electrodes is longer than the length of the front surface or rear surface of the dielectric substrate, and both end portions of the at least one of the first and second electrodes in the longitudinal direction are bent and arranged on the corresponding end surfaces of the dielectric substrate.

4. The patch antenna device according to claim 2 or 3, wherein the length of the second electrode is longer than the length of the first electrode.

5. The antenna device according to claim 1 or 2, wherein the patch antenna element that serves as the parasitic element, is arranged at a position opposite to a radiation direction of the patch antenna element that serves as the feeding element.

6. The antenna device according to claim 1 or 2, wherein a reactance circuit is connected to the electrodes of the patch antenna element that serves as the parasitic element.

7. The antenna device according to claim 1 or 2, wherein the interval between the pair of patch antenna elements is set within the range of 0.12 times to 0.30 times a free space wavelength at a working frequency.

8. An antenna device comprising:

a sub-array unit including a pair of patch antenna elements, each of which includes a dielectric substrate including at least two substantially parallel facing surfaces, and electrodes provided respectively on the at least two substantially parallel facing surfaces of the dielectric substrate; wherein the pair of patch antenna elements are arranged with said at least two substantially parallel facing surfaces substantially parallel to each other at a predetermined interval so that one of the electrodes of one of the pair of patch antenna elements faces one of the electrodes of the other one of the pair of patch antenna elements;

one of the pair of patch antenna elements is arranged to be connected to an RF source to serve as a feeding element, and the other one of the pair of patch antenna elements is arranged to serve as a parasitic element;

a plurality of the sub-array units are arranged in a line at a predetermined interval so that the feeding element of the subsequent sub-array unit is located behind the parasitic element of the preceding sub-array unit;

one of the pair of patch antenna elements serves as a first patch antenna element and another one of the pair of patch antenna elements serves as a second patch antenna element, and one of the electrodes in each of the pair of patch antenna elements serves as a first electrode and the other one of the electrodes in each of the pair of patch antenna elements serves as a second electrode; and the plurality of sub-array units are arranged in a line at the predetermined interval so that the second electrode of the second patch antenna element of the preceding sub-array unit faces the first electrode of the first patch antenna element of the subsequent sub-array unit.

* * * * *